US011274878B2

(12) United States Patent
Choi et al.

(10) Patent No.: US 11,274,878 B2
(45) Date of Patent: Mar. 15, 2022

(54) REFRIGERATOR

(71) Applicant: LG Electronics Inc., Seoul (KR)

(72) Inventors: Daejin Choi, Seoul (KR); Donghoon Lee, Seoul (KR); Changwoan Yang, Seoul (KR); Dongjeong Kim, Seoul (KR); Wonsup Bae, Seoul (KR); Jinsung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/101,927

(22) Filed: Nov. 23, 2020

(65) Prior Publication Data

US 2021/0071945 A1 Mar. 11, 2021

Related U.S. Application Data

(63) Continuation of application No. 16/825,009, filed on Mar. 20, 2020, now Pat. No. 10,876,789, which is a (Continued)

(51) Int. Cl.

| | |
|---|---|
| ***A47B 96/04*** | (2006.01) |
| ***F25D 25/02*** | (2006.01) |
| ***A47B 88/457*** | (2017.01) |

(52) U.S. Cl.

CPC ..... *F25D 25/025* (2013.01); *A47B 88/457* (2017.01); *F25D 2700/02* (2013.01)

(58) Field of Classification Search

CPC .... F25D 25/04; F25D 25/025; F25D 2700/02; A47B 88/457; A47B 88/467

See application file for complete search history.

(56) References Cited

U.S. PATENT DOCUMENTS

| | | | |
|---|---|---|---|
| 2,761,751 | A | 9/1956 | Haines |
| 2,873,159 | A | 2/1959 | Alfred |

(Continued)

FOREIGN PATENT DOCUMENTS

| | | |
|---|---|---|
| CN | 2319653 | 5/1999 |
| CN | 1740713 | 3/2006 |

(Continued)

OTHER PUBLICATIONS

Chinese Office Action in Chinese Application No. 201680033647.1, dated Aug. 6, 2019, 41 pages (with English translation).

(Continued)

*Primary Examiner* — Matthew W Ing

(74) *Attorney, Agent, or Firm* — Fish & Richardson P.C.

(57) ABSTRACT

A refrigerator that is capable of enabling a user to easily introduce or remove goods into or from the refrigerator is described. Specifically, a refrigerator that is capable of enabling a drawer for receiving goods to be more conveniently used is described. The refrigerator includes a cabinet having a storage compartment with a food introduction port formed in the front thereof, a door hingedly connected to the cabinet for opening and closing the storage compartment, a plurality of drawers disposed in the storage compartment, the drawers being arranged vertically, a moving frame extending vertically so as to correspond to the height at which the drawers are disposed, the moving frame being configured to selectively push the drawers such that the drawers are moved toward the food introduction port, an electric driving unit coupled to the moving frame for moving the moving frame toward the food introduction port, and a controller for controlling the electric driving unit to move the moving frame when it is sensed that the door is open.

10 Claims, 34 Drawing Sheets

Related U.S. Application Data continuation of application No. 15/554,839, filed as application No. PCT/KR2016/012607 on Nov. 3, 2016, now Pat. No. 10,612,836.

(56) References Cited

U.S. PATENT DOCUMENTS

| | | | | |
|---|---|---|---|---|
| 2,984,533 | A | 5/1961 | Sundberg | |
| 3,019,070 | A | 1/1962 | Dieboid | |
| 5,070,319 | A | 12/1991 | Scuka | |
| 5,299,863 | A | 4/1994 | Albright, Jr. | |
| 5,479,152 | A | 12/1995 | Walker et al. | |
| 6,055,823 | A | 5/2000 | Baker et al. | |
| 6,971,730 | B2 | 12/2005 | Koons | |
| 8,061,790 | B2 | 11/2011 | Anikhindi et al. | |
| 8,067,915 | B2 | 11/2011 | Hooker et al. | |
| 8,152,254 | B2 | 4/2012 | Kim | |
| 8,277,004 | B2 | 10/2012 | Chung | |
| 8,305,023 | B2 | 11/2012 | Eom et al. | |
| 8,382,218 | B2 | 2/2013 | Placke et al. | |
| 8,459,757 | B2 | 6/2013 | Gasser | |
| 8,562,087 | B2 | 10/2013 | Eom et al. | |
| 8,668,289 | B2 | 3/2014 | Lee et al. | |
| 8,991,953 | B2 | 3/2015 | Lee et al. | |
| 9,429,354 | B2 | 8/2016 | Ha et al. | |
| 10,139,154 | B2 * | 11/2018 | Lee | A47B 88/497 |
| 10,145,605 | B2 | 12/2018 | Yang et al. | |
| 10,180,279 | B2 | 1/2019 | Yang et al. | |
| 10,520,246 | B2 * | 12/2019 | Choi | F25D 25/025 |
| 10,557,662 | B2 * | 2/2020 | Choi | A47B 88/457 |
| 10,612,836 | B2 * | 4/2020 | Choi | A47B 88/457 |
| 10,724,787 | B2 * | 7/2020 | Choi | F25D 23/02 |
| 10,876,789 | B2 * | 12/2020 | Choi | A47B 88/457 |
| 2001/0008037 | A1 | 7/2001 | Brustle | |
| 2004/0164654 | A1 | 8/2004 | Laible | |
| 2007/0101539 | A1 | 5/2007 | Sutterlutti et al. | |
| 2009/0160297 | A1 | 6/2009 | Anikhindi et al. | |
| 2009/0241567 | A1 | 10/2009 | Hausmann et al. | |
| 2010/0001624 | A1 | 1/2010 | Placke et al. | |
| 2010/0236277 | A1 | 9/2010 | Eom et al. | |
| 2010/0307186 | A1 | 12/2010 | Kwon et al. | |
| 2011/0050065 | A1 | 3/2011 | Lee et al. | |
| 2011/0095670 | A1 | 4/2011 | Cho et al. | |
| 2013/0055543 | A1 | 3/2013 | Rotter | |
| 2013/0127322 | A1 | 5/2013 | Seo et al. | |
| 2014/0285081 | A1 | 9/2014 | Wu et al. | |
| 2015/0027247 | A1 | 1/2015 | Kamada | |
| 2016/0216027 | A1 | 7/2016 | Go et al. | |
| 2018/0038632 | A1 | 2/2018 | Yang et al. | |

FOREIGN PATENT DOCUMENTS

| | | |
|---|---|---|
| CN | 101167614 | 4/2008 |
| CN | 101240970 | 8/2008 |
| CN | 101849747 | 10/2010 |
| CN | 101896094 | 11/2010 |
| CN | 101949627 | 1/2011 |
| CN | 101981397 | 2/2011 |
| CN | 201964715 | 9/2011 |
| CN | 102297559 | 12/2011 |
| CN | 102449416 | 5/2012 |
| CN | 103123199 | 5/2013 |
| CN | 102226626 | 7/2013 |
| CN | 204421453 | 6/2015 |
| DE | 202007013337 | 2/2009 |
| EP | 2283294 | 2/2011 |
| EP | 2284464 | 2/2011 |
| EP | 2299215 | 3/2011 |
| JP | 2007303109 | 11/2007 |
| JP | 2009228911 | 10/2009 |
| JP | 2015042898 | 3/2015 |
| KR | 19990054661 | 7/1999 |
| KR | 1020040019191 | 3/2004 |
| KR | 1020060045235 | 5/2006 |
| KR | 200419191 | 6/2006 |
| KR | 1020070114982 | 12/2007 |
| KR | 20090080239 | 7/2009 |
| KR | 1020090102575 | 9/2009 |
| KR | 1020090102577 | 9/2009 |
| KR | 1020100105266 | 9/2010 |
| KR | 1020100126168 | 12/2010 |
| KR | 1020100130357 | 12/2010 |
| KR | 20110004704 | 1/2011 |
| KR | 1020110019242 | 2/2011 |
| KR | 1020110022849 | 3/2011 |
| KR | 1020110024883 | 3/2011 |
| KR | 20110080021 | 7/2011 |
| KR | 20110088360 | 8/2011 |
| KR | 1020110089536 | 8/2011 |
| KR | 20110121174 | 11/2011 |
| KR | 20120082992 | 7/2012 |
| KR | 1020130071922 | 7/2013 |
| KR | 20140036871 | 3/2014 |
| KR | 20140074520 | 6/2014 |
| KR | 20150045256 | 4/2015 |
| KR | 1020150076949 | 7/2015 |
| KR | 20170052410 | 5/2017 |
| WO | WO2015131778 | 9/2015 |

OTHER PUBLICATIONS

European Office Action in European Application No. 16862452.6, dated Jul. 1, 2019, 5 pages.
European Search Report in European Application No. 16862452.6, dated Jul. 23, 2018, 8 pages.
International Search Report in International Application No. PCT/KR2016/012607, dated Feb. 23, 2017, 36 pages (with partial English translation).
Korean Notice of Allowance in Korean Application No. 10-2016-0001300, dated Aug. 6, 2019, 1 page (with English translation).
Korean Notice of Allowance in Korean Application No. 10-2019-0140008, dated Jun. 2, 2020, 6 pages (with English translation).
Machine translation of Wakasa (JP2009228911) (Year: 2019).
Taiwan Office Action in Taiwan Application No. 105135937, dated Jun. 27, 2017, 18 pages (with English translation).
Taiwan Office Action in Taiwanese Application No. 105135937, dated Jan. 2, 2018, 22 pages (with English translation).
United States Final Office Action in U.S. Appl. No. 15/692,431, dated Nov. 27, 2019, 19 pages.
United States Office Action in U.S. Appl. No. 15/692,431, dated May 16, 2019, 23 pages.
U.S. Office Action in U.S. Appl. No. 15/692,312, dated Feb. 26, 2019, 16 pages.
KR Office Action in Korean Appln. No. 10-2021-0020452, dated Apr. 12, 2021, 11 pages (with English translation).
Korean Notice of Allowance in Korean Application No. 10-2020-0109499, dated Nov. 24, 2020, 2 pages (with English translation).
Office Action in Korean Appln. No. 10-2021-0020452, dated Jul. 1, 2021, 1 page (English translation only).
Extended European Search Report in European Appln. No. 21167764.6, dated Aug. 24, 2021, 6 pages.
Notice of Allowance in Korean Appln. No. 10-2019-0156820, dated Sep. 16, 2021, 3 pages (with English translation).
Office Action in Chinese Appln. No. 202011217885.2, dated Nov. 2, 2021, 17 pages (with English translation).
Office Action in Chinese Appln. No. 202011218264.6, dated Nov. 8, 2021, 17 pages (with English translation).
Office Action in Korean Appln. No. 10-2019-0156815, dated Sep. 16, 2021, 11 pages (with English translation).
Office Action in Korean Appln. No. 10-2021-0126950, dated Oct. 15, 2021, 13 pages (with English translation).
Notice of Allowance in Korean Appln. No. 10-2019-0156814, dated Dec. 1, 2021, 3 pages (with English translation).
Office Action in Chinese Appln. No. 202011219346.2, dated Nov. 17, 2021, 14 pages (with English translation).

* cited by examiner

REFRIGERATOR

CROSS-REFERENCE TO RELATED APPLICATIONS

This application is a continuation of U.S. application Ser. No. 16/825,009, filed on Mar. 20, 2020, now allowed, which is a continuation of U.S. application Ser. No. 15/554,839, filed on Aug. 31, 2017, now U.S. Pat. No. 10,612,836, which is a National Stage application under 35 U.S.C. § 371 of International Application No. PCT/KR2016/012607, filed Nov. 3, 2016, which claims the benefit of Korean Application No. 10-2016-0001300, filed on Jan. 5, 2016 and Korean Application No. 10-2015-0154816, filed on Nov. 4, 2015. The disclosures of the prior applications are incorporated by reference in their entirety.

TECHNICAL FIELD

The present disclosure relates to a refrigerator. Specifically, the present disclosure relates to a refrigerator that is capable of enabling a user to easily introduce or remove goods into or from the refrigerator. More specifically, the present disclosure relates to a refrigerator that is capable of enabling a drawer for receiving goods to be more conveniently used.

BACKGROUND

In general, a refrigerator is an appliance that discharges cool air, generated using a refrigeration cycle that uses a compressor, a condenser, an expansion valve, and an evaporator, for lowering the temperature in the refrigerator to store foods in a frozen state or in a refrigerated state.

A refrigerator generally includes a freezing compartment for storing foods or beverages in a frozen state and a refrigerating compartment for storing foods or beverages in a refrigerated state.

Refrigerators may be classified into a top mount type refrigerator configured such that a freezing compartment is disposed on a refrigerating compartment, a bottom freezer type refrigerator configured such that a freezing compartment is disposed under a refrigerating compartment, and a side by side type refrigerator configured such that a freezing compartment and a refrigerating compartment are arranged side by side. Doors are provided at the freezing compartment and the refrigerating compartment. A user may access the freezing compartment or the refrigerating compartment by opening a corresponding one of the doors.

In addition, there is a refrigerator configured such that a user may access the freezing compartment and the refrigerating compartment by opening a single door. In general, this type of refrigerator is a small-sized refrigerator configured such that the freezing compartment is provided in a predetermined space within the refrigerating compartment.

Furthermore, there is a French type refrigerator, which is a modification of the top mount type refrigerator, configured such that the upper refrigerating compartment is opened and closed by left and right doors. Of course, the freezing compartment of the French type refrigerator may be opened and closed by left and right doors.

In general, shelves, on which goods are placed, or receiving boxes, in which good are received, are disposed in the refrigerating compartment and the freezing compartment. The receiving boxes are generally provided to form independent storage spaces in the storage compartment. That is, the receiving boxes may be provided in order to store vegetables or fruits separately from other goods or to store meat or fish separately from other goods.

In recent years, the capacity of refrigerators has been gradually increased. Accordingly, the forward and rearward width of the storage compartment is increased, with the result that it is not easy to withdraw goods that are stored deep inside the storage compartment. For this reason, most of the receiving boxes are configured to have a drawer form. That is, the user may pull the receiving boxes in order to take goods out from the receiving boxes. In particular, the drawer type receiving boxes are generally provided in the lower region of the refrigerator in order to improve user convenience.

In addition, in recent years, a home bar, an ice maker, a shelf, and a door box have been increasingly frequently mounted at the rear of the door of the refrigerator in order to use the rear of the door as an additional storage space or an additional functional space. That is, the door has additional functions, such as the provision of additional storage space or the production and supply of ice or cold water, in addition to simply opening and closing the freezing compartment or the refrigerating compartment. For these reasons, the distance by which the rear of the door is inserted into the refrigerating compartment or the freezing compartment is further increased. As a result, the fronts of the shelves or the receiving boxes provided in the refrigerating compartment or the freezing compartment may interfere with the rear of the door.

In order to reduce such interference, the fronts of the shelves or the receiving boxes may be positioned so as to be spaced apart rearward from the front of the main body of the refrigerator by a predetermined distance. That is, the fronts of the shelves or the receiving boxes may be positioned further inward in the freezing compartment or the refrigerating compartment. In a case in which the receiving boxes are configured to have a drawer shape, therefore, it may be difficult for the user to withdraw the receiving boxes while holding the fronts of the receiving boxes. In other words, the user must insert his/her hand more deeply into the storage compartment in order to withdraw the receiving boxes. Particularly, in a case in which the receiving boxes are provided in the lower part of the refrigerator, the user must withdraw the receiving boxes in a crouching style, which is very inconvenient.

Supposing that the fronts (for example, handles) of the receiving boxes are positioned deeply in the storage compartment, rather than right in front of the user, when the user opens the door in order to withdraw the receiving boxes, such inconvenience may be easily understood.

In order to solve the above problem, the applicant of the present application has proposed a storage structure configured to be interlocked with the door, which is disclosed in Korean Patent Application Publication No. 2010-0130357 (hereinafter, referred to as a "prior invention"). The storage structure according to the prior invention includes a link for mechanically interlocking the door and the storage structure. When the door is opened, therefore, the storage structure is withdrawn. That is, the storage structure is mechanically withdrawn to a position spaced apart forward from an initial position by a predetermined distance such that the user can withdraw a drawer provided in the storage structure more easily. When the opening angle of the door is increased, therefore, the distance by which the drawer is withdrawn increases.

However, the prior invention has a problem in that when the door is opened, the link is exposed outward, whereby the link blocks the movement path of the user. In addition, it is not possible to provide a refrigerator having an aesthetically pleasing appearance as the result of the provision of the link.

In addition, in the drawer according to the prior invention, additional force is required in order to open the door. This is because the force necessary to pull the drawer as well as the force necessary to open the door are both required. A particularly high force may be required when the door is initially opened. This is because a force higher than a static frictional force of the drawer must be applied in order to withdraw the drawer. The static frictional force of the drawer is proportional to the load of the drawer. In a case in which a large amount of goods is stored in the drawer, therefore, it is difficult to open the door.

In addition, the prior invention has a problem in that the storage structure, which substantially occupies the entire space of the storage compartment, moves forward and rearward, whereby the space for storing goods is somewhat reduced. That is, the space for storing goods may be much less than the entire volume of the storage compartment.

Meanwhile, the user may not open the door slowly, but may open the door very quickly using a very high force. In this case, a very high force and impact may be applied to the link and the drawer. Of course, a very high force and impact may be applied to the elastic device. As a result, the door, the link, the connection between the link and the drawer, and the elastic device may be damaged.

Meanwhile, the prior invention has a problem in that it is not possible to insert the storage structure to the initial position in a state in which the door is open. This is because the insertion of the storage structure is prevented by the link in a state in which the door is open. In a case in which a portion of the storage structure is used, therefore, the remaining portions of the storage structure, which are not used, remain withdrawn, which causes a loss of cool air.

Generally, in conventional refrigerators, the drawer, particularly the drawer in the freezing compartment, is withdrawn and inserted along a rail. The rail is provided at the sidewall of the storage compartment, and the drawer is provided with a rail connection part. The rail connection part is formed in the shape of a roller. The drawer moves forward and rearward in a state in which the rail connection part is inserted in the rail However, it is not easy to couple the above-mentioned type of drawer to the rail. Particularly, in a state in which heavy goods are received in the drawer, it is difficult for the user to fit the roller into the rail while holding the drawer.

In addition, the user may completely separate the drawer from the refrigerator, rather than putting goods in the drawer or taking goods out from the drawer after withdrawing the drawer, as needed. In this case, it is very inconvenient for the user to separate the rail connection part from the rail and then to couple the rail connection part to the rail. Consequently, the user usually uses the drawer in a state in which the drawer is not separated from the refrigerator, unless there is some special reason otherwise.

SUMMARY

The present invention has been made to fundamentally solve the above problems.

It is an object of the present invention to provide a refrigerator configured such that when a user opens a door of the refrigerator, a drawer provided in a storage compartment is automatically withdrawn forward by a predetermined distance.

It is another object of the present invention to provide a refrigerator configured such that a drawer is automatically moved from an initial position to a ready position by an electric driving unit, whereby no additional force beyond a user's force to open the door is necessary. That is, it is another object of the present invention to provide a refrigerator configured such that the force necessary to open a door and the force necessary to move a drawer from an initial position to a ready position are individual or independent. Specifically, it is another object of the present invention to provide a refrigerator configured such that a door is opened by the manual application of a user's force to the door, and a drawer is moved from an initial position to a ready position by an electrical force regardless of whether a user's force is applied.

It is another object of the present invention to provide a refrigerator configured such that a drawer electrically moves from an initial position to a ready position and such that the drawer non-electrically returns from the ready position to the initial position. In other words, it is another object of the present invention to provide a refrigerator configured such that a drawer moves from an initial position to a ready position using electrical energy and such that the drawer moves from the ready position to the initial position without using electrical energy.

It is another object of the present invention to provide a refrigerator configured such that a drawer moves from an initial position to a ready position as the result of driving of a motor, and the drawer moves from the ready position to the initial position regardless of the driving of the motor.

It is another object of the present invention to provide a refrigerator configured such that the driving force of a motor is selectively transferred to a drawer. In particular, it is another object of the present invention to provide a refrigerator configured such that the driving force of a motor is transferred to a drawer when the drawer is withdrawn, and the driving force of the motor is not transferred to the drawer when the drawer is inserted.

It is another object of the present invention to provide a refrigerator configured such that a drawer automatically moves from an initial position to a ready position, and the drawer is manually moved from the ready position to the initial position.

It is another object of the present invention to provide a refrigerator configured such that a speed at which a drawer moves from an initial position to a ready position is different from a speed at which the drawer moves from the ready position to the initial position. Specifically, it is another object of the present invention to provide a refrigerator configured such that a speed at which a drawer moves from a ready position to an initial position is higher than a speed at which the drawer moves from the initial position to the ready position.

It is another object of the present invention to provide a refrigerator configured such that a drawer moves from a ready position to an initial position due to an elastic restoring force. In particular, it is another object of the present invention to provide a refrigerator configured such that an element impeding the insertion of a drawer is removed, whereby the drawer returns relatively rapidly using an elastic restoring force. Therefore, it is another object of the present invention to provide a refrigerator configured such that a drawer completely returns to an initial position while a door is being closed.

It is another object of the present invention to provide a refrigerator configured such that a drawer is automatically withdrawn and automatically inserted. That is, it is another object of the present invention to provide a refrigerator configured such that an electric driving unit is driven to withdraw and insert a drawer. In particular, it is another object of the present invention to provide a refrigerator configured such that a speed at which a drawer is withdrawn and a speed at which the drawer is inserted are controlled to be different from each other, thereby minimizing the collision between the drawer and a door.

It is another object of the present invention to provide a refrigerator configured such that a speed at which a door is opened and/or a closed is sensed in order to change the speed of an electric driving unit configured to move a drawer, particularly the speed of a motor.

It is another object of the present invention to provide a refrigerator configured such that interference between a door and a drawer, configured to automatically move when the door is opened or closed, is considerably reduced using a sensor for very precisely sensing the opening angle of the door and/or the closing angle of the door. That is, it is another object of the present invention to provide a refrigerator configured such that an opening (or closing) angle of a door that is capable of minimizing interference between the door and a drawer is set, whereby it is possible to very precisely sense whether the door is open (or closed) at the set angle.

It is another object of the present invention to provide a refrigerator including a door opening sensor that is capable of flexibly corresponding to a door opening angle that varies depending upon the product models.

It is another object of the present invention to provide a refrigerator configured such that it is sensed whether a door is open or closed at a consistent angle using a single sensor, which is easily applied to conventional refrigerators.

It is another object of the present invention to provide a refrigerator configured such that an element for automatically withdrawing a drawer is not exposed in a storage compartment, whereby it is possible to protect an electric driving unit, to improve user convenience, and to provide the interior of the storage compartment with an aesthetically pleasing appearance.

It is another object of the present invention to provide a refrigerator configured such that it is possible to simultaneously move a plurality of drawers from an initial position to a ready position using a single electric driving unit. To this end, it is another object of the present invention to provide a refrigerator including a moving frame that is capable of simultaneously transferring the driving force of a single electric driving unit to a plurality of drawers.

It is another object of the present invention to provide a refrigerator including a moving frame that exhibits a high load distribution property, high durability, and high reliability in assembly.

It is another object of the present invention to provide a refrigerator configured such that a drawer is automatically inserted and withdrawn with high reliability and durability. In particular, it is another object of the present invention to provide a refrigerator configured such that it is possible to minimize damage to an electric driving unit due to overload of the electric driving unit or repetitive use of the electric driving unit for a long period of time.

It is another object of the present invention to provide a refrigerator configured such that a drawer configured to be automatically withdrawn, an electric driving unit configured to automatically withdraw the drawer, and relevant elements are easily assembled, and, in addition, are easily repaired as needed. In addition, it is another object of the present invention to provide a refrigerator configured such that it is possible to minimize the reduction in capacity of a storage compartment due to the above-mentioned elements.

It is another object of the present invention to provide a refrigerator configured such that a plurality of drawers is simultaneously automatically withdrawn, and, in addition, the drawers are easily manufactured and maintained.

It is another object of the present invention to provide a refrigerator configured such that a drawer is easily connected to or separated from a rail configured to support the drawer.

It is another object of the present invention to provide a refrigerator configured such that only a basket for receiving goods is easily separated from and coupled to a drawer. That is, it is another object of the present invention to provide a refrigerator configured such that only a basket is easily separated from and coupled to a drawer in a state in which the connection between a rail and a rail connection part of the drawer is maintained.

It is another object of the present invention to provide a refrigerator configured such that it is possible to maximally prevent a rail from being visibly exposed to a user.

It is a further object of the present invention to provide a control method of a refrigerator that is capable of minimizing the load of a motor and flexibly corresponding to various environments in which a drawer is used.

Means for Solving the Problems

To achieve these objects and other advantages and in accordance with the purpose of the invention, as embodied and broadly described herein, a refrigerator includes a cabinet having a storage compartment, a door hingedly connected to the cabinet for opening and closing the storage compartment, a drawer provided in the storage compartment, an electric driving unit for automatically moving the drawer to a ready position spaced apart forward from an initial position by a predetermined distance when the door is opened, and a controller for controlling the driving of the electric driving unit.

The drawer may be automatically and/or electrically withdrawn.

The drawer may be manually moved from the ready position to the initial position when the door is closed.

The drawer may be non-electrically moved from the ready position to the initial position when the door is closed.

The drawer may be elastically moved from the ready position to the initial position when the door is closed.

The drawer may be inserted and withdrawn regardless of whether a user's force is applied to the door when the door is opened and closed.

The drawer may be automatically inserted when the door is closed. The electric driving unit may be driven to automatically insert the drawer. That is, the electric driving unit may be controlled to be driven in order to insert and withdraw the drawer. The motor may be driven in a clockwise direction in order to withdraw the drawer, and the motor may be driven in a counterclockwise direction in order to insert the drawer.

The speed at which the motor is driven may be controlled by the controller.

The speed at which the motor is driven to insert the drawer and the speed at which the motor is driven to withdraw the drawer may be controlled to be different from each other. Of course, the speed at which the motor is driven to insert the drawer and the speed at which the motor is driven to withdraw the drawer may be controlled to be the same. Impact applied to the drawer and the door when the door is opened may be greater than impact applied to the drawer and the door when the door is closed. In order to prevent or minimize the impact applied to the drawer and the door, therefore, the speed at which the motor is driven to insert the drawer and the speed at which the motor is driven to withdraw the drawer may be controlled such that the speed at which the motor is driven to insert the drawer is higher than the speed at which the motor is driven to withdraw the drawer.

The speed at which the motor is driven to move the drawer may be variably set depending on the speed at which the door is moved. When the speed at which the door is closed is increased, the speed at which the motor is driven to insert the drawer may be controlled to be further increased. When the speed at which the door is opened is increased, the speed at which the motor is driven to withdraw the drawer may be controlled to be further increased.

The drawer may be withdrawn from the initial position to the ready position regardless of the increase in opening angle of the door. That is, the drawer may not move even when the opening angle of the door is increased, and the drawer may be withdrawn at a specific opening angle of the door or within a specific opening angular range of the door. On the other hand, the drawer may not move even when the closing angle of the door is decreased, and the drawer may be inserted at the specific opening angle of the door or within the specific opening angular range of the door. In other words, the drawer may be inserted and withdrawn without being mechanically interlocked with the door.

In another aspect of the present invention, a refrigerator includes a cabinet having a storage compartment, a door hingedly connected to the cabinet for opening and closing the storage compartment, a drawer provided in the storage compartment, a sensor for sensing whether the door is open, an electric driving unit for moving the drawer to a ready position spaced apart forward from an initial position by a predetermined distance when it is sensed that the door is open, and a rail configured to allow the drawer to move forward and rearward relative to the storage compartment.

In another aspect of the present invention, a refrigerator includes a cabinet having a storage compartment, a door hingedly connected to the cabinet for opening and closing the storage compartment, a drawer provided in the storage compartment, a sensor for sensing whether the door is open, an electric driving unit for moving the drawer to a ready position spaced apart forward from an initial position by a predetermined distance when it is sensed that the door is open, a rail configured to allow the drawer to move forward and rearward relative to the storage compartment, and an elastic device configured to be elastically deformed when the drawer moves from the initial position to the ready position and configured to provide an elastic restoring force to the drawer when the drawer moves from the ready position to the initial position.

The drawer may be moved from the ready position to the initial position by the elastic restoring force of the elastic device. The drawer may be moved only by the elastic restoring force regardless of whether a user's force is applied to the door.

The elastic device may be constantly connected with the drawer within a section between the initial position and the ready position of the drawer.

The elastic device may be selectively connected with the drawer. When the connection between the elastic device and the drawer is released, the drawer may be moved regardless of elastic deformation and elastic restoration of the elastic device.

The elastic device may be disconnected from the drawer when the drawer is withdrawn further forward from the ready position. As the result of the release of the connection between the elastic device and the drawer, the drawer may be further withdrawn manually.

In another aspect of the present invention, a refrigerator includes a cabinet having a storage compartment, a door hingedly connected to the cabinet for opening and closing the storage compartment, a drawer provided in the storage compartment, a sensor for sensing whether the door is open, a motor assembly, a moving frame configured to be moved forward and rearward by driving of the motor assembly, the moving frame pushing the drawer when being moved forward, and a controller for controlling the driving of the motor assembly.

The controller may control the motor assembly to move the moving frame forward when it is sensed that the door is open. The controller may control the movement of the moving frame such that the drawer is moved to a ready position spaced apart forward from an initial position by a predetermined distance.

The moving frame may return after moving the drawer to the ready position. That is, the moving frame may return rearward after pushing the drawer such that the drawer is moved to the ready position. Here, the position to which the moving frame returns may also be referred to as the initial position. At this time, the controller may control the motor assembly to be driven in the reverse direction. When the moving frame returns to the initial position, therefore, the pushing force applied to the drawer may be removed or released.

This means that the force resisting the return of the drawer is substantially removed or released. Consequently, the drawer may easily return to the initial position when the door is closed.

Of course, an elastic device may be provided such that the drawer is returned to the initial position by an elastic restoring force of the elastic device. In this case, the force resisting the return of the drawer is removed, and the drawer is returned to the initial position by the elastic restoring force of the elastic device, whereby the drawer may return at a very high speed. As a result, it is possible to prevent or minimize the collision between the drawer and the door.

In addition, in a case in which the elastic device is provided, it is possible to return the drawer to the initial position even in a state in which the door is open. In a case in which a plurality of drawers is provided, the drawers may be inserted to the initial position after use, thereby minimizing the loss of cool air.

In another aspect of the present invention, a refrigerator includes a cabinet having a storage compartment, a door hingedly connected to the cabinet for opening and closing the storage compartment, a sensor for sensing whether the door is open, a drawer provided in the storage compartment, the drawer being configured to move to a ready position spaced apart forward from an initial position by a predetermined distance when it is sensed that the door is open, an elastic device configured to be elastically deformed when the drawer moves from the initial position to the ready position and configured to provide an elastic restoring force to the drawer such that the drawer moves from the ready position to the initial position, and an electric driving unit for moving the drawer from the initial position to the ready position and elastically deforming the elastic device.

A force to withdraw the drawer forward and a force to elastically deform the elastic device may be generated by driving of the electric driving unit. That is, the force to withdraw the drawer forward and the force to elastically deform the elastic device may have no relation to the magnitude of the user's force applied to open the door.

In addition, a force to insert the drawer rearward may also have no relation to the user's force to open the door. That is, the drawer may be inserted rearward by the elastic restoring force of the elastic device.

In another aspect of the present invention, a refrigerator includes a cabinet having a storage compartment, a door hingedly connected to the cabinet for opening and closing the storage compartment, a drawer provided in the storage compartment so as to be movable forward and rearward, and a rail for supporting the drawer such that the drawer moves forward and rearward relative to the storage compartment, wherein the drawer includes a basket for receiving goods and a drawer frame provided with a basket location part, on which the basket is located, and a rail coupling part located on the rail so as to be coupled to the rail.

In another aspect of the present invention, a refrigerator includes a cabinet having a storage compartment, a door hingedly connected to the cabinet for opening and closing the storage compartment, a drawer provided in the storage compartment so as to be movable forward and rearward, the drawer including a basket for receiving goods and a drawer frame provided with a rail coupling part, and a rail coupled to the rail coupling part for supporting the drawer such that the drawer moves forward and rearward relative to the storage compartment, wherein the rail coupling part is formed in a channel shape such that the rail coupling part is located on the rail downward from above so as to surround the rail, and the rail is provided at the rear thereof with a catching part, into which a rear end of the rail coupling part is inserted, and the rail is provided at the front thereof with an elastic protrusion, which is inserted into a mounting hole provided at the front end of the rail coupling part.

In another aspect of the present invention, a refrigerator includes a cabinet having a storage compartment, a door hingedly connected to the cabinet for opening and closing the storage compartment, a sensor for sensing whether the door is open, a drawer provided in the storage compartment so as to be movable forward and rearward, the drawer including a basket for receiving goods and a drawer frame provided with a rail coupling part and a catching member protruding toward a sidewall of the storage compartment, a rail coupled to the rail coupling part for supporting the drawer such that the drawer moves forward and rearward relative to the storage compartment, the rail being supported by the sidewall of the storage compartment via a front rail bracket and a rear rail bracket, and an electric driving unit including a transfer member protruding from the sidewall of the storage compartment toward the drawer frame, the electric driving unit moving the catching member based on the movement of the transfer member to move the drawer to a ready position spaced apart forward from an initial position by a predetermined distance when it is sensed that the door is open, wherein the transfer member is configured to move between the front rail bracket and the rear rail bracket within a section between the initial position and the ready position of the drawer in order to avoid the interference between the transfer member and the front and rear rail brackets.

In another aspect of the present invention, a refrigerator includes a cabinet having a storage compartment, a door hingedly connected to the cabinet for opening and closing the storage compartment, a drawer provided in the storage compartment, the drawer including a catching member, a sensor for sensing whether the door is open, a support assembly configured to be coupled to the drawer for supporting the drawer so as to be movable forward and rearward relative to the storage compartment, the support assembly being separably coupled to a left sidewall or a right sidewall of the storage compartment, wherein the support assembly includes a support cover configured to be coupled to the sidewall of the storage compartment, a motor assembly mounted to the inside surface of the support cover facing the sidewall, a rail mounted to the outside surface of the support cover for supporting the drawer so as to be movable forward and rearward, and a moving frame mounted to the support cover so as to move forward and rearward in a space between the sidewall and the support cover by driving of the motor assembly, the moving frame including a transfer member configured to push the catching member at the rear of the catching member through the support cover.

In another aspect of the present invention, a refrigerator includes a cabinet having a storage compartment, a door hingedly connected to the cabinet for opening and closing the storage compartment, a drawer provided in the storage compartment, the drawer including a catching member, a sensor for sensing whether the door is open, a support assembly configured to be coupled to the drawer for supporting the drawer so as to be movable forward and rearward relative to the storage compartment, the support assembly being separably coupled to a left sidewall or a right sidewall of the storage compartment, wherein the support assembly includes a support cover configured to be coupled to the sidewall of the storage compartment, the support cover being provided with a slit extending forward and rearward, a motor assembly mounted to the inside surface of the support cover facing the sidewall, a rail mounted to the outside surface of the support cover for supporting the drawer so as to be movable forward and rearward, and a moving frame mounted to the support cover so as to move forward and rearward in a space between the sidewall and the support cover by driving of the motor assembly, the moving frame including a transfer member configured to push the catching member at the rear of the catching member through the slit.

In another aspect of the present invention, a refrigerator includes a cabinet having a storage compartment, a door hingedly connected to the cabinet for opening and closing the storage compartment, a magnet provided at the door, the magnet being configured to turn about a rotary shaft of the door with a predetermined turning radius as the door is opened, and a reed switch provided above or under the magnet such that the reed switch is spaced apart from the magnet, the reed switch being fixed to the cabinet regardless of the hinged rotation of the door, the reed switch having a critical point of effective magnetic intensity for contact point switching when an opening angle of the door reaches a predetermined opening angle.

In another aspect of the present invention, a refrigerator includes a cabinet having a storage compartment, a door hingedly connected to the cabinet for opening and closing the storage compartment, a sensor including a magnet provided at the door, the magnet being configured to turn about a rotary shaft of the door with a predetermined turning radius as the door is opened and a reed switch fixed to the cabinet, a contact point of the reed switch being switched at a critical point of effective magnetic intensity due to the magnet, the sensor being configured to sense that the door is open when an opening angle of the door reaches a predetermined opening angle, and an electric driving unit for moving the drawer to a ready position spaced apart forward from an initial position by a predetermined distance when it is sensed that the door is open.

In another aspect of the present invention, a control method of a refrigerator, including a motor, a drawer provided in a storage compartment defined in a cabinet so as to movable forward and rearward, and a transfer member for pushing the drawer to automatically withdraw the drawer from an initial position to a ready position by driving of the motor, includes determining a condition for automatically withdrawing the drawer in a ready state (a determination step), upon determining at the determination step that the condition is satisfied, driving the motor in one direction to move the transfer member forward such that the drawer is withdrawn to the ready position (a withdrawal step), and driving the motor in a reverse direction to return the transfer member rearward (a returning step).

The control method may further include continuously driving the motor in the one direction to stop the withdrawal of the drawer after the withdrawal step (a stopping step). The returning step may be performed after the stopping step.

The refrigerator may further include a door for opening and closing the storage compartment and a sensor for sensing that the door is open when an opening angle of the door is a predetermined opening angle. The condition for automatically withdrawing the drawer may include generating a door opening signal through the sensor.

The refrigerator may further include a door switch for sensing whether the door is in tight contact with the cabinet to sense whether the door is open or closed. The door switch may be provided separately from the sensor. In terms of function, the door switch may be provided to control lighting in the storage compartment, and the sensor may be provided to control the motor, which is related to the movement of the drawer.

The sensor may not only sense whether the door is open but may also sense whether the door is closed. Sensing whether the door is open may be sensing whether the door has been opened to a predetermined angle. Sensing whether the door is closed may be sensing whether the door has been closed to a predetermined angle. The opening angle of the door at which it is sensed that the door is open and the closing angle of the door at which it is sensed that the door is closed may be the same. For example, the opening angle of the door at which it is sensed that the door is open and the closing angle of the door at which it is sensed that the door is closed may be 90 degrees.

The control method may further include an urgent returning step to prevent or minimize the collision between the drawer and the door when the door is closed. The urgent returning step may be performed to protect the drawer when the drawer is withdrawn or a motor assembly is driven to withdraw the drawer.

Specifically, the control method may further include stopping the withdrawal step or the stopping step and driving the motor in the reverse direction to return the transfer member rearward when it is sensed through the sensor that the door is closed during the withdrawal step or the stopping step (an urgent returning step).

When the urgent returning step starts to be performed in a state in which the motor is driven in the one direction, the driving of the motor may be stopped for a predetermined time, and the motor may then be driven in the reverse direction.

In another aspect of the present invention, a refrigerator includes a cabinet having a storage compartment with a food introduction port formed in the front thereof, a door hingedly connected to the cabinet for opening and closing the storage compartment, a plurality of drawers disposed in the storage compartment, the drawers being arranged vertically, a moving frame extending vertically so as to correspond to the height at which the drawers are disposed, the moving frame being configured to selectively push the drawers such that the drawers are moved toward the food introduction port, an electric driving unit coupled to the moving frame for moving the moving frame toward the food introduction port, and a controller for controlling the electric driving unit to move the moving frame when it is sensed that the door is open.

In another aspect of the present invention, a refrigerator includes a cabinet having a storage compartment with a food introduction port formed in the front thereof, a door hingedly connected to the cabinet for opening and closing the storage compartment, a drawer disposed in the storage compartment, a moving frame configured to selectively push the drawer such that the drawer is moved toward the food introduction port, an electric driving unit coupled to the moving frame for moving the moving frame toward the food introduction port, and a controller for controlling the electric driving unit to move the moving frame when it is sensed that the door is open, wherein the drawer remains separated from the moving frame at a position at which the front part of the drawer is withdrawn after escaping from the food introduction port.

In another aspect of the present invention, a refrigerator includes a cabinet having a storage compartment with a food introduction port formed in the front thereof, a door hingedly connected to the cabinet for opening and closing the storage compartment, a drawer disposed in the storage compartment, a moving frame configured to selectively push the drawer such that the drawer is moved toward the food introduction port, an electric driving unit coupled to the moving frame for moving the moving frame toward the food introduction port, a controller for controlling the electric driving unit to move the moving frame when it is sensed that the door is open, and an elastic device coupled to one side of the drawer and the inside wall of the storage compartment for selectively generating an elastic restoring force, wherein the drawer is returned by the elastic restoring force.

In another aspect of the present invention, a refrigerator includes a cabinet having a storage compartment with a food introduction port formed in the front thereof, a door hingedly connected to the cabinet for opening and closing the storage compartment, a drawer disposed in the storage compartment, a moving frame coupled to the drawer for moving the drawer forward and rearward, an electric driving unit coupled to the moving frame, and a controller for controlling the electric driving unit to move the moving frame when it is sensed that the door is open or closed, wherein the controller controls the electric driving unit to be driven at a higher speed when the door is closed than when the door is opened.

In another aspect of the present invention, a refrigerator includes a cabinet having a storage compartment with a food introduction port formed in the front thereof, a door hingedly connected to the cabinet for opening and closing the storage compartment, a drawer disposed in the storage compartment, a fixed rail coupled to the sidewall of the storage compartment for supporting the load of the drawer, a moving rail movably coupled to the fixed rail, the moving rail being coupled to the side surface of the drawer, a moving frame for selectively pushing the drawer to move the drawer toward the food introduction port, an electric driving unit coupled to the moving frame for moving the moving frame toward the food introduction port, and a controller for controlling the electric driving unit to move the moving frame when it is sensed that the door is open.

In another aspect of the present invention, a refrigerator includes a cabinet having a storage compartment with a food introduction port formed in the front thereof, a door hingedly connected to the cabinet for opening and closing the storage compartment, a support cover mounted to the inside wall of the storage compartment so as to define the sidewall of the storage compartment, the support cover being provided with a through part, a plurality of rails mounted to the outside surface of the support cover, the rails being arranged vertically, a plurality of drawers disposed in the storage compartment such that the drawers are inserted or withdrawn through the food introduction port along the rails, the drawers being arranged vertically, a moving frame disposed inside the support cover, the moving frame extending vertically so as to correspond to a height at which the drawers are disposed, the moving frame being configured to selectively push the drawers through a transfer member extending through the through part such that the drawers are moved toward the food introduction port, an electric driving unit coupled to the moving frame for moving the moving frame toward the food introduction port inside the support cover, and a controller for controlling the electric driving unit to move the moving frame when it is sensed that the door is open.

In another aspect of the present invention, a refrigerator includes a cabinet having a storage compartment, a door hingedly connected to the cabinet for opening and closing the storage compartment, a drawer provided in the storage compartment, a sensor configured to sense whether the door is open, and an electric driving unit configured to drive the drawer such that the drawer is withdrawn forward when it is sensed that the door is open.

In another aspect of the present invention, a refrigerator includes a cabinet having a storage compartment with a food introduction port formed in the front thereof, a door hingedly connected to the cabinet for opening and closing the storage compartment, a plurality of drawers vertically arranged in the storage compartment, a sensor configured to sense whether the door is open, a moving frame configured to push the respective drawers while being moved forward, and an electric driving unit configured to move the moving frame forward such that the drawers are withdrawn forward when it is sensed that the door is open.

In another aspect of the present invention, a refrigerator includes a cabinet having a storage compartment with a food introduction port formed in the front thereof, a door hingedly connected to the cabinet for opening and closing the storage compartment, a drawer provided in the storage compartment, a fixed rail coupled to a sidewall of the storage compartment for supporting the load of the drawer, a moving rail movably coupled to the fixed rail, the moving rail being coupled to a side surface of the drawer, a moving frame configured to push the drawer while being moved forward, and an electric driving unit configured to move the moving frame forward such that the drawer is withdrawn forward when it is sensed that the door is open.

In another aspect of the present invention, a refrigerator includes a cabinet having a storage compartment with a food introduction port formed in the front thereof, a door hingedly connected to the cabinet for opening and closing the storage compartment, a support cover having an outside surface, which defines an inner surface of the storage compartment, and an inside surface, which faces a sidewall of the storage compartment, the support cover being provided with a through part, a rail mounted to the outside surface of the support cover, a drawer configured to be inserted and withdrawn through the food introduction port along the rail, a moving frame provided between the inside surface of the support cover and the sidewall of the storage compartment, the moving frame being configured to push the drawer through a transfer member extending through the through part such that the drawer is moved forward, and an electric driving unit provided between the inside surface of the support cover and the sidewall of the storage compartment for moving the moving frame forward.

In another aspect of the present invention, a refrigerator includes a cabinet having a storage compartment with a food introduction port formed in the front thereof, a door hingedly connected to the cabinet for opening and closing the storage compartment, a drawer provided in the storage compartment, a sensor configured to sense that the door is open when the door is turned and opened by a predetermined angle, an elastic device configured to be elastically deformed when the drawer is withdrawn and to be elastically restored when the drawer is inserted, and an electric driving unit for driving the drawer in one direction such that the drawer is withdrawn forward to generate a force for moving the drawer forward when it is sensed that the door is open.

In a further aspect of the present invention, a refrigerator includes a cabinet having a storage compartment with a food introduction port formed in the front thereof, a door hingedly connected to the cabinet for opening and closing the storage compartment, a drawer provided in the storage compartment, a rail configured to allow the drawer to move forward and rearward relative to the storage compartment, a sensor configured to sense that the door is open when the door is turned and opened by a predetermined angle, a moving frame configured to selectively push the drawer such that the drawer is moved toward the food introduction port, and an electric driving unit configured to drive the drawer such that the drawer is withdrawn forward to a ready position when it is sensed that the door is open.

The features of the above embodiments may be integrated into other embodiments unless the features are inconsistent or exclusive.

According to an embodiment of the present invention, it is possible to provide a refrigerator configured such that when a user opens a door of the refrigerator, a drawer provided in a storage compartment is automatically withdrawn forward by a predetermined distance. That is, it is possible to provide a refrigerator configured such that a drawer automatically moves from an initial position to a ready position. The ready position is a position to which the drawer is withdrawn forward from the initial position by a predetermined distance. That is, since the drawer in the storage compartment can be withdrawn to a position closer to the user, it is possible for the user to very conveniently use the drawer. In other words, since the drawer automatically moves from the initial position to the ready position, which is closer to the user, it is possible for the user to grasp the drawer in order to withdraw the drawer, thereby improving user convenience.

According to another embodiment of the present invention, it is possible to provide a refrigerator configured such that a drawer is automatically moved from an initial position to a ready position by an electric driving unit, whereby no additional force other than a user's force is necessary in order to open the door. That is, it is possible to provide a refrigerator configured such that a force necessary to open a door and a force necessary to move a drawer from an initial position to a ready position are individual or independent. Specifically, it is possible to provide a refrigerator configured such that a door is opened by the manual application of a user's force to the door, and a drawer is moved from an initial position to a ready position by an electrical force regardless of a user's force. Consequently, it is possible for the user to conveniently use the drawer without using any additional force.

According to another embodiment of the present invention, it is possible to provide a refrigerator configured such that a drawer electrically moves from an initial position to a ready position, and the drawer non-electrically returns from the ready position to the initial position. Specifically, it is possible to provide a refrigerator configured such that a drawer moves from an initial position to a ready position using electrical energy, and the drawer moves from the ready position to the initial position without using electrical energy. Consequently, it is possible to reduce electrical energy consumption.

According to another embodiment of the present invention, it is possible to provide a refrigerator configured such that a drawer moves from an initial position to a ready position as the result of driving of a motor, and the drawer moves from the ready position to the initial position regardless of the driving of the motor. Consequently, it is possible to reduce electrical energy consumption.

According to another embodiment of the present invention, it is possible to provide a refrigerator configured such that the driving force of a motor is selectively transferred to a drawer. In particular, it is possible to provide a refrigerator configured such that the driving force of a motor is transferred to a drawer when the drawer is withdrawn, and the driving force of the motor is not transferred to the drawer when the drawer is inserted. Consequently, it is possible to reduce electrical energy consumption.

According to another embodiment of the present invention, it is possible to provide a refrigerator configured such that a drawer automatically moves from an initial position to a ready position, and the drawer is manually moved from the ready position to the initial position. Consequently, it is possible to reduce electrical energy consumption.

According to another embodiment of the present invention, it is possible to provide a refrigerator configured such that the speed at which a drawer moves from an initial position to a ready position is different from the speed at which the drawer moves from the ready position to the initial position. Specifically, it is possible to provide a refrigerator configured such that the speed at which a drawer moves from a ready position to an initial position is higher than the speed at which the drawer moves from the initial position to the ready position. Consequently, it is possible to minimize the incidence of collision between the drawer and the door when the drawer returns while the door is being closed.

According to another embodiment of the present invention, it is possible to provide a refrigerator configured such that a drawer moves from a ready position to an initial position due to an elastic restoring force. In particular, it is possible to provide a refrigerator configured such that an element impeding the insertion of a drawer is removed, whereby the drawer is returned relatively rapidly by an elastic restoring force. Therefore, it is possible to provide a refrigerator configured such that a drawer completely returns to an initial position while a door is being closed. In addition, it is possible to minimize the incidence of collision between the drawer and the door when the drawer returns while the door is being closed.

According to another embodiment of the present invention, it is possible to provide a refrigerator configured such that a drawer is automatically withdrawn and automatically inserted. That is, it is possible to provide a refrigerator configured such that an electric driving unit is driven to withdraw and insert a drawer. In particular, it is possible to provide a refrigerator configured such that the speed at which a drawer is withdrawn and the speed at which the drawer is inserted are controlled to be different from each other, thereby minimizing the incidence of collision between the drawer and a door.

According to another embodiment of the present invention, it is possible to provide a refrigerator configured such that the speed at which a door is opened and/or closed is sensed in order to change the speed of an electric driving unit configured to move a drawer, particularly the speed of a motor. Consequently, it is possible to prevent the collision between the drawer and the door as the result of the drawer being withdrawn too fast when the door is opened or to minimize the amount of time the user waits for the withdrawal of the drawer to the ready position as the result of the drawer being withdrawn too slow when the door is opened. In addition, it is possible to prevent the collision between the drawer and the door as the result of the drawer being inserted too slowly when the door is closed or to minimize the application of impact to the drawer as the result of the drawer being inserted too fast when the door is closed.

According to another embodiment of the present invention, it is possible to provide a refrigerator configured such that interference between a door and a drawer, configured to automatically move when the door is opened or closed, is considerably reduced using a sensor for very precisely sensing the opening angle of the door and/or the closing angle of the door. That is, it is possible to provide a refrigerator configured such that the opening (or closing) angle of a door at which interference between the door and a drawer is minimized is set, whereby it is possible to very precisely sense whether the door is open (or closed) at the set angle.

According to another embodiment of the present invention, it is possible to provide a refrigerator including a door opening sensor that is capable of flexibly corresponding to a door opening angle that varies depending upon the product models. Consequently, it is possible to reduce manufacturing cost.

According to another embodiment of the present invention, it is possible to provide a refrigerator configured such that it is sensed using a single sensor whether a door is open or closed at a consistent angle, which is easily applied to conventional refrigerators. Consequently, it is possible to reduce manufacturing cost and to construct simple control logic.

According to another embodiment of the present invention, it is possible to provide a refrigerator configured such that an element for automatically withdrawing a drawer is not exposed in a storage compartment, whereby it is possible to protect an electric driving unit, to improve user convenience, and to provide the interior of the storage compartment with an aesthetically pleasing appearance.

According to another embodiment of the present invention, it is possible to provide a refrigerator configured such that it is possible to simultaneously move a plurality of drawers from an initial position to a ready position using a single electric driving unit. To this end, it is possible to provide a refrigerator including a moving frame that is capable of simultaneously transferring the driving force of a single electric driving unit to a plurality of drawers. The moving frame is not provided to support the load of the drawer. That is, the moving frame is provided simply to simultaneously withdraw the drawers. Consequently, it is possible to minimize the load applied to the electric driving unit.

According to another embodiment of the present invention, it is possible to provide a refrigerator including a moving frame that exhibits even load distribution, high durability, and high reliability in assembly. Consequently, it is possible to uniformly withdraw a plurality of drawers without deviation.

According to another embodiment of the present invention, it is possible to provide a refrigerator configured such that a drawer is automatically inserted and withdrawn with high reliability and durability. In particular, it is possible to provide a refrigerator configured such that it is possible to minimize damage to an electric driving unit attributable to overload of the electric driving unit or repetitive use of the electric driving unit for a long period of time.

According to another embodiment of the present invention, it is possible to provide a refrigerator configured such that a drawer configured to be automatically withdrawn, an electric driving unit configured to automatically withdraw the drawer, and relevant elements are easily assembled, and, moreover, are easily repaired as needed. In addition, it is possible to provide a refrigerator configured such that it is possible to minimize the reduction in capacity of a storage compartment due to the above-mentioned elements.

According to another embodiment of the present invention, it is possible to provide a refrigerator configured such that a plurality of drawers is simultaneously automatically withdrawn, and, in addition, the drawers are easily manufactured and maintained.

According to another embodiment of the present invention, it is possible to provide a refrigerator configured such that a drawer is easily connected to or separated from a rail configured to support the drawer.

According to another embodiment of the present invention, it is possible to provide a refrigerator configured such that only a basket for receiving goods is easily separated from and coupled to a drawer. That is, it is possible to provide a refrigerator configured such that only a basket is easily separated from and coupled to a drawer in a state in which the connection between a rail and a rail connection part of the drawer is maintained. Consequently, it is possible to improve user convenience.

According to another embodiment of the present invention, it is possible to provide a refrigerator configured such that it is possible to maximally prevent a rail from being visibly exposed to a user. Consequently, it is possible to provide a refrigerator configured such that it is possible to maximally prevent the constraint of the drawer due to foreign matter introduced into the rail and to provide an aesthetically pleasing appearance.

According to a further embodiment of the present invention, it is possible to provide a control method of a refrigerator that is capable of minimizing the load of a motor and flexibly corresponding to various environments in which a drawer is used. In particular, it is possible to provide a control method of a refrigerator that is capable of minimizing the collision between a drawer and a door when the door is closed very fast after being opened. In addition, it is possible to minimize the overload that may be applied to the motor due to the collision between the drawer and the door, thereby improving durability.

DETAILED DESCRIPTION

Hereinafter, embodiments according to the present invention will be described in detail with reference to the accompanying drawings.

Figure 1:
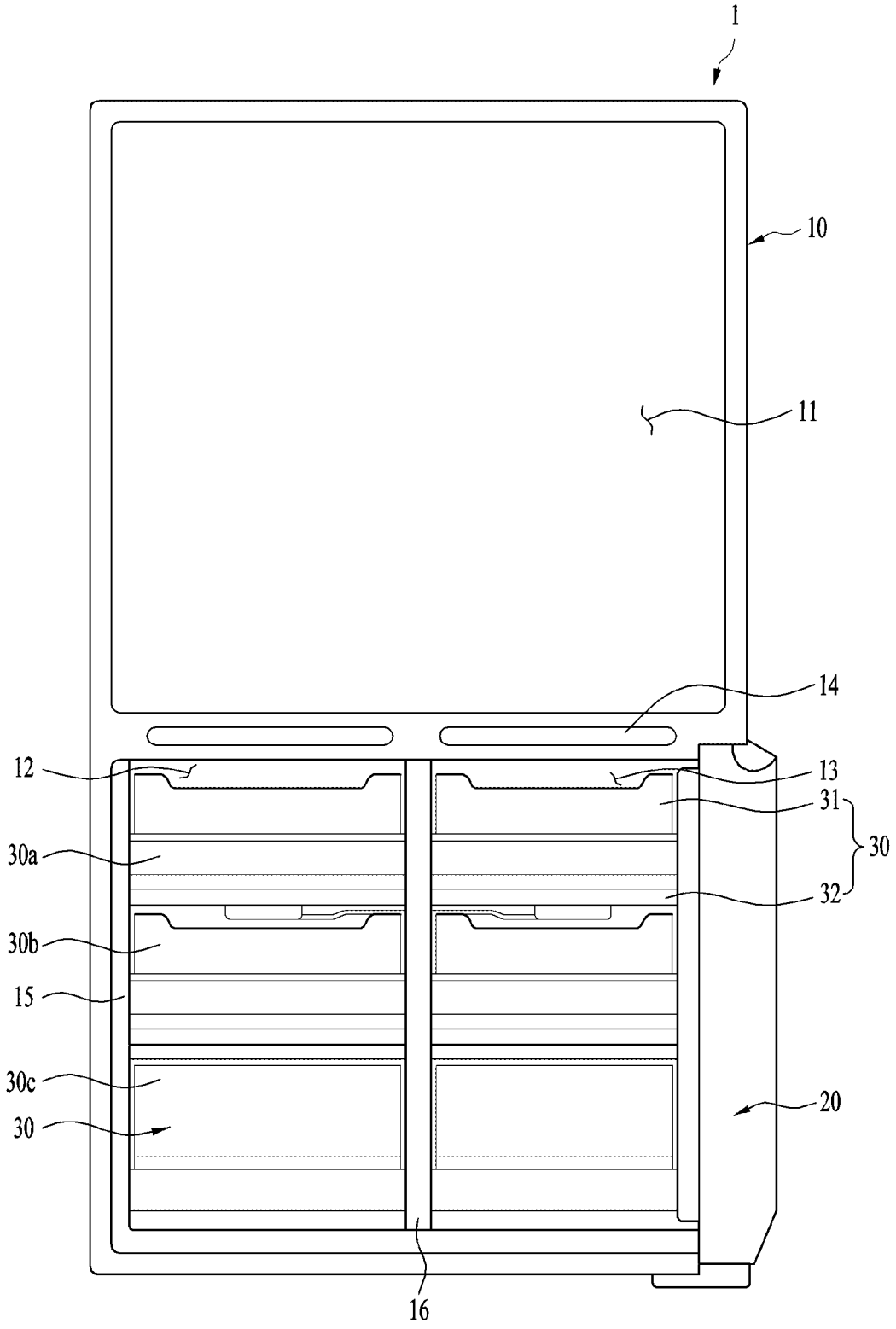
FIG. 1 is a front view showing a refrigerator according to an embodiment of the present invention.

FIG. 1 is a front view showing a refrigerator 1 according to an embodiment of the present invention. Specifically, an example of a four-door refrigerator including an upper refrigerating compartment 11 and lower freezing compartments 12 and 13 is shown in FIG. 1. For the convenience of description, left and right doors for the upper refrigerating compartment 11 and a left door for the lower left freezing compartment 12 are omitted. That is, only a right door 20 for the lower right freezing compartment 13 is shown in FIG. 1. Of course, this embodiment may be applied to a side-by-side type refrigerator in addition to the refrigerator with the above-stated construction. That is, this embodiment may be applied to any refrigerator that includes doors for opening and closing storage compartments and drawers configured to move forward and rearward in the storage compartments.

The refrigerator includes a cabinet 10, in which the storage compartments 11, 12, and 13 are defined, and doors 20 hingedly connected to the cabinet 10 for opening and closing the storage compartments 11, 12, and 13. The door 20 is turned with respect to the cabinet to open the storage compartments. Consequently, the door 20 may be a turnable door. If a plurality of storage compartments is provided, as previously described, a plurality of doors may be provided accordingly.

The refrigerating compartment 11 may be partitioned from the freezing compartments 12 and 13 by a horizontal partition wall 14. In addition, the left freezing compartment 12 and the right freezing compartment 13 may be partitioned from each other by an additional sidewall or partition wall 16. For the sake of convenience, the partition wall 16 may be referred to as a vertical partition wall. The refrigerating compartment 11, the left freezing compartment 12, and the right freezing compartment 13 may be opened and closed by individual doors.

Drawers 30, each of which includes a basket 31 for receiving goods, may be provided in the storage compartments 11, 12, and 13, particularly in the freezing compartments 12 and 13. Each drawer 30 may include a drawer frame 32. The basket 31 may be coupled to the drawer frame 32. In some cases, the drawer may define a front opening at its front surface through which its contents can be accessed by the user. Additionally, or alternatively, the drawer may define an upper opening at its upper surface through which its contents can be accessed by the user.

A plurality of drawers 30 may be provided such that the drawers 30 are arranged vertically. FIG. 1 shows an example in which three drawers 30*a*, 30*b*, and 30*c* are provided in each of the right and left freezing compartments such that the drawers 30*a*, 30*b*, and 30*c* are arranged vertically. Of course, this embodiment may be applied to an example in which drawers are provided in the refrigerating compartment in addition to the freezing compartments. Furthermore, one, two, or three doors may be connected to one door so as to operate automatically, or four or more doors may be connected to one door so as to operate automatically.

In this embodiment, it is possible to provide a refrigerator configured such that the drawers 30 can move automatically when the door 20 is opened and/or closed for user convenience. For example, it is possible to provide a refrigerator configured such that the drawers 30, provided in the right freezing compartment 13, can move automatically when the right freezing compartment 13 is opened or closed by the door 20. Automatic movement of the drawers may be applied to any one of the freezing compartments 12 and 13 or to both the freezing compartments 12 and 13. In addition, the automatic movement of the drawers may be applied to the refrigerating compartment, in addition to the freezing compartments.

Figure 2:
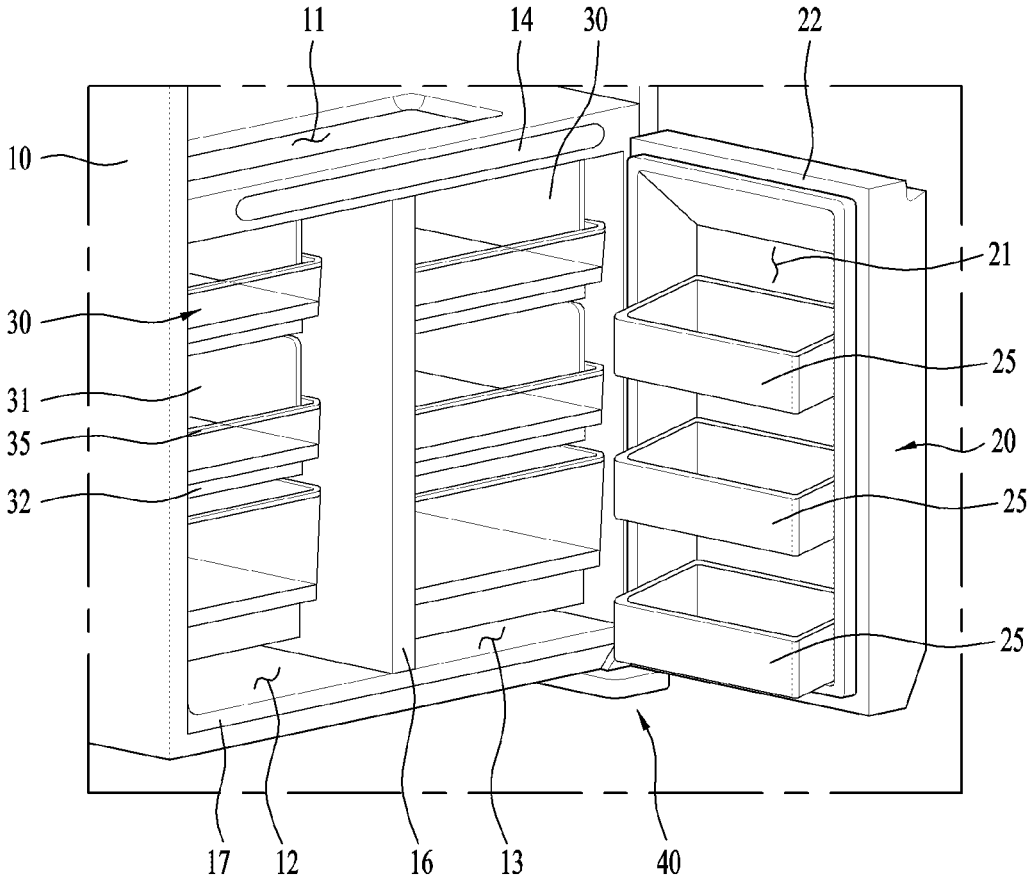
FIG. 2 is a view showing a lower storage compartment of the refrigerator shown in FIG. 1.

FIG. 2 is a view showing the lower freezing compartments 12 and 13 of the refrigerator shown in FIG. 1. The left freezing compartment door, which is not seen in FIG. 2, is in a closed state, and the right freezing compartment door 20 is in an open state.

As shown in FIG. 2, the drawers 30 provided in the left freezing compartment are inserted further inward than the drawers provided in the right freezing compartment. In FIG. 2, the position of the drawers 30 provided in the left freezing compartment may be referred to as an initial position, and the position of the drawers 30 provided in the right freezing compartment may be referred to as a ready position.

In other words, the drawers may be positioned at the initial position in a state in which the door 20 is closed, and the drawers may be positioned at the ready position in a state in which the door 20 is open. Of course, in the state in which the door 20 is open by a predetermined angle or more, the drawers 30 may be moved from the initial position to the ready position.

The initial position is a position at which interference between the door 20 and the drawers 30 is eliminated and the drawers are inserted into the storage compartment such that the door 20 can be completely closed, and the ready position is a position at which the drawers 30 are withdrawn such that a user can easily hold the drawers 30. Consequently, the ready position may be a position spaced apart forward from the initial position. In addition, the ready position may be a position at which the drawers are automatically withdrawn when the door is opened.

Hereinafter, the positions at which a drawer 30 is inserted and withdrawn and the distances by which the drawer 30 is inserted and withdrawn will be described in detail with reference to FIG. 3.

Figure 3:
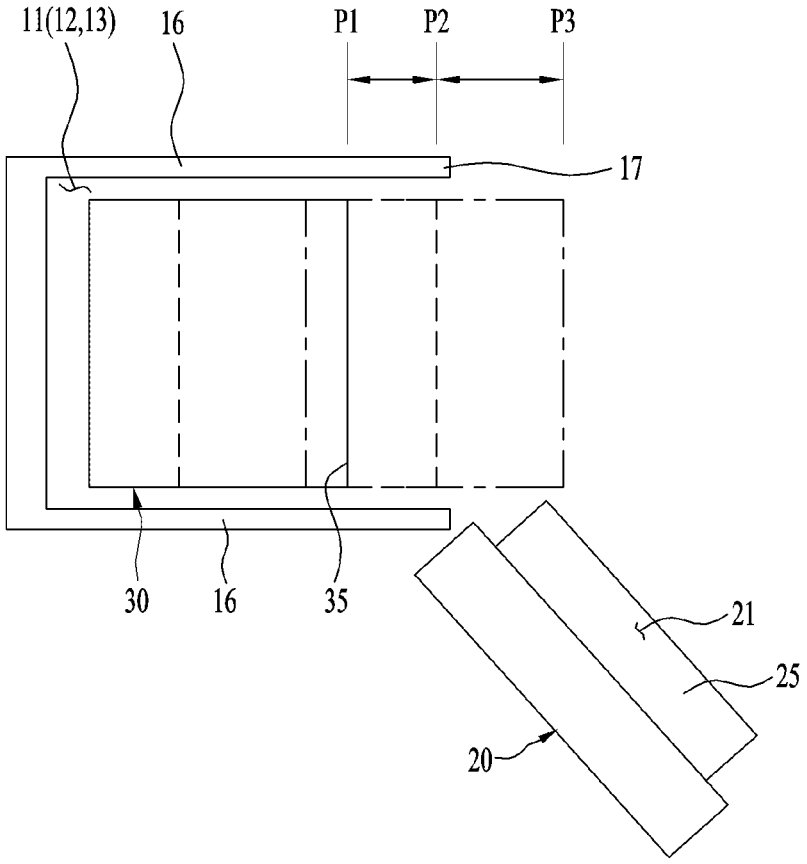
FIG. 3 is a schematic conceptual view defining the position of a drawer relative to a storage compartment.

FIG. 3 shows three positions of the drawer 30 in a state in which the door 20 is open. For the convenience of description, the positions of the drawer 30 may be set on the basis of the front of the drawer 30 or a handle 35 of the drawer 30.

Position P1 may be an initial position. The initial position is a position at which the drawer 30 is inserted such that a door basket 25 does not interfere with the drawer 30 in a state in which the door 20 is closed.

Position P2 may be a position spaced apart forward from position P1. Position P2 may be a position at which the drawer 30 is withdrawn by a predetermined distance such that the user can easily withdraw the drawer 30. Position P2 may be a ready position. This is because position P2 is a position at which the drawer is ready such that the user can easily withdraw the drawer. In some cases, Position P2 may correspond to a withdrawal distance of between approximately 100 mm to 120 mm from Position P1.

Position P3 may be a position spaced apart forward from position P2. The P3 position may be a position at which the drawer is maximally withdrawn. That is, position P3 may be the maximum withdrawal position, at which the drawer 30 is maximally withdrawn in a state in which the drawer 30 is not separated from the storage compartment. The reason for this is that when the drawer 30 is completely separated from the refrigerator, the drawer is not normally positioned.

Consequently, the movement of the drawer 30 from position P1 to position P3 may be referred to as the withdrawal of the drawer 30, and the movement of the drawer 30 from position P3 to position P1 may be referred to as the insertion of the drawer 30.

As shown in FIG. 3, receiving boxes or baskets 25, which define additional door storage regions 21, may be provided at the rear of the door 20. In order to eliminate interference between the door 20, particularly the basket 25 provided in the door 20, and the drawer 30, the drawer 30 is positioned at the initial position (position P1) in a state in which the door 20 is closed. When the user open the door 20 in order to withdraw goods, the drawer 30 moves forward from the initial position to the ready position (position P2) such that the user can more easily withdraw the drawer 30. As a result, the front of the drawer 30 or the handle 35 becomes closer to the user such that the user can more easily withdraw the drawer 30.

That is, the initial position may be a position at which the drawer has been maximally moved inward into the storage compartment, and the ready position may be a position spaced apart forward from the initial position by a predetermined distance. At the ready position, it is not necessary for the user to reach deep into the storage compartment in order to grasp the handle 35, whereby it is very convenient for the user to manipulate the drawer 30.

In order to introduce goods into the drawer 30 or to remove goods from the drawer 30, the user may withdraw the drawer 30 up to the maximum withdrawal position (position P3).

As shown in FIG. 3, the drawer 30 may not escape from an opening 17 defined in the storage compartment even at the ready position. The opening may be a food introduction port. That is, when the door 20 is opened, the drawer 30, particularly the front of the drawer 30 or the handle 35, may be positioned further rearward than the opening 17. That is, the drawer 30 may remain positioned in the storage compartment. This is because the reason that the user opens the door 20 is not necessarily to use or withdraw the drawer 30. For example, the user may open the door 20 in order to use the door storage region 21. In addition, in a case in which a plurality of drawers 30 is provided, only a specific one of the drawers may be withdrawn. If the remaining drawers, which the user does not wish to withdraw, are withdrawn from the storage compartment, cool air may be lost.

As will be described hereinafter, embodiments of the present invention may provide a refrigerator configured such that the drawer can move automatically based on the extent to which the user opens the door, particularly at a specific door opening angle. Consequently, it is possible to prevent unnecessary movement of the drawer, thereby reducing a loss of cool air and a loss of energy. In addition, it is possible to provide a refrigerator configured such that interference between the drawer and the door is minimized.

In addition, when the door is opened, cool air is inevitably discharged from the storage compartment. When the drawer is withdrawn, cool air is discharged from the basket of the drawer. That is, as the withdrawal distance of the drawer increases, the loss of cool air from the basket is accelerated. Particularly, when the drawer is withdrawn further forward than the food introduction port, the loss of cool air may be accelerated still further. In order to minimize the loss of cool air in the basket at the ready position, therefore, the drawer 30 may be prevented from escaping from the interior of the storage compartment at the ready position.

For example, the ready position may be a position spaced apart forward from the initial position by about 120 mm. Of course, the distance between the ready position and the initial position may be set differently based on the shape of the refrigerator, the position of the drawer, the distance by which the door storage region 21 is inserted into the storage compartment, the capacity of the refrigerator, etc. However, the ready position may be a position at which the front of the drawer 30 or the handle 35 does not escape from the opening 17 of the storage compartment. That is, the front of the drawer 30 or the handle 35 may be positioned further inward than the opening 17 without escaping from the opening 17.

In this embodiment, the refrigerator may be configured such that when the door 20, which opens and closes the storage compartment, is opened, the drawer, which is provided in the storage compartment, can move automatically (can be withdrawn automatically) from the initial position to the ready position. That is, the refrigerator may be configured such that when the door is opened, the front of the drawer may move automatically toward the food introduction port 17. Consequently, the refrigerator according to this embodiment may further include an electric driving unit for moving the drawer. In addition, the refrigerator according to this embodiment may further include a sensor for sensing a condition under which the electric driving unit is to be operated.

That is, in this embodiment, the refrigerator may be configured such that the drawer is withdrawn from position P1 to position P2 using electrical energy. In addition, in this embodiment, the refrigerator may be configured such that the drawer is automatically withdrawn regardless of force necessary for the user to open the door. In addition, in this embodiment, the refrigerator may be configured such that the drawer is automatically withdrawn using a driving force generated from a motor.

Hereinafter, a support assembly for automatically withdrawing the drawer while movably supporting the drawer will be described in detail with reference to FIG. 4.

Figure 4:
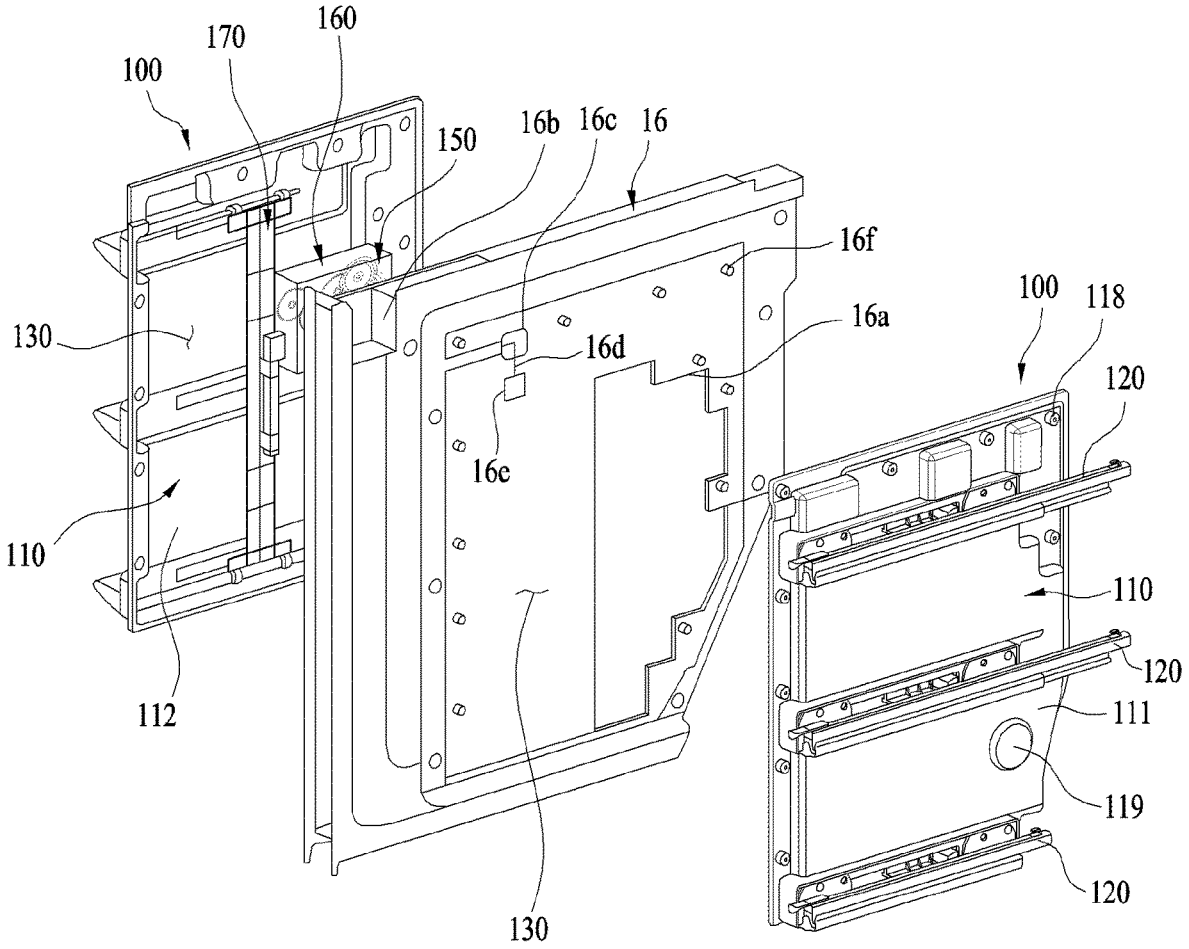
FIG. 4 is an exploded view showing a support assembly according to an embodiment of the present invention.

FIG. 4 shows a support assembly 100 that can be coupled to a freezing compartment sidewall of the refrigerator shown in FIG. 1. Specifically, support assemblies 100 are positioned at the left and right sides of the partition wall 16, which is one of the freezing compartment sidewalls. In this case, freezing compartments are provided at the left and right sides of the freezing compartment partition wall 16. In a case in which one freezing compartment is provided, the partition wall 16 may be a left heat insulation wall (a left sidewall) or a right heat insulation wall (a right sidewall) of the freezing compartment. In a case in which freezing compartments are provided at the left and right sides of the partition wall 16, the support assembly 100 may be provided in only one of the freezing compartments, not both the freezing compartments. In any case, the support assembly 100 may be mounted to the freezing compartment sidewall.

In the case in which a single storage compartment is provided, opposite sidewalls of the storage compartment may be heat insulation walls. A heat insulation wall may be a wall, the inner space of which is filled with an insulating material. In the case in which left and right storage compartments are provided, the left and right storage compartments may be partitioned by a partition wall. In this case, the left sidewall of the left storage compartment may be a heat insulation wall, and the right sidewall of the left storage compartment may be formed by the partition wall. In the case in which the right sidewall of the right storage compartment is a heat insulation wall, the left sidewall of the right storage compartment may be formed by the partition wall. The partition wall may be a non-heat insulation wall.

In a case in which the left and right freezing compartments are separated from each other, as shown in FIG. 1, the support assembly 100 may be mounted to the left or right sidewall. The left sidewall or the right sidewall may be a heat insulation wall. However, it may be disadvantageous to mount the support assembly 100 to the heat insulation wall from the aspect of heat insulation. In addition, in a case in which the conventional thickness of the heat insulation wall is maintained, the inner space of the storage compartment in which the support assembly 100 is mounted may be reduced. For this reason, the support assembly 100 may be mounted to the freezing compartment partition wall 16, at which heat insulation is not critical, selected from among the freezing compartment sidewalls.

Of course, the support assembly 100 may not be mounted to the sidewall of the freezing compartment but may be mounted to the sidewall of the refrigerating compartment. In this case, the drawer provided in the refrigerating compartment may be automatically withdrawn. In addition, the refrigerating compartment may be partitioned into left and right parts, in the same manner as in the freezing compartment. Even in this case, a partition wall may be provided to partition the refrigerating compartment into left and right parts. A support assembly may be mounted to one of the sidewalls that define the refrigerating compartment. However, the support assembly may be mounted to the partition wall in order to prevent the reduction of heat insulation efficiency and to minimize the reduction in space of the storage compartment.

The partition wall 16 may be a partition wall for partitioning the left and right freezing compartments from each other. The partition wall 16 may be symmetrical. That is, support assemblies having the same shape may be mounted to the left and right sides of the partition wall 16 in the same fashion. Consequently, drawers may be provided in the left and right freezing compartments such that the drawers can be automatically inserted and withdrawn.

Hereinafter, an embodiment in which support assemblies 100 are mounted to the left and right sides of the sidewall defining the storage compartment, particularly the partition wall 16 for partitioning the left and right freezing compartments from each other, will be described in detail.

The support assembly 100 supports the drawer 30 such that the drawer 30 can move forward and rearward. In addition, the drawer 30 may be automatically withdrawn through the support assembly 100.

The support assembly 100 may include a support cover 110. The support cover 110 may be mounted to one sidewall of the freezing compartment, particularly the partition wall 16. Specifically, the support cover 110 may be mounted to the left sidewall or the right sidewall of the freezing compartment, rather than the upper sidewall, the lower sidewall, and the rear sidewall of the freezing compartment. As will be described hereinafter, various components, including the electric driving unit, may be mounted to the support cover 110. The support assembly 100 may be mounted to one side wall of the freezing compartment, particularly the partition wall 16, as a single assembly, or may be separated from the partition wall 16 through the support cover 110. That is, the support assembly 100 may be integrally coupled to the sidewall of the storage compartment or may be separated from the sidewall of the storage compartment. Consequently, it is possible to very simply manufacture the support assembly 100 and to easily maintain the support assembly 100. This is because, as will be described hereinafter, the drawer 30 can be separated from a rail 120, and then the support assembly 100, including the support cover 110, can be separated from the partition wall 16. On the other hand, the support assembly may be manufactured, the support assembly may be mounted to the partition wall 16, and the drawer 30 may be coupled to the rail 120.

The support cover 110 may include an outside surface 111 and an inside surface 112. The inside surface 112 of the support cover 110 may be coupled to the sidewall so as to face the sidewall. The outside surface 111 may be exposed in the storage compartment. Consequently, the outside surface 111 may define the inner surface of the storage compartment. The sidewall may be a partition wall.

The rail 120 may be mounted to the support cover 110. Specifically, the rail 120 may be mounted to the outside surface 111 of the support cover 110. The rail 120 may be provided at each of the left and right sides of the storage compartment. Consequently, one of the rails may be mounted to the outside surface of the support cover 110, and the other rail may be mounted to the sidewall of the storage compartment. The rail 120 may be provided such that the drawer can move forward and rearward in the storage compartment. That is, the drawer 30 may be supported such that the drawer 30 can move forward and rearward in the storage compartment along the rail 120. The drawer 30 may slide forward and rearward along the rail 120. Consequently, the rail 120 may support the load of the drawer 30, and the load of the drawer 30 may be transferred to one sidewall of the freezing compartment or the partition wall 16 via the rail 120. Embodiments of the rail 120 and the structure in which the rail 120 and the drawer 30 are coupled to each other will be described later.

In a case in which a plurality of drawers 30 is provided, a plurality of rails 120 may be provided. Consequently, a plurality of rails 120 may be mounted to a single support cover 110. Specifically, a plurality of drawers 30 may be provided such that the drawers 30 are arranged vertically, and therefore a plurality of rails 120 may be provided such that the rails 120 are arranged vertically.

Meanwhile, as the result of the inside surface 112 of the support cover 110 being mounted to the sidewall of the storage compartment or the partition wall 16 so as to face the sidewall of the storage compartment or the partition wall 16, a predetermined space 130 is defined between the support cover 110 and the sidewall of the storage compartment or the partition wall 16. The predetermined space 130 may be an unexposed space in the storage compartment. Consequently, elements provided in the predetermined space 130 may not be exposed in the interior of the storage compartment. For this reason, the predetermined space 130 may be referred to as an isolation space. In addition, the predetermined space 130 may be an electric driving unit mounting space, in which the electric driving unit will be mounted, as will be described hereinafter.

The predetermined space, isolation space, or electric driving unit mounting space 130 is provided between an inside surface 112 of the support cover 110 and the partition wall 16. As a result, elements mounted to the inside surface 112 of the support cover 110 are not exposed in the storage compartment. Consequently, the side of the support cover 110 facing the partition wall 16 may be the inside of the support cover 110. On the other hand, elements mounted to an outside surface 111 of the support cover 110 may be exposed in the storage compartment. For example, the rail 120 may be mounted to the outside surface 111 of the support cover 110, and therefore the rail 120 may be exposed in the storage compartment. Consequently, the side of the support cover 110 that faces the storage compartment may be the outside of the support cover 110.

An electric driving unit 150 may be provided on the inside surface 112 of the support cover 110. That is, the electric driving unit 150 may be provided in the predetermined space 130. Consequently, the electric driving unit 150 may not be exposed in the storage compartment. This is because the support cover 110 covers the electric driving unit 150. That is, the electric driving unit 150 is provided inside the support cover 110.

Specifically, the electric driving unit 150 may not be mounted to the partition wall 16 but may be mounted to the inside surface of the support cover 110. When the support cover 110 is separated from the partition wall 16, therefore, the electric driving unit 150 may be separated from the partition wall 16.

The electric driving unit 150 is operated to move the drawer 30 from the initial position to the ready position. That is, the electric driving unit 150 may be operated to move the drawer 30 toward the food introduction port 17. To this end, the electric driving unit 150 may include a motor assembly 160 for generating force necessary to move the drawer 30 and a moving frame 170 for applying force to the drawer 30 so as to move the drawer 30. Specifically, the moving frame 170 may be configured to selectively push the drawers.

The moving frame 170 may be configured such that the moving frame 170 is moved forward and rearward by the operation of the motor assembly 160. Here, a direction in which the moving frame 170 is moved forward and rearward may be the same as the direction in which the drawer 30 is moved forward and rearward. That is, the moving frame 170 may be configured such that the moving frame 170 is moved by the motor assembly 160 in a direction identical to the direction in which drawer 30 is moved. In some cases, the speed at which the moving frame 170 is moved forward may be lower than the speed at which the moving frame 170 is moved rearward.

Specifically, the moving frame 170 may be movably mounted to the support cover 110. For example, the moving frame 170 may be mounted to the inside surface of the support cover 110 such that the moving frame 170 can be moved forward and rearward. The moving frame 170 may be supported so as to be slidable with respect to the support cover 110. Since the moving frame 170 is substantially positioned in the predetermined space 130, the structure of the moving frame 170 and the movement of the moving frame 170 cannot be seen in the storage compartment. However, the movement of the moving frame 170 must be transferred to the drawer 30, which is provided in the storage compartment. For this reason, an element for transferring force, for example, a transfer member, which will be described hereinafter, may be exposed to the outside surface of the support cover 110. That is, the transfer member may extend from the inside of the support cover 110 to the outside of the support cover 110. Consequently, the transfer member may extend from the inside surface 112 to the outside surface 11 of the support cover 110.

In other words, the moving frame 170 may be an element for transferring force generated by the motor assembly 160, which is positioned in the predetermined space 130, to the drawer 30, which is positioned outside the predetermined space 130. The details of the moving frame 170 will be described later.

As shown in FIG. 4, a through part 16*a* may be formed through the partition wall 16. The through part 16*a* may be formed such that the motor assembly 160 is disposed through the through part 16*a*. The motor assembly 160 may have a predetermined horizontal width, as shown in FIG. 4. In a case in which the motor assembly 160 is positioned in the predetermined space 130 with the result that the motor assembly 160 is isolated from the storage compartment, therefore, the horizontal width of the partition wall 16 or the horizontal width of the support cover 110 may be excessively increased, which may reduce the inner space of the storage compartment. Consequently, it is possible to prevent the inner space of the storage compartment from being reduced due to the motor assembly 160 by the provision of the through part 16*a*. Specifically, in a case in which the support assemblies 110 are positioned on the left and right sides of the partition wall 16, a portion of the left motor assembly (the motor assembly for moving the drawer in the left freezing compartment) may be positioned in the right space 130 through the through part 16*a*. Similarly, a portion of the right motor assembly (the motor assembly for moving the drawer in the right freezing compartment) may be positioned in the left space 130 through the through part 16*a*. The two motor assemblies 160 may be vertically arranged side by side. That is, the two motor assemblies 160 may be vertically arranged side by side such that the horizontal widths of the motor assemblies 160 partially overlap each other. As a result, owing to the support assemblies, it is possible to minimize the effect in thickness of the motor assemblies 160 as compared with a case in which the two motor assemblies 160 are horizontally arranged side by side at the same height.

The through part 16*a* may be formed so as to correspond to the external shape of the motor assembly 160. Consequently, the motor assembly 160 may be fixed and supported in the through part 16*a*. In a case in which the motor assemblies are provided at the left and right sides of the partition wall 16, the through part 16*a* may be formed so as to have a vertically extending length. One of the motor assemblies is disposed through the upper side of the through part 16*a*, and the other motor assembly is disposed through the lower side of the through part 16*a*. That is, the two motor assemblies 160 may be vertically arranged through the through part 16*a*. When the support cover 110 is coupled to the partition wall 16, the through part 16*a* may be covered by the support cover 110.

The through part 16*a* may be formed in a case in which the motor assembles are provided on the left and right sides of the partition wall 16. In a case in which the motor assembly is provided at only one sidewall of the storage compartment, however, a recessed part may be formed in place of the through part. Consequently, a portion of the horizontal width of the motor assembly may be inserted into the recessed part, whereby it is possible to minimize the reduction of the inner space of the storage compartment due to the motor assembly.

Meanwhile, the motor assembly 160 includes a motor 162 configured to be operated by electrical energy. To this end, an electric cable for supplying electrical energy must be connected to the motor assembly 160. The electric cable may be connected from a power supply device of the refrigerator to the motor assembly 160.

An upper opening 16*b* for electric cable connection may be formed in the partition wall 16. The electric cable connected to the power supply device may extend to the upper opening 16*b* of the vertical partition wall 16 through the horizontal partition wall 14 shown in FIG. 1. An electric cable through part 16*c* may be formed through the partition wall 16. Consequently, the electric cable may further extend from the upper opening 16*b* to the electric cable through part 16*c*. An electric cable 16*d* may extend from the electric cable through part 16*c* to the right side (one side) and may then be terminated using an electric cable coupling part 16*e*. The electric cable coupling part 16*e* may be an electric cable coupling part configured to be connected to the right motor assembly 160. In the same manner, an electric cable and an electric cable coupling part may also be provided at the left side (the other side) of the electric cable through part 16*c*.

The electric cable may extend through the horizontal partition wall 14 and the vertical partition wall 16 before the support assembly 100 is mounted to the partition wall 16, and may then extend through the electric cable through part 16*c*. The electric cable coupling part 16*e* may be formed at the end of the electric cable.

The electric cable coupling part 16*e* is positioned in the predetermined space 130, which was previously described. Before the support assembly 100 is mounted to the partition wall 16, therefore, the motor assembly 160 is connected to the partition wall 16 through the electric cable coupling part 16*e*. Subsequently, the support assembly 100 may be fixed to the partition wall 16 through a fastening part 118 formed at the support cover 110 and a fastening part 16*f* formed at the partition wall 16. The fastening parts 118 and 16*f* may be formed in the shape of a boss for screw coupling. On the other hand, screws may be removed in order to separate the support assembly 100 from the partition wall 16. Subsequently, the motor assembly 160 is separated from the electric cable coupling part 16*e*, whereby the support assembly 100 is completely separated from the partition wall 16. That is, the structural and electrical connection between the support assembly 100 and the partition wall 16 may be released.

Consequently, it is possible to very easily perform coupling, separation, and connection between the support assembly 100 and the partition wall 16 through the structure of the partition wall 16 or the sidewall of the storage compartment, the structure of the support assembly 100, and the electric cable connection structure via the sidewall or the partition wall.

As previously described, the motor assembly 160 includes the motor 162. In general, motors are formed to have a cylindrical shape. A direction in which a rotary shaft of the motor extends may be perpendicular to the sidewall of the storage compartment or the partition wall 16. As a result, the horizontal width of the motor assembly 160 may be increased due to the size of the motor (the height of the cylindrical motor).

As shown in FIG. 4, the support cover 110 may be provided with a motor avoidance recess 119. For example, a circular motor avoidance recess 119 may be formed in the support cover 110 such that the circular motor avoidance recess 119 corresponds in shape to the motor. The motor avoidance recess 119 may receive at least a portion of the motor. Consequently, it is possible to enlarge the part of the motor assembly 160 corresponding to the motor without increasing the horizontal width of the motor assembly 160. In order to eliminate the interference between the motor avoidance recess 119 and the enlarged part of the motor assembly 160, the motor avoidance recess 119 may be formed in the support cover 110.

For the right support cover, the motor avoidance recess 119 protrudes rightward from the right support cover. The protruding motor avoidance recess 119 may interfere with other elements mounted to the support cover. In order to solve this problem, the motor avoidance recess 119 may be formed between the rails 120.

On the assumption that three rails 120 are mounted to the support cover 110, the motor avoidance recess 119 may be formed in the right support cover between the middle rail and the lower rail. On the other hand, the motor avoidance recess 119 may be formed in the left support cover between the upper rail and the middle rail.

The motor assembly 160 may be more securely coupled to the support cover 110 by the provision of the motor avoidance recess 119. In addition, the motor assembly 160 may be formed between the rails in order to minimize the reduction of the inner space of the storage compartment due to the extension of the predetermined space 130.

In a case in which the horizontal width of the motor assembly 160 is further increased in consideration of the size of the motor, for example in a case in which the horizontal width of a housing 161 of the motor assembly 160 is further increased, it is necessary to reduce the inner space of the storage compartment in order to avoid the interference between the motor assembly 160 and the rail.

Figure 5:
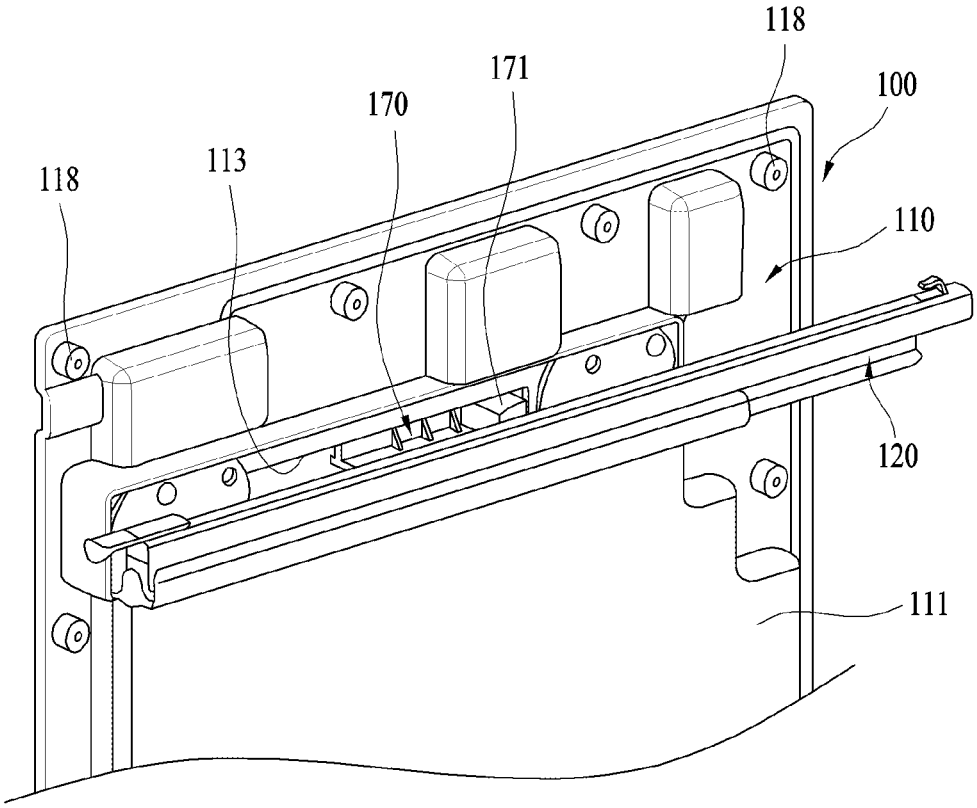
FIG. 5 is a view showing a state in which a rail is mounted to a support cover in the support assembly shown in FIG. 4.

Hereinafter, a structure that supports the drawer and applies force to the drawer will be described in detail with reference to FIG. 5. FIG. 5 is an enlarged view showing the upper part of the support assembly shown in FIG. 4. As shown in FIG. 5, a rail 120 corresponding to one drawer 30 and a structure for transferring force to the drawer 30 are provided at the support cover 110.

Referring to FIG. 5, the drawer 30, while not shown in FIG. 5, is supported such that the drawer 30 can move forward and rearward along the rail 120. In general, the user may pull or push the drawer in order to withdraw or insert the drawer 30. The rail 120 is generally provided in order for the user to easily withdraw or insert the drawer 30 using the minimum force. To this end, the rail 120 may be mounted to the outside surface 111 of the support cover 110, i.e. the surface of the support cover 110 facing the interior of the storage compartment.

As previously described, the electric driving unit 150, particularly the motor assembly 160, may be mounted to the inside surface 112 of the support cover 110. Here, the inside surface 112 of the support cover 110 may be the surface of the support cover 110 facing the sidewall or the partition wall 16. Consequently, it is necessary to provide a structure for transferring force or displacement generated at the inside surface 112 of the support cover to the outside surface 111 of the support cover.

To this end, a through part 113 may be formed in the support cover 110. That is, the through part 113 may be formed through the support cover 110. It is possible to transfer the movement of the moving frame 170 to the drawer 30 through the through part 113.

Specifically, the moving frame 170 may include a transfer member 171 for transferring force to the drawer 30. The transfer member 171 may be a portion of the moving frame 170. Alternatively, the transfer member 171 may be connected to the moving frame 170. In addition, the transfer member 171 may be selectively connected to the moving frame 170. In any case, the movement of the moving frame 170 may be transferred to the drawer 30 via the transfer member 171.

The transfer member 171 may extend through the through part 113. That is, the moving frame 170 may be moved on the inside surface 112 of the support cover, whereas the transfer member 171 may be moved on the outside surface 111 of the support cover through the through part 113. Consequently, the transfer member 171 is moved forward and rearward through the through part 113.

Since the transfer member 171 is moved forward and rearward, the through part 113 may be formed so as to define a movement path of the transfer member 171. For this reason, the through part 113 may be referred to as a slit that is formed so as to extend forward and rearward.

The transfer member 171 transfers the force generated by the electric driving unit, particularly the movement of the moving frame 170, to the drawer 30. That is, the transfer member 171 may push the drawer 30 such that the drawer 30 can move along the rail. In other words, the drawer 30 may move automatically even when the user does not manipulate the drawer.

As shown in FIG. 5, the load of the drawer may be transferred to the support cover 110 via the rail 120. The load transferred to the support cover 110 may be transferred to the sidewall or the partition wall to which the support cover 110 is mounted. Consequently, the load of the drawer may not substantially affect the electric driving unit 150. In other words, load applied to the electric driving unit 150 in order to withdraw the drawer may have little to no relationship to the load of the drawer.

In addition, the load of the drawer may not be transferred to the electric driving unit 150, particularly the moving frame 170. Specifically, since the direction in which the moving frame 170 is moved is substantially perpendicular to the direction in which the load of the drawer is applied, it is possible to minimize the effect in movement of the moving frame 170 attributable to the increase in load of the drawer. In other words, the moving frame 170 is decoupled from the drawer in the vertical direction such that the weight of the drawer may not be vertically transferred to the moving frame 170. Even when the load of the drawer is increased, therefore, the moving frame 170 may be smoothly moved forward and rearward.

Figure 6:
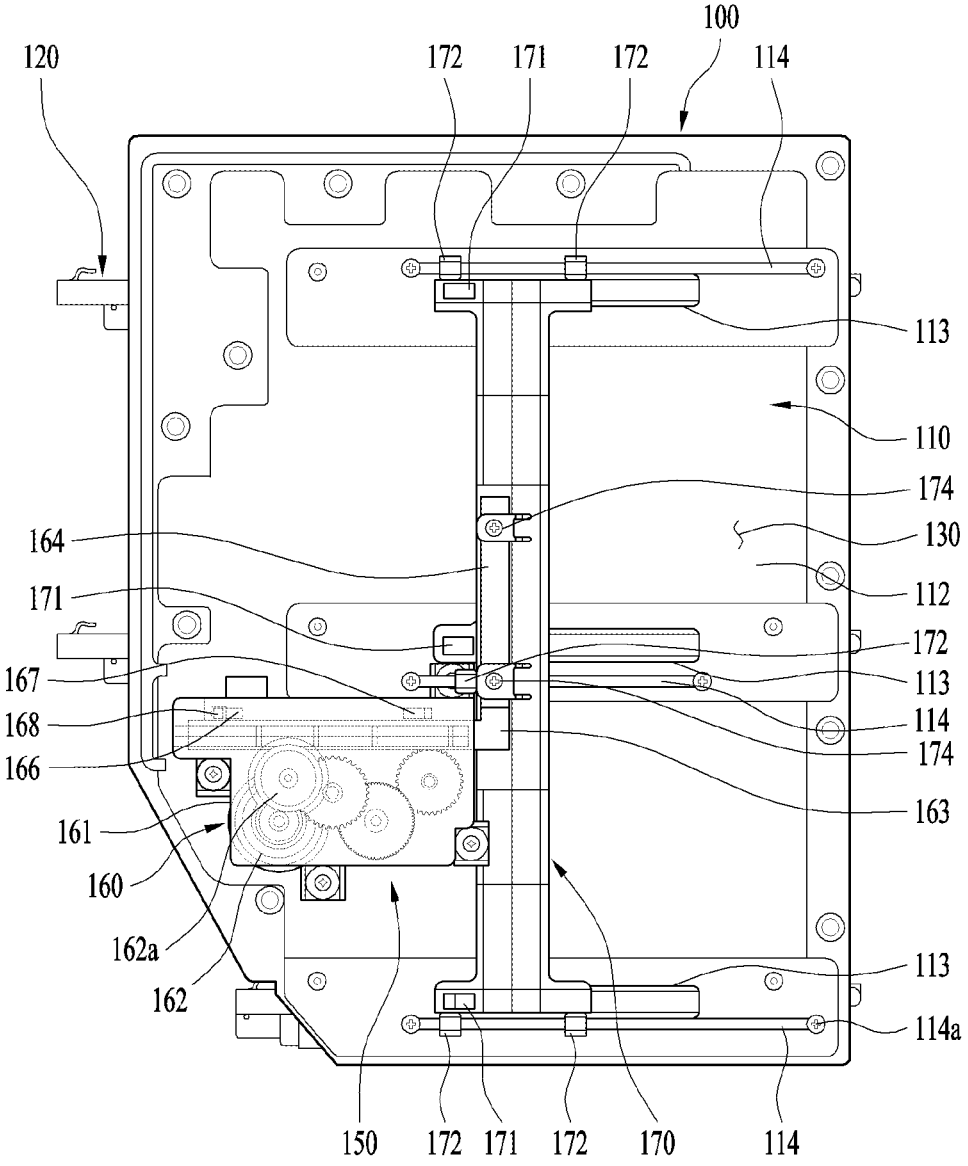
FIG. 6 is a view showing an initial position of a motor assembly and a moving frame in the support assembly shown in FIG. 4.
Figure 7:
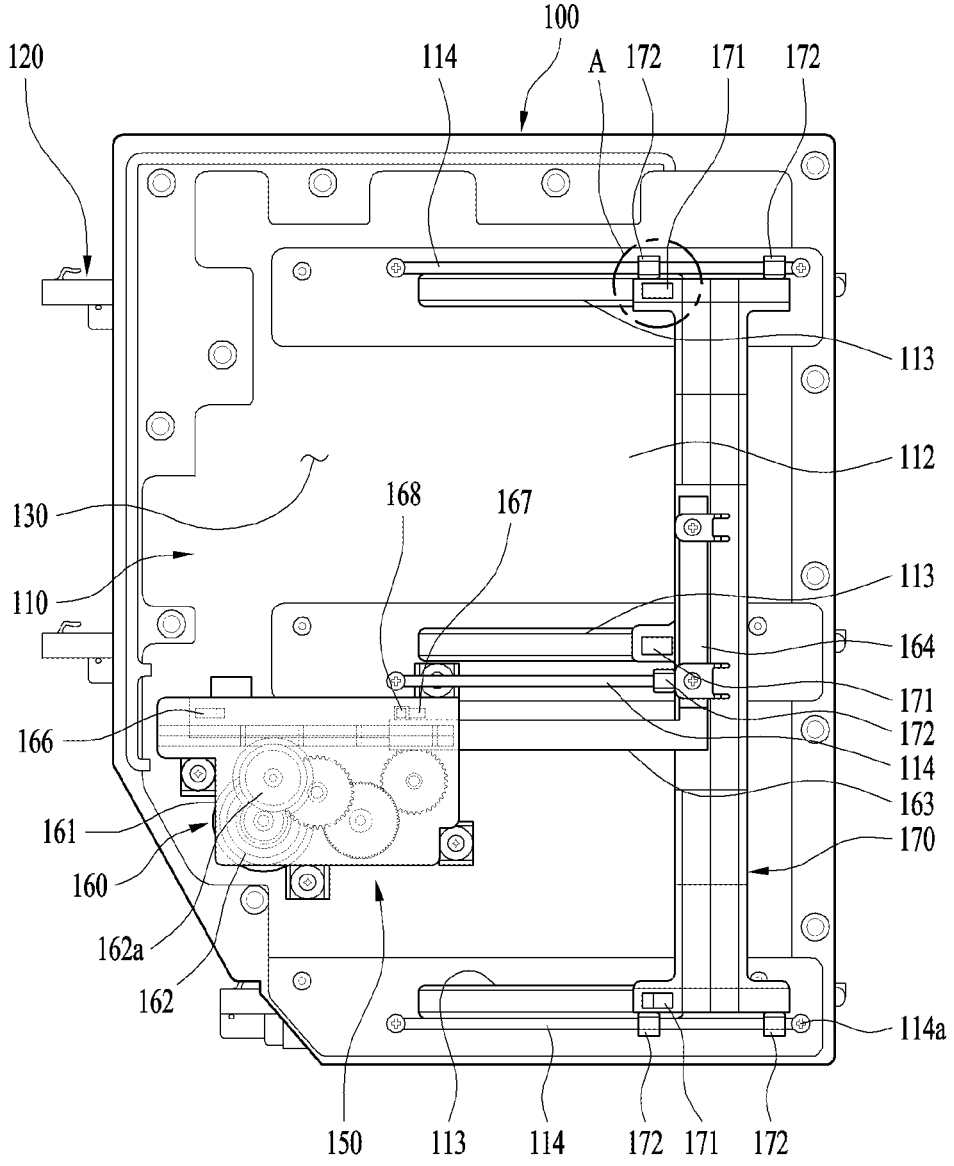
FIG. 7 is a view showing a ready position of the motor assembly and the moving frame in the support assembly shown in FIG. 4.

Hereinafter, a mechanism between the electric driving unit 150 and the drawer 30 will be described in detail with reference to FIGS. 6 and 7. FIG. 6 is a view showing the support assembly 100 at the initial position of the drawer when viewed from inside the support cover 110, and FIG. 7 is a view showing the support assembly 100 at the ready position of the drawer when viewed from inside the support cover 110. Of course, the support cover 110 may be fixed to the sidewall of the storage compartment or the partition wall regardless of the movement of the drawer.

The motor assembly 160 may be provided in the predetermined space or electric driving unit mounting space 130 between the inside surface 112 of the support cover 110 and the partition wall 16. Specifically, the motor assembly 160 may be mounted to the inside surface 112 of the support cover 110. Consequently, the motor assembly 160 may be fixed to the support assembly 100 regardless of the movement of the drawer.

The motor assembly 160 may include a housing 161, in which power generating and transfer elements, such as a motor 162 and a gear 162*a*, may be received. The housing 161 is fixed to the support cover 110 such that the motor assembly 160 is stably supported by the support cover 110. As previously described, the part of the housing 161 corresponding to the motor 162 may protrude further outward than the remaining parts of the housing 161 due to the shape of the motor 162, and may be located in the motor avoidance recess 119.

A plurality of gears 162*a* may be provided in order to reduce the rotational speed and to transfer torque.

The electric driving unit 150 may include a connection member 163. The motor assembly 160 may include the connection member 163. The connection member 163 may be provided between the motor assembly 160, particularly the housing 161 of the motor assembly 160, and the moving frame 170. That is, the connection member 163 may be provided in order to interconnect the motor assembly 160 and the moving frame 170.

The connection member 163 may be configured such that the distance by which the connection member 163 is withdrawn from the motor assembly 160, particularly the housing 161, is changeable. That is, the distance by which the connection member 163 is withdrawn may be changed. When the distance by which the connection member 163 is withdrawn from the housing 161, which is fixed, is increased, the distance between the housing 161 and the moving frame 170 increases. On the other hand, when the distance by which the connection member 163 is withdrawn from the housing 161, which is fixed, is decreased, the distance between the housing 161 and the moving frame 170 decreases. Consequently, the motor assembly 160 may drive the connection member 163 such that the distance by which the connection member 163 is withdrawn is changed, and may move the moving frame 170 as the result thereof.

One side of the connection member 163 may be positioned so as to move relative to the motor assembly 160, and the other side of the connection member 163 may be positioned so as to move together with the moving frame 170. That is, the other side of the connection member 163 may be coupled to the moving frame 170. A connection member coupling part 174 may be formed at the moving frame 170. The connection member 163 is coupled to the moving frame 170 via the connection member coupling part 174. Consequently, the movement of the connection member 163 may result in the movement of the moving frame 170.

Specifically, the connection member 163 may be formed in the shape of a rack, and the motor assembly 160 may be formed in the shape of a pinion. That is, one of the gears 162*a* may be a pinion gear, which may be connected to the connection member 163. For example, the clockwise rotation of the motor 162 may be converted into the forward movement of the connection member 163 through the gears 162*a*, and the counterclockwise rotation of the motor 162 may be converted into the rearward movement of the connection member 163 through the gears 162*a*. Of course, the directions in which the motor is rotated and the directions in which the connection member is moved may be reversed based on the configuration of the gears.

Consequently, the distance by which the connection member is withdrawn may be increased or decreased according to the forward and reverse driving of the motor assembly 160. The driving of the motor assembly 160 may push or pull the connection member 163 and thus may push or pull the moving frame.

The moving frame 170 may be configured to transfer driving force generated by the motor assembly 160 to the drawer 30. Basically, therefore, the moving frame 170 is moved by the driving of the motor assembly 160. Specifically, the moving frame 170 may be movably provided on the inside surface 112 of the support cover 110.

As previously described, a plurality of drawers may be provided in the storage compartment. When the door is opened, all of the drawers may move from the initial position to the ready position. The movement of the drawers may be performed simultaneously. Consequently, the moving frame 170 may be configured to transfer a driving force to all of the drawers.

In order to transfer a driving force to the drawers, which are arranged vertically, the moving frame 170 may extend in a vertical direction. For example, the moving frame 170 may extend upward and downward. That is, the moving frame 170 may extend vertically so as to correspond to the height of the drawers, which are arranged vertically. In addition, the moving frame 170 may be provided with a plurality of transfer members 171. In the same manner, the transfer members may be disposed at a single moving frame 170 such that the transfer members are arranged vertically. One transfer member 171 may be provided so as to correspond to one drawer 30. As a result, all of the drawers, which are arranged vertically, may be moved by a single moving frame 170. That is, the moving frame may move forward to push the drawers.

In FIGS. 6 and 7, an example in which three transfer members 171 are formed at a single moving frame 170 is shown. This means that a single moving frame 170 is moved in order to move three transfer members 171 which are arranged vertically. That is, three transfer members 171 may be simultaneously moved from the initial position to the ready position by moving a single moving frame 170. As a result, it is possible to simultaneously move a plurality of drawers through a single motor assembly 160, a single connection member 163, and a single moving frame 170. That is, it is possible to easily move a plurality of drawers even though only one electric driving unit 150 that is operably connected to a single door 20 is provided. Consequently, it is possible to realize simple and easy control logic. In addition, the motor assembly 160, the connection member 163, and the moving frame 170 may not be provided for each drawer. As a result, it is possible to minimize the reduction in capacity of the storage compartment. Of course, it is possible to minimize the increase in manufacturing cost and to realize very easy installation and maintenance.

The moving frame 170 may be supported on the inside surface 112 of the support cover 110 such that the moving frame 170 can move forward and rearward. More specifically, the moving frame 170 may be supported such that the moving frame 170 can slide forward and rearward.

As previously described, the moving frame 170 may be configured to move a plurality of drawers 30. To this end, the moving frame 170 may be formed in the shape of a plate that extends vertically. That is, the moving frame 170 may be formed in the shape of a plate that extends in a vertical direction. In addition, the deviation in movement between the upper and lower parts of the moving frame 170 may be minimized when the moving frame 170 is moved.

Figure 8:
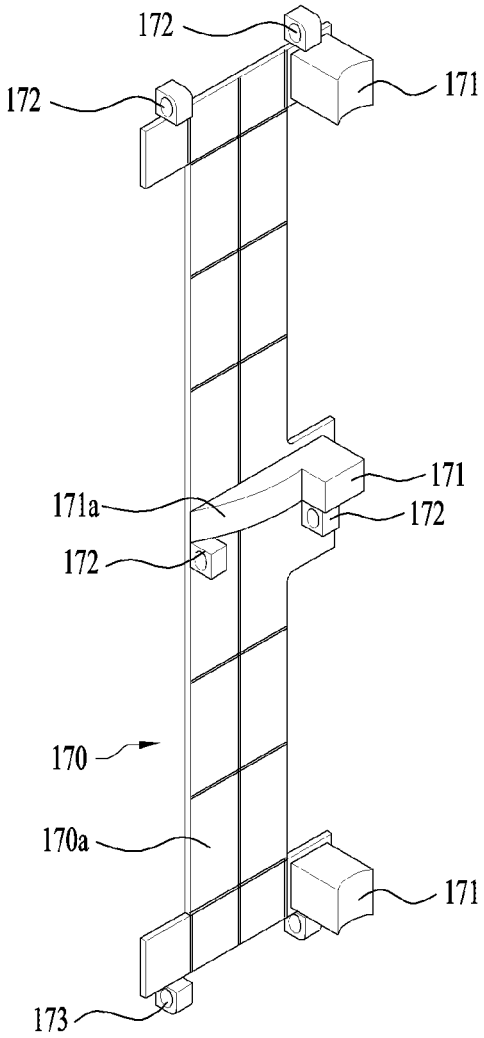
FIG. 8 is a view of the moving frame shown in FIG. 4.

FIG. 8 is a perspective view of the moving frame 170. The moving frame 170 is configured to have a structure for simultaneously withdrawing three drawers.

Transfer members 171 may be provided at the upper end, the lower end, and the middle of the moving frame 170. To this end, the moving frame 170 may extend vertically so as to correspond to the height of the drawers 30.

The moving frame 170 may be formed in the shape of a plate that extends in a vertical direction. The moving frame 170 may have a relatively small thickness. In order to increase the rigidity of the moving frame 170, therefore, a plurality of ribs 170*a* may be formed at the moving frame 170. The ribs may include horizontal ribs and vertical ribs. In addition, the ribs may be formed in the shape of a lattice.

Specifically, the moving frame 170 may be formed in the shape of a plate that has a predetermined width in a direction in which the moving frame 170 is moved, i.e. in a forward and rearward direction. Of course, the moving frame 170 may be formed in the shape of a rectangle that has a height greater than a forward and rearward width. As previously described, the vertical height of the moving frame 170 may be formed so as to correspond to the height at which the drawers are arranged. In addition, the moving frame 170 may be formed in the shape of a thin plate having a relatively small thickness. Consequently, it is possible to minimize the reduction of the inner space of the storage compartment due to the thickness of the moving frame 170 and to move the drawers 30 while exhibiting sufficient rigidity. This is because force is applied to the moving frame 170 in the forward and rearward direction, not in the thickness direction, when the moving frame 170 pushes the drawer 30.

In addition, the moving frame 170 may be provided with a sliding support part 172. A pair of sliding support parts 172 may be formed at the upper end of the moving frame 170, and a pair of sliding support parts 172 may be formed at the lower end of the moving frame 170. In addition, a pair of sliding support parts 172 may be formed at the middle of the moving frame 170. Consequently, the moving frame 170 may move in a state in which the moving frame 170 is supported by at least four upper, lower, left, and right support points. The moving frame 170 may have two upper support points, two lower support points, and two middle support points. As a result, it is possible to prevent the moving frame from being twisted when the moving frame 170 is moved forward and rearward.

The forward and rearward width of the upper end and the lower end of the moving frame 170 may be increased in order to form the support parts 172 at the upper end and the lower end of the moving frame 170. The transfer members 171 may be formed at the extension parts of the moving frame 170.

On the other hand, the middle of the moving frame 170, at which the transfer member is formed, may not extend horizontally. As a result, the transfer member 171 formed at the middle of the moving frame 170 may become separated from the moving frame 170 when the transfer member 171 is used for a long period of time. That is, a connection between the transfer member 171 and the moving frame 170 may be broken or damaged. This is because the transfer member 171 may protrude from the moving frame 170 and may be bent and thus broken or damaged when the transfer member 171 is used for a long period of time.

In order to solve this problem, a reinforcement rib or reinforcement protrusion 171*a* may be formed between the moving frame 170 and the transfer member provided at the middle of the moving frame 170. The reinforcement rib may be formed parallel to a direction in which force is applied to the reinforcement rib. A plurality of reinforcement ribs may be formed, or the reinforcement protrusion 171*a* may extend from the transfer member.

Meanwhile, when the moving frame 170 is used for a long period of time, the middle part of the moving frame 170 may extend toward the drawer or in the opposite direction. That is, the middle part of the moving frame 170 may become convex. In this case, the transfer member may be constrained in the slit 113, or may escape from the slit 113. Particularly, in a case in which the transfer member escapes from the slit 113, it is not possible for the transfer member to transfer force to the drawer 30.

For this reason, the middle part of the moving frame 170 as well as the upper and lower ends of the moving frame 170 may be slidably supported.

In order to more smoothly move the moving frame 170, guide bars 114 may be formed at the support cover 110. The guide bars 114 may be formed so as to correspond to the upper and lower ends of the moving frame 170. To this end, the guide bars may include an upper guide bar and a lower guide bar. More specifically, the guide bars 114 may be formed so as to correspond to the upper end, the middle, and the lower end of the moving frame 170. In the same manner, the sliding support parts 172 may be formed at the upper end, the middle, and the lower end of the moving frame 170.

Each of the sliding support parts 172 may be formed so as to surround a corresponding one of the guide bars 114. Consequently, the sliding support parts 172 may slide forward and rearward in a state in which the sliding support parts 172 surround the respective guide bars 114.

Figure 9:
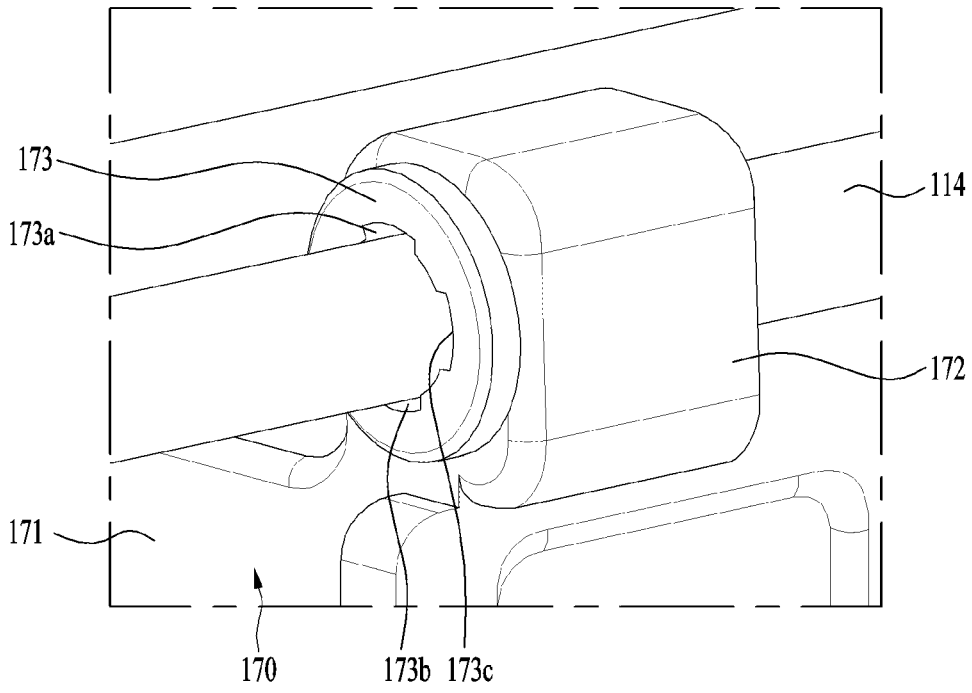
FIG. 9 is an enlarged view of part "A" shown in FIG. 7.

FIG. 9 is a partially enlarged view showing the sliding support part 172 and the guide bar 114. Specifically, FIG. 9 is an enlarged view of part "A" shown in FIG. 7. FIG. 9 shows that the sliding support part 172 surrounds the guide bar 114.

As shown in FIG. 9, a liner 173 may be interposed between the guide bar 114 and the sliding support part 172. The liner may be made of a polyoxymethylene (POM) material. That is, the liner may be made of engineered plastic such as polyacetal or polyoxymethylene. The POM material exhibits high mechanical strength, high wear resistance, low frictional resistance, and high lubricity. For this reason, it is possible for the guide bar 114 to support the moving frame 170 such that the moving frame 170 can move smoothly even when the guide bar 114 is used for a long period of time. Of course, the guide bar 114 may be coated with a lubricant such as grease.

As shown in FIG. 9, the sliding support part 172 slides forward and rearward along the guide bar 114. At this time, the sliding support part 172 may not move smoothly due to the loading and twisting of the moving frame 170.

Friction may be concentrated on the upper inside surface and the lower inside surface of the liner 173 due to the loading of the moving frame 170. In addition, friction may be concentrated on the left inside surface and the right inside surface of the liner 173 due to the twisting of the moving frame 170, which may be caused by the force applied to the transfer member 171 protruding from the moving frame 170.

For this reason, friction avoidance recesses 173*a*, 173*b*, 173*c*, and 173*d* may be formed in the upper inside surface, the lower inside surface, the left inside surface, and the right inside surface of the liner 173, respectively. It is possible to minimize the frictional force between the liner and the guide bar by the provision of the friction avoidance recesses 173*a*, 173*b*, 173*c*, and 173*d*, whereby the moving frame may move smoothly while being securely supported.

In particular, the friction avoidance recesses 173*a*, 173*b*, 173*c*, and 173*d* may be filled with grease, by which the frictional force may be further minimized. In addition, since sufficient grease is supplied to a friction part, the moving frame may move smoothly even when the moving frame is used for a long period of time.

The moving frame 170 may simultaneously withdraw a plurality of drawers. In other words, the moving frame 170 may simultaneously push a plurality of drawers without temporal or positional deviation. If temporal or positional deviation occurs, the moving frame 170 may be twisted. As a result, the moving frame 170 may not move smoothly, and excessive stress may be concentrated on a specific part of the moving frame.

Consequently, it may be very important to mount the moving frame 170 in position. To this end, the guide bar 114 may be mounted in position first. To this end, guide bar fixing parts 114*a* may be provided.

As shown in FIGS. 6 and 7, the guide bar fixing parts 114*a* may be formed at two upper points and two lower points of the support frame. The two guide bars may be mounted in position without upward and downward deviation or forward and rearward deviation, owing to the provision of the guide bar fixing parts 114*a*. The moving frame may also be mounted in position through the guide bars.

In order for the transfer members 171, provided at the moving frame, to simultaneously transfer force to the drawers, the drawers must be mounted in position without deviation, which will be described hereinafter in detail when the detailed structure of the drawers is described.

Meanwhile, in FIG. 6, the motor assemblies 160 are mounted lower than the upper and lower centers of the support cover 110 such that the motor assemblies 160 are mounted vertically through the partition wall 16, as described with reference to FIG. 4. That is, the motor assemblies 160 may be mounted to the opposite support cover 110 at higher positions than the upper and lower centers of the support cover 110.

The connection member 163 may push or pull the upper part or the lower part of the moving frame 170 at positions other than the upper and lower center parts of the moving frame 170, due to the position of the motor assembly 160. Basically, therefore, the connection member 163 applies force to the moving frame such that the moving frame is twisted. In order to minimize the application of force to the moving frame 170 at eccentric positions, rather than the upper and lower center parts of the moving frame 170, the connection member 163 includes an extension part 164. The extension part 164 may extend upward or downward from the end of the connection member 163 (i.e. the end of the connection member 163 that is connected to the moving frame).

The extension part 164 may be formed so as to extend through the upper and lower center parts of the moving frame 170. That is, the extension part 164 shown in FIG. 6 may extend further upward from the upper and lower center parts of the moving frame 170, and the opposite extension part 164 may extend further downward from the upper and lower center parts of the moving frame 170. As a result, it is possible to minimize twisting of the moving frame 170 even when the upper and lower centers of the connection member 163 are not aligned with the upper and lower centers of the moving frame 170. The connection member 163 may be coupled to the moving frame as the result of the coupling between the extension part 164 and the connection member coupling part 174.

A plurality of connection member coupling parts 174 may be provided in order to uniformly transfer force and displacement applied through the connection member 163 to the upper and lower parts of the moving frame 170. In addition, it is possible to uniformly transfer a driving force generated by the electric driving unit to the moving frame 170 through the extension part 164.

As previously described, the through part 113 is formed in the support cover 110. The through part 113 may be referred to as a slit-shaped through part or a slit. The number of through parts 113 may be the same as the number of drawers 30. The through parts 113 are formed through the support cover 110. As shown in FIGS. 6 and 7, the through parts 113 are formed in the support cover 110 so as to extend horizontally. The transfer member 171 moves leftward and rightward along the slit 113. In the refrigerator, the transfer member 171 moves forward and rearward along the slit 113. Since the transfer member is formed through the support cover 110, the transfer member may be connected to the drawer 30 provided on the outside surface 111 of the support cover 110. That is, the transfer member 171 may be coupled to the drawer 30, or may contact the drawer 30. The transfer member 171 may be connected to the drawer 30 in order to directly apply force to the drawer 30.

As shown in FIG. 6, the distance between the motor assembly 160 and the moving frame 170 at the initial position of the drawer and the moving frame is relatively small. In this state, the moving frame 170 is biased to the left side. In other words, the moving frame is more deeply positioned in the storage compartment of the refrigerator.

When the motor assembly 160 is driven, the distance between the motor assembly 160 and the moving frame 170 is increased. That is, the connection member 163 pushes the moving frame 170 such that the moving frame 170 moves forward. At this time, the transfer member 171 pushes the drawer 30 as the result of the movement of the moving frame 170, whereby the drawer 30 is moved to the ready position. In other words, the support assembly 100 is moved from the initial position shown in FIG. 6 to the ready position shown in FIG. 7. That is, the connection member 163 and the moving frame 170 shown in FIG. 6 are positioned at the initial position, and the connection member 163 and the moving frame 170 shown in FIG. 7 are positioned at the ready position.

On the other hand, the relative position between the support cover 110 and the housing 161 of the motor assembly is not changed. Consequently, the moving frame 170 may be provided between the initial position and the ready position so as to be moved forward and rearward by the motor assembly 160. In addition, the moving frame 170 may be connected to the drawer in order to apply force to the drawer in a direction in which the drawer is withdrawn from the initial position to the ready position.

Figure 10:
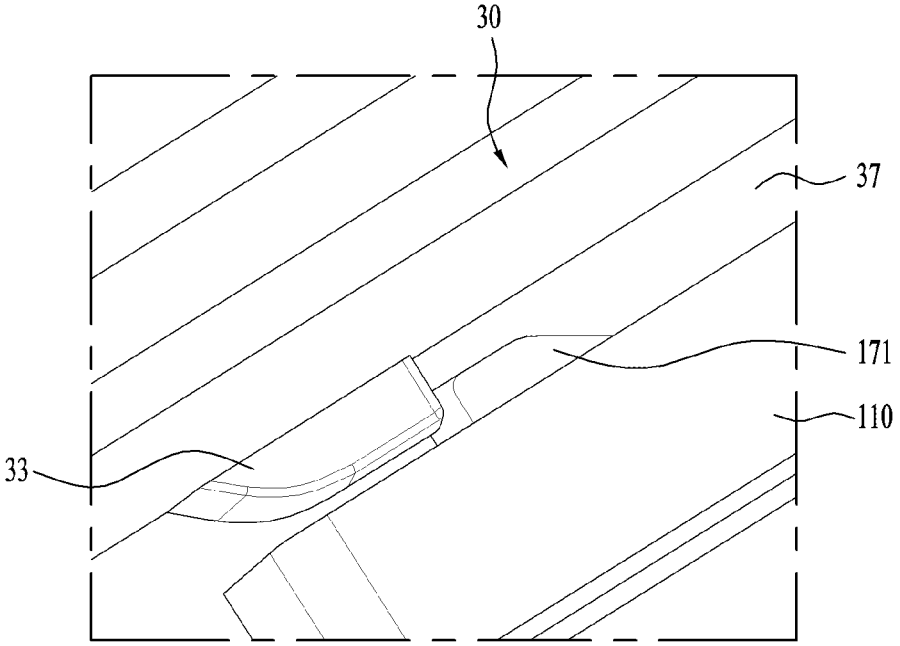
FIG. 10 is an enlarged view showing a connection between a catching member of the drawer and a transmission member of the moving frame.

As shown in FIG. 10, the connection between the drawer 30 and the moving frame, particularly the transfer member 171, may be referred to as catching. In addition, the connection release may be referred to as catching release.

Specifically, the drawer 30 is provided with a catching member 33. The catching member 33 may protrude toward the support cover 110. The transfer member 171 may protrude toward the drawer 30 through the support cover 110.

The transfer member 171 is positioned at the rear of the catching member 33. As a result, a pushing force may be transferred to the transfer member 171, but a pulling force may not be transferred to the transfer member 171. That is, the transfer member 171 pushes the catching member 33 forward while moving forward. When the transfer member 171 is moved rearward, however, the connection between the catching member 33 and the transfer member 171 is released. Consequently, the transfer member 171 may selectively push the catching member 33. More specifically, the transfer member 171 pushes the catching member 33 forward when the transfer member 171 moves forward, but does not push the catching member when the transfer member 171 moves rearward.

The catching member 33 may be formed at a rail coupling part 37 of the drawer 30. That is, the catching member 33 may be formed at the rail coupling part 37, at which the drawer 30 is coupled to the rail 120. Consequently, the position at which the drawer is pushed is substantially identical to the position at which the drawer is coupled to the rail 120.

Figure 11:
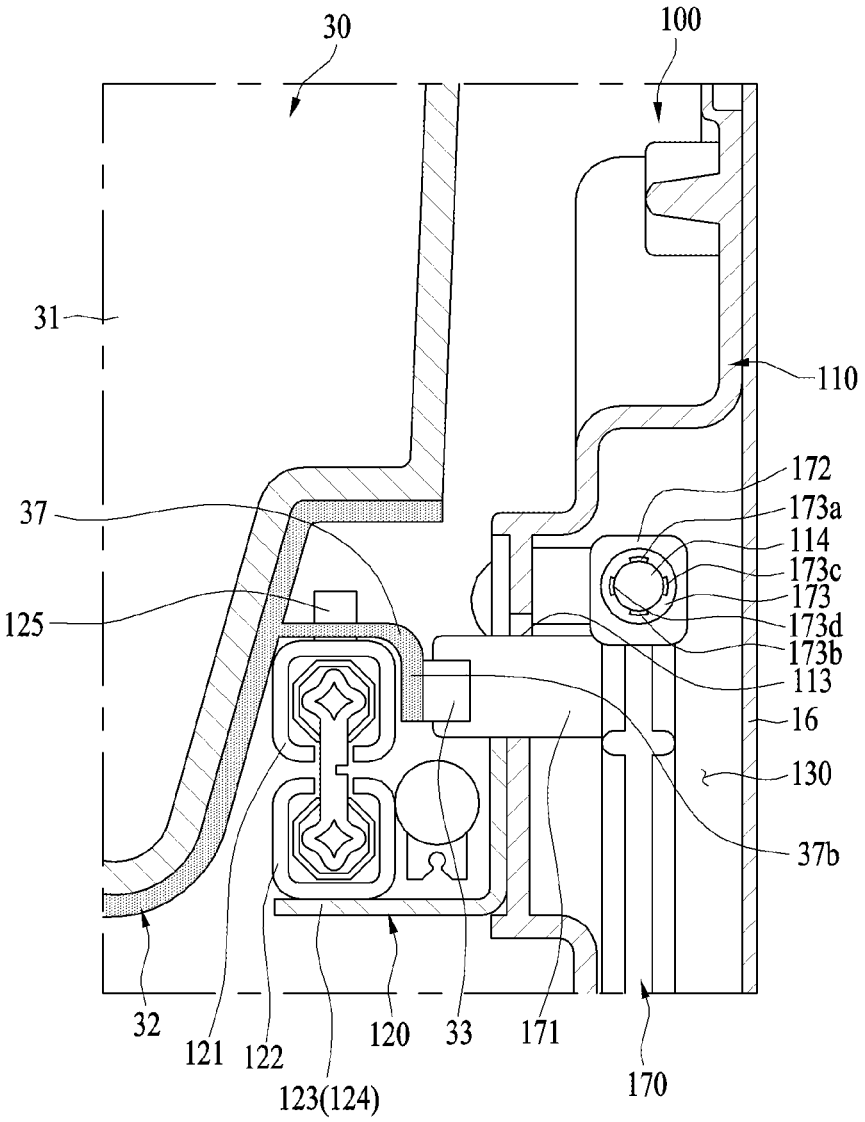
FIG. 11 is an enlarged sectional view showing a connection between the drawer and the support assembly.

Hereinafter, an automatic movement mechanism of the drawer 30 will be described in detail with reference to FIG. 11. FIG. 11 is an enlarged sectional view showing a connection between the drawer 30 and the support assembly 100.

The drawer 30 may include a basket 31 for receiving goods and a drawer frame 32 provided outside the basket 31. The basket 31 may be supported by the rail 120 via the drawer frame 32 such that the basket 31 can move along the rail 120. The basket 31 and the drawer frame 32 may be moved as one body. The drawer frame 32 may be provided at the lower side of the basket 31.

The rail 120 may include a fixed rail 122 and a moving rail 121. The rail 120 may be coupled to the sidewall of the storage compartment or the partition wall 16 via rail brackets 123 and 124. In addition, the rail 120 may be coupled to the support cover 110.

The fixed rail 122 may be configured to support the load of the drawer 30. The moving rail 121 may be configured to move forward and rearward relative to the fixed rail 122. For example, the moving rail 121 may be configured to slide relative to the fixed rail 122.

The moving rail 121 is coupled to the rail coupling part 37 of the drawer 30. Consequently, the moving rail 121 and the drawer 30 may move forward and rearward as one body.

The rail coupling part 37 is formed at the side of the drawer. In addition, the rail coupling part 37 may be provided to locate the moving rail 121 in the upper part thereof. That is, the rail coupling part 37 may be provided such that the upper part of the moving rail 121 is located in the rail coupling part 37 while the upper part of the moving rail 121 is surrounded by the rail coupling part 37.

The structure of the drawer 30 and the coupling structure between the drawer 30 and the rail 120 will be described hereinafter in detail.

The drawer frame 32 is positioned at one side (the left side) of the support cover 110, and the moving frame 170 is positioned at the other side (the right side) of the support cover 110. The transfer member 171 of the moving frame 170 may extend to the vicinity of the drawer frame 32 through the slit 113 formed in the support cover 110.

The moving frame 170 may be selectively connected to the drawer frame 32. That is, the moving frame 170 may be configured to selectively push the drawer through the drawer frame 32. As the result of the connection between the moving frame 170 and the drawer frame 32, the movement of the moving frame 170 may be converted into the movement of the drawer frame 32, i.e. the drawer 30. On the other hand, as the result of the disconnection between the moving frame 170 and the drawer frame 32, conversion of the movement of the moving frame 170 into the movement of the drawer 30 may be prevented.

Specifically, the drawer 30 may be provided with a catching member 33. The catching member 33 may be referred to as a first catching member 33 such that the catching member 33 is distinguished from another catching member, which will be described hereinafter. The first catching frame 33 may be formed at the drawer frame 32, and may extend toward the moving frame 170. Consequently, the first catching frame 33 may be formed at the side surface of the drawer 30. More specifically, the first catching frame 33 may be formed at the lower side surface of the drawer 30.

As previously described, the moving frame 170 may move forward from the initial position to the ready position. The movement of the moving frame 170 is converted into the movement of the drawer 30 from the initial position to the ready position. The movement of the moving frame 170 from the initial position to the ready position may be performed by the application of force to the moving frame 170 from the rear of the moving frame 170. Consequently, the moving frame 170 may push the drawer 30 such that the drawer 30 is moved from the initial position to the ready position.

To this end, as described with reference to FIG. 10, the first catching member 33 may be positioned at the front of the transfer member 171. In addition, the moving frame 170 contacts the drawer 30 in a state in which the moving frame 170 and the drawer 30 are in the initial position. As the transfer member 171 moves from the initial position to the ready position, therefore, the transfer member 171 may continuously push the first catching member 33. As a result, the drawer 30 may also be moved from the initial position to the ready position.

On the other hand, in a state in which the drawer 30 is at the ready position, the transfer member 171 may return rearward, which may be referred to as the return of the transfer member to the initial position. That is, at this time, the connection or catching between the transfer member 171 and the first catching member 33 is released. Consequently, the drawer 30 remains at the ready position, and the transfer member 171, particularly the moving frame 170, may return rearward.

In addition, as shown in FIG. 11, the sectional area of the transfer member 171 may be greater than the sectional area of the catching member 33. That is, the relatively large transfer member 171 may transfer force to the relatively small catching member 33. Consequently, force is stably transferred from the transfer member 171 to the catching member 33. In addition, the transfer member 171 may further extend upward and downward from the catching member 33. Consequently, the transfer member 171 may stably transfer force to the entire contact surface of the catching member 33, even when the catching member 33 droops.

As previously described, at the initial position, the drawer 30 may remain in the storage compartment. When the user wishes to use the drawer 30, the user opens the door 20 and pulls the drawer 30 such that at least a portion of the drawer is withdrawn from the storage compartment. The above-mentioned maximum withdrawal position may be a position at which the drawer 30 is maximally withdrawn forward in a state in which the drawer 30 is supported by the rail 120. The maximum withdrawal position may be preset through the rail 120. That is, the distance between the ready position and the maximum withdrawal position may be preset.

Basically, the drawer 30 may be supported by the rail 120 such that the drawer 30 can move between the initial position and the maximum withdrawal position. As previously described, the drawer 30 may automatically move from the initial position to the ready position by driving of the electric driving unit 150.

The drawer may be manually withdrawn from the ready position to the maximum withdrawal position (a position spaced apart forward from the ready position by a predetermined distance). That is, the connection between the moving frame 170 and the drawer 30 is released between the ready position and the maximum withdrawal position such that the drawer 30 can be manually withdrawn.

When the door 20 is opened, the drawer 30 may automatically move to the ready position such that the user can easily withdraw the drawer 30. In order to use the drawer 30, the user may further manually withdraw the drawer 30 away from the ready position. After the use of the drawer 30, the user may manually insert the drawer 30 into the storage compartment. For example, the user may manually push the drawer 30 to the ready position or to the vicinity of the ready position. Of course, the user may manually push the drawer 30 to the initial position.

That is, automatic withdrawal of the drawer 30, which is achieved simultaneously when the door is opened, may be performed from the initial position to the ready position, and the drawer 30 may be manually withdrawn from the ready position to the maximum withdrawal position.

Meanwhile, when the drawer 30 is withdrawn to the ready position, the motor assembly 160 may be operated to move the connection member 163 to the initial position. Consequently, the insertion of the drawer 30 may be performed manually. Manual insertion may be performed as follows. The user may insert the drawer 30 while directly holding the drawer 30. Alternatively, when the door 20 is closed, the door 20 may push the drawer 30 such that the drawer 30 is inserted. The reason for this is that the user's force is used to insert the drawer.

For example, the user may directly push the drawer 30 from the maximum withdrawal position to the initial position such that the drawer 30 is inserted. Alternatively, the user may directly push the drawer 30 from the maximum withdrawal position to the ready position such that the drawer 30 is inserted, and may then close the door 20 such that the drawer 30 is pushed to the initial position. When the door 20 is closed, the door basket provided at the rear of the door 20 pushes the drawer 30. When the user manually closes the door 20, therefore, the user must use force greater than the force required to insert the drawer in order to close the door 20.

In the above, the mechanism between the drawer 30 and the support assembly 100 has been described in terms of automatic withdrawal of the drawer 30. That is, an embodiment in which the drawer 30 is automatically withdrawn using electrical energy has been described. In the above embodiment, it is not necessary for the user to apply force to the drawer 30 in order to withdraw the drawer 30.

Meanwhile, effort on the part of the user may be minimized when the drawer 30 is inserted as well as when the drawer 30 is withdrawn. That is, it is not necessary for the user to apply force to the drawer 30 in order to insert the drawer 30.

In this embodiment, it is possible to provide a refrigerator configured such that the drawer 30 can be inserted automatically for user convenience. In particular, it is possible to provide a refrigerator configured such that the drawer 30 can be automatically pushed from the ready position or the vicinity of the ready position to the initial position. That is, for the same reason that no force from the user is needed to automatically withdraw the drawer 30, no force from the user may be needed to automatically insert the drawer 30. In addition, the door basket 25 provided at the rear of the door 20 may prevent impact from being applied to the drawer, and it may not be necessary for the user to apply force to the drawer in order to insert the drawer, except for the force necessary to close the door 20.

To this end, an automatic drawer insertion device may be provided. Accordingly, the drawer may be inserted back into the initial position without the user having to provide the required closing force. For example, as described in this embodiment, an elastic device 180 may be provided. The elastic device 180 may be mounted to the sidewall of the storage compartment. In the same manner as in the previous embodiment, the elastic device 180 may be mounted to the support cover 110.

Figure 12:
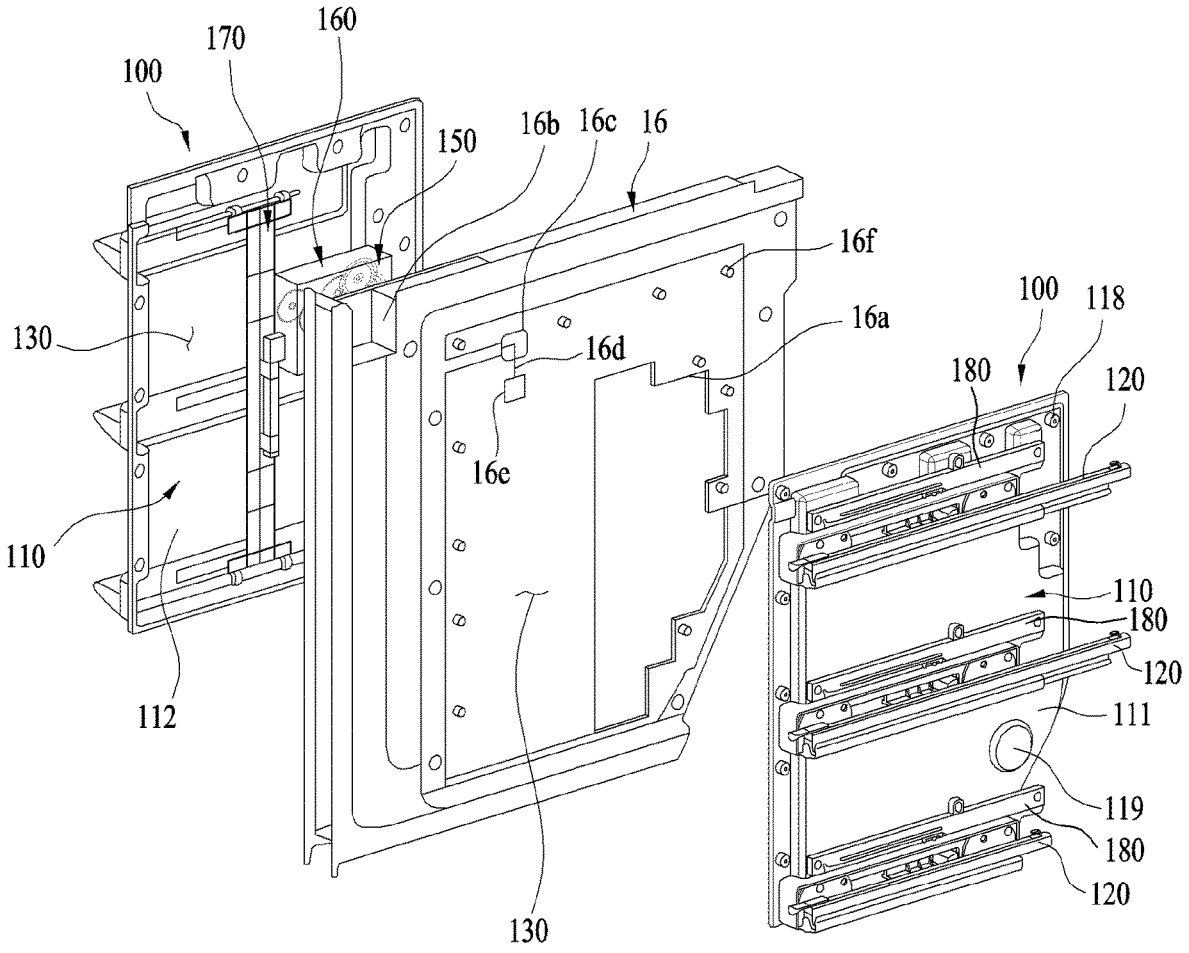
FIG. 12 is an exploded view showing a support assembly according to another embodiment of the present invention.
Figure 13:
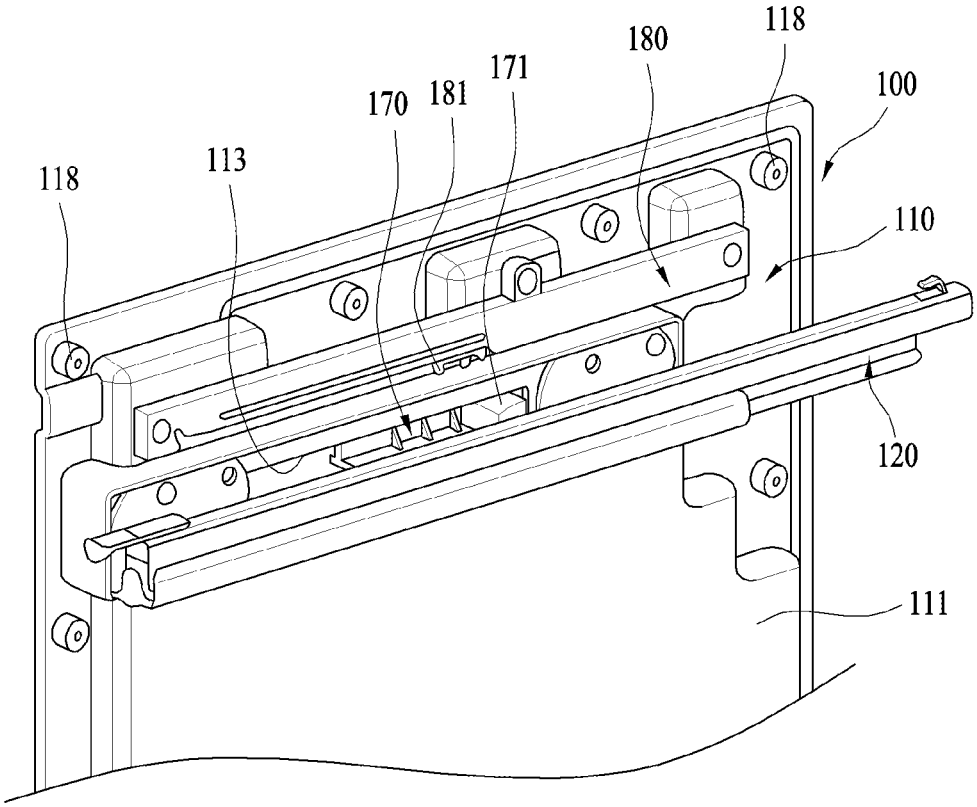
FIG. 13 is a view showing a state in which a rail and an elastic device are mounted to a support cover in the support assembly shown in FIG. 12.
Figure 14:
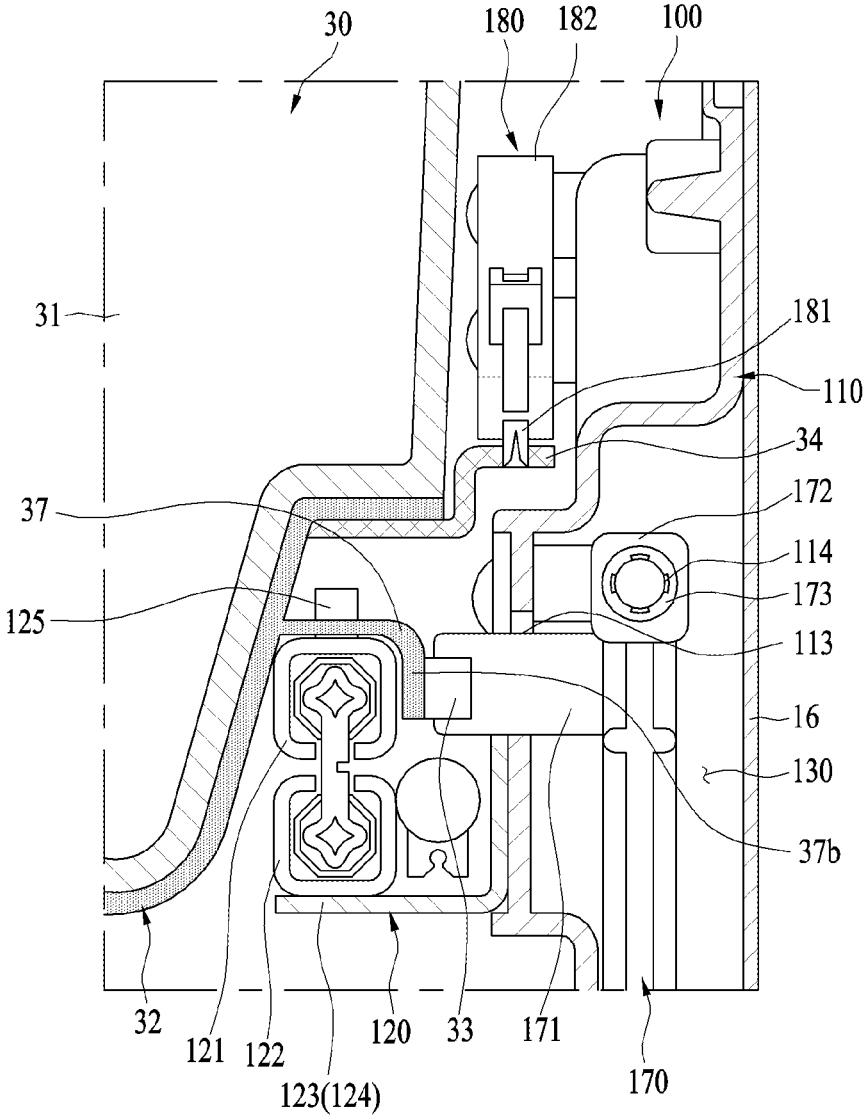
FIG. 14 is an enlarged sectional view showing a connection between the drawer and the support assembly.

Hereinafter, an embodiment including an elastic device 180 will be described in detail with reference to FIGS. 12 to 14. In FIGS. 12 to 14, an elastic device 180 is added, unlike FIGS. 4, 5, and 11. Consequently, a detailed description of elements corresponding to the elements described with reference to FIGS. 4, 5, and 11 will be omitted.

The elastic device 180 may be configured to provide an elastic restoring force to the drawer 30. In particular, the elastic device 180 may be configured such that the elastic device 180 is elastically deformed when the drawer 30 is withdrawn and such that the elastic device 180 provides an elastic restoring force to the drawer 30 when the drawer 30 is inserted. That is, the withdrawal of the drawer may be automatically performed by the electric driving unit, and the insertion of the drawer may be automatically performed by the elastic device 180. In other words, the withdrawal of the drawer may be automatically performed by the driving force of the motor, and the insertion of the drawer may be automatically performed by the elastic restoring force of the elastic device 180.

In addition to the rail 120, the elastic device 180 may be mounted to the support cover 110. Specifically, a set including a pair of rails 120, a slit 113, and an elastic device 180 may be provided at a single drawer 30. In a case in which a plurality of drawers 30 is provided, a plurality of sets may also be provided. In addition, in the same manner as the rail 120, the elastic device 180 may be mounted to the outside surface 111 of the support cover 110.

The rail 120 may be mounted to the lower side of the slit 113, formed in the support cover 110, and the elastic device 180 may be mounted to the upper side of the slit 113.

The elastic device 180 may be configured to provide an elastic restoring force to the drawer 30 when the drawer 30 returns from the ready position or the vicinity of the ready position to the initial position. The drawer 30 may be automatically returned to the initial position by the elastic restoring force.

To this end, the elastic device 180 may be selectively connected to the drawer 30. That is, the elastic device 180 may be configured to selectively hold the drawer.

Specifically, the elastic device 180 may include a hanging member 181. The hanging member 181 may be selectively connected to the drawer 30. More specifically, the drawer may be provided with a second catching member 34. That is, as shown in FIG. 14, a second catching member 34, which is connected to the hanging member 181 of the elastic device 180, may be provided in addition to the first catching member 33, which is connected to the transfer member 171 of the moving frame.

The second catching member 34 may be provided at the upper side of the first catching member 33. Specifically, the second catching member 34 may protrude from the drawer frame 32 toward the support cover 110.

Figure 15:
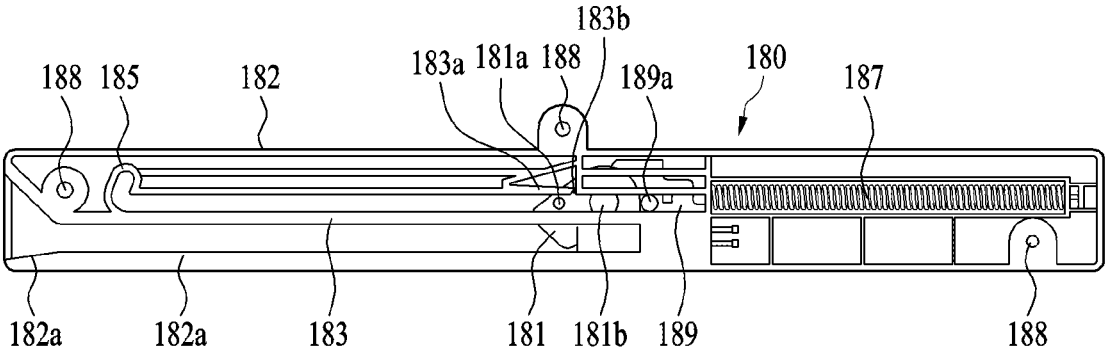
FIG. 15 is a front view showing an example of the elastic device.

Hereinafter, an embodiment of the elastic device 180 will be described in detail with reference to FIG. 15.

The elastic device 180 includes a spring 187 as an example of an elastic member. In addition, a hanging member 181 is provided in order to elastically deform the spring 187. The hanging member is coupled to the catching member of the drawer 30 such that the hanging member is displaced in response to the movement of the drawer 30. As the result of this displacement, the elastic device 180 may be elastically deformed or may generate an elastic restoring force.

A connection member 189 may be interposed between the hanging member 181 and the spring 187. One end of the spring 187 is fixed, and the other end of the spring 187 is coupled to the connection member 189. The connection member 189 is coupled to the hanging member 181. Consequently, the hanging member 181 and the connection member 189 are moved as one body, whereby the spring 197 may be elastically deformed or elastically restored.

The elastic device 180 includes a housing 182. The housing 182 receives the spring 187 and the hanging member 181. Of course, the housing 182 may receive the connection member 189. The housing 182 may be provided with a plurality of coupling parts 188. The elastic device 180 may be fixedly coupled to the sidewall of the storage compartment, the partition wall, or the support cover 110 via the coupling parts 188.

The hanging member 181 is basically configured to move while being displaced linearly. A slot 183 is formed in order to guide the movement of the hanging member 181. The hanging member 181 is provided with a guide protrusion 181*a*. The guide protrusion 181*a* moves along the slot 183.

As the hanging member 181 moves forward, the connection between the hanging member 181 and the drawer is released at a specific position. To this end, an inclined slot 185 may be formed at the front of the slot 183. During the forward movement of the hanging member 181, the guide protrusion 181*a* may move upward along the inclined slot 185. The upward movement of the guide protrusion 181*a* is achieved by the rotation of the hanging member 181. To this end, the hanging member 181 may be provided with a rotating protrusion 181*b*, which forms the rotational center of the hanging member 181.

The rotating protrusion 181*b* moves forward and rearward along the slot 183 in the same manner as the guide protrusion 181*a*. The rotating protrusion 181*b* may be positioned at the rear of the guide protrusion 181*a*. When the guide protrusion 181*a* moves upward along the inclined slot 185, therefore, the hanging member 181 is rotated about the rotating protrusion 181*b*.

When the rotating protrusion 181*b* is caught by the inclined slot 185, the connection between the drawer 30 and the elastic device 180 is released. When the drawer 30 is inserted, however, the drawer may be reconnected with the elastic device 180. At this time, the drawer 30 may be automatically inserted by the elastic restoring force.

Here, it should be noted that the insertion speed of the drawer may be configured to be higher than the withdrawal speed of the drawer. For example, the speed at which the elastic device 180 inserts the drawer back into the storage compartment, or in some cases the speed at which the drawer is inserted back into the storage compartment by being driven by a motor, may be higher than the withdrawal speed at which the drawer is withdrawn from the storage compartment by the driving force of the motor. In some cases, the insertion speed may be approximately 1.5 to 2.0 times higher than the withdrawal speed. This difference in speed can help prevent, for example, the door from crashing into the drawer when the drawer is being inserted back into the storage compartment.

The connection member 189 may also be provided with a guide protrusion 189*a*, which is configured to move along the slot 183.

The housing 182 may be provided with a guide slot 182*a* for guiding the movement of the second catching member 34, which is selectively connected to the hanging member 181. An enlarged opening 182*b* may be formed in the front of the guide slot 182*a*. The catching member 34 moves forward along the guide slot 182*a* and escapes from the enlarged opening 182*b* at a specific position. That is, after the connection between the drawer and the elastic device is released, the drawer may be withdrawn further forward. In other words, the drawer may be further withdrawn.

Meanwhile, when the withdrawn drawer is inserted, the catching member 34 must enter the guide slot 182*a*. In order to more easily perform such entry, the enlarged opening 182*b* is provided.

The housing 182 may be provided with a positioning part 183*a* for placing the hanging member 181 in position. The positioning part 183*a* may be configured to position the hanging member 181 in position after the hanging member 181 returns rearward.

When the hanging member 181 is not positioned in position at the rear, as previously described, the drawer may not be completely inserted to the initial position. Consequently, the hanging member 181 may return rearward due to the elastic restoring force of the spring, and then the hanging member 181 may be prevented from moving forward by a repulsive force.

To this end, the positioning part 183*a* may be formed in the shape of a rib.

The positioning part 183*a* may be formed at the rear of the slot 183, or may be inclined rearward in a direction in which the height of the slot 183 is reduced. Of course, the height of the slit at the positioning part 183*a* may be smaller than the height of the slit at the other parts.

Consequently, the guide protrusion 181*a* of the hanging member 181 may return to the proper position while pushing the positioning part 183*a* upward due to the elastic restoring force. Subsequently, the positioning part 183*a* pushes the guide protrusion 181*a* due to the elastic restoring force thereof. Consequently, the guide protrusion 181*a* may be maintained in position.

A communication part 183*b* may be formed in the end of the positioning part 183*a* and the slot 183. The guide protrusion 181*a* may be inserted into the slot 183 through the communication part 183*b*.

The left side diameter and the right side diameter of the guide protrusion 181*a* are greater than the height of the slot 183. However, the diameter of the part corresponding to the slot 183 is equal to or less than the height of the slot 183. Consequently, the guide protrusion 181*a* moves forward and rearward along the slot 183 but does not escape from the slot 183. As a result, it is not easy to insert the guide protrusion 181*a* into the slot 183.

The communication part 183*b* may be a structure for inserting the guide protrusion 181*a* into the slot 183.

However, the guide protrusion 181*a* may escape from the slot 183 through the communication part 183*b*. That is, if the upper part of the positioning part 183*a* is plastically deformed, the guide protrusion 181*a* may be constrained by the positioning part 183*a*. As a result, the drawer 30 may not be automatically withdrawn.

In order to minimize the breakage or bending of the positioning part 183*a*, therefore, the positioning part 183*a* may be formed in the shape of a cantilever. In addition, the thickness of the fixed end of the positioning part 183*a* may be greater than the thickness of the free end of the positioning part 183*a*. For example, the thickness of the positioning part 183*a* may be gradually decreased from the fixed end to the free end thereof.

As a result, the positioning part 183*a* may be reinforced while the positioning part 183*a* is easily elastically deformed. In addition, the positioning part 183*a* may be reinforced by increasing the horizontal width of the fixed end of the positioning part 183*a*.

Consequently, it is possible to prevent the breakage of the positioning part 183*a* even when the positioning part 183*a* is used for a long period of time.

Meanwhile, the hanging member 181 may be an element that requires high strength and low friction. In the same manner as the liner 173, therefore, the hanging member 181 may be made of a POM material.

Figure 16:
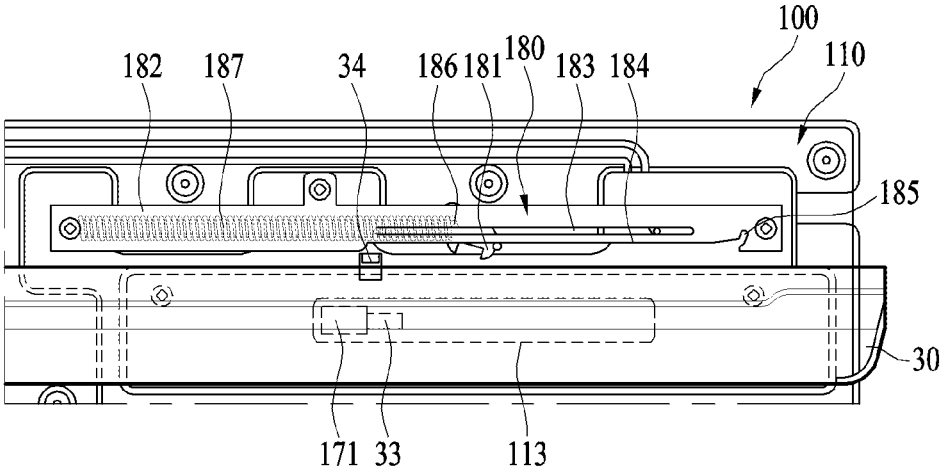
FIG. 16 is a side view showing a connection between the lower part of the drawer and the support assembly at an initial position of the drawer.
Figure 17:
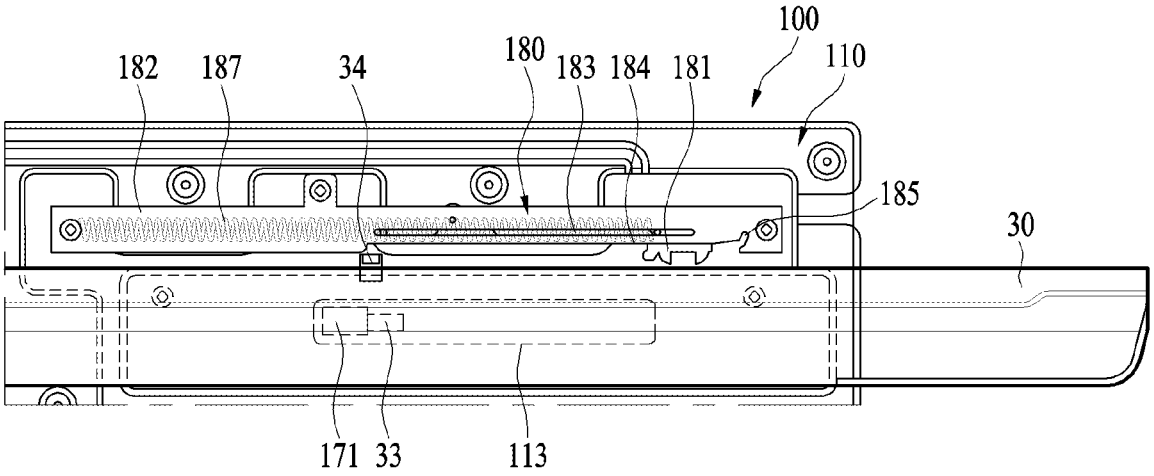
FIG. 17 is a side view showing the connection between the lower part of the drawer and the support assembly at a ready position of the drawer.

Hereinafter, a mechanism for automatically inserting the drawer using the elastic device 180 will be described in detail with reference to FIGS. 16 and 17. FIG. 16 is a side view showing the drawer 30 and the support assembly 100 at the initial position of the drawer 30, and FIG. 17 is a side view showing the drawer 30 and the support assembly 100 at the ready position of the drawer 30. For the convenience of description, the upper part of the drawer 30 is omitted.

As shown in FIGS. 16 and 17, the hanging member 181 of the elastic device 180 may be selectively connected to the second catching member 34 provided at the drawer 30. At the initial position of the drawer 30, the connection between the elastic device 180 and the drawer 30 may be released. As the drawer 30 moves to the ready position, the elastic device 180 and the drawer 30 may be connected with each other.

Specifically, the drawer 30 is automatically withdrawn forward by the operation of the electric driving unit 150. That is, the drawer 30 is withdrawn from the initial position to the ready position. When the drawer 30 is withdrawn, the second catching member 34 provided at the drawer 30 is connected to the hanging member 181 to move the hanging member 181 forward. The hanging member 181 moves forward together with the second catching member 34. As a result, the spring 187 may be elastically deformed. For example, the spring 187 may be extended. The drawer 30 is automatically inserted due to the elastic restoring force generated at this time.

More specifically, the drawer 30 may be automatically withdrawn while overcoming the elastic force of the elastic device 180 by the operation of the electric driving unit 150. When the force applied to the drawer 30 by the electric driving unit 150 is removed, the elastic restoring force generated by the elastic device 180 may be applied to the drawer 30. As a result, the hanging member 181 pulls the second catching member 34 of the drawer 30 due to the elastic restoring force. Consequently, the drawer 30 may be automatically inserted even if the user does not apply additional force in order to insert the drawer 30.

The transfer member 171 may be provided so as to push only the first catching member, whereas the hanging member 181 may be provided so as to be pulled by the second catching member 34 and to pull the second catching member 34. That is, the hanging member 181 is pulled by the second catching member 34 when the drawer 30 is withdrawn, whereas the hanging member 181 pulls the second catching member 34 when the drawer 30 is inserted. In other words, the hanging member 181 and the second catching member 34 may be connected with each other when the drawer 30 is inserted or withdrawn. When the drawer 30 is inserted, the drawer 30 may not be manually inserted but may be automatically inserted, whereby the user may very conveniently manipulate the drawer. Of course, automatic insertion of the drawer 30 may be performed from the ready position or the vicinity of the ready position to the initial position, rather than from the maximum withdrawal position to the initial position.

When the drawer 30 moves from the initial position to the ready position, the elastic device 180 is elastically deformed. When the drawer 30 moves from the ready position to the initial position, the elastic device 180 provides an elastic restoring force to the drawer 30. The elastic device 180 may be continuously elastically deformed and elastically restored from the initial position to the ready position. In this case, the elastic restoring force may be provided to the drawer 30 until the drawer 30 completely returns to the initial position.

When the drawer 30 starts to move from the initial position, however, a relatively large load may be applied to the electric driving unit 150 due to a static frictional force of the drawer 30. The drawer 30 must move while overcoming the static frictional force of the drawer 30 and the elastic force of the elastic device 180. As a result, larger load may be applied to the electric driving unit 150. For this reason, it is necessary to release the connection between the drawer 30 and the elastic device 180 at the initial position of the drawer 30. In addition, at the initial position, the drawer 30 may move forward by a predetermined distance such that the drawer 30 is connected with the elastic device 180.

FIG. 16 shows the initial position of the drawer 30. In the state shown, the connection between the drawer 30 and the elastic device 180 may be released. Specifically, the connection between the second catching member 34 of the drawer 30 and the hanging member 181 of the elastic device 180 may be released. At this time, the connection between the first catching member 33 of the drawer 30 and the transfer member 171 of the moving frame 170 may be maintained. This is because it is necessary for the forward movement of the transfer member 171 to be transferred to the first catching member 33 of the drawer 30 without delay.

When the door is opened, the electric driving unit 150 is operated, with the result that the transfer member 171 pushes the first catching member 33 forward. Consequently, the drawer 30 is withdrawn forward, and the second catching member 34 also moves forward. The second catching member 34 is connected to the hanging member 181 of the elastic device 180 while moving forward. Consequently, the hanging member 181 moves forward together with the second catching member 34. The spring 187 may be elastically deformed by the forward movement of the second catching member 34.

The position at which the second catching member 34 and the hanging member 181 are connected with each other may be preset to be between the initial position and the ready position of the second catching member 34. Here, the position at which the second catching member 34 and the hanging member 181 are connected with each other may be referred to as an elasticity start position. For example, on the assumption that the distance between the initial position and the ready position is 120 mm, the elasticity start position may be set to be 30 mm forward from the initial position. Until the drawer moves from the initial position to the elasticity start position, therefore, the resistance attributable to the spring 187 is not transferred to the electric driving unit 150. Subsequently, as the drawer moves further forward from the elasticity start position, resistance attributable to the spring 187 is further increased and transferred to the electric driving unit 150.

The elasticity start position may be set by changing the shape of the slots 183 and 184 formed in the housing 182 of the elastic device 180 and the connection relationship between the slots and the hanging member 181.

FIG. 17 is a side view showing the ready position of the drawer.

When the door is opened, the electric driving unit 150 moves the transfer member 171 forward. As the result of the forward movement of the transfer member 171, the first catching member 33 of the drawer 30 also moves forward. The electric driving unit 150 moves the transfer member 171 forward until the drawer 30 reaches the ready position.

As shown, at the ready position of the drawer 30, the elastic device applies force to the drawer 30 in a direction in which the drawer 30 is inserted. In this embodiment, therefore, control may be performed so as to maintain the operation of the electric driving unit 150 (for example, so as to drive the electric driving unit 150 in a clockwise direction) at the ready position. That is, the operation of the electric driving unit 150 may be maintained such that the electric driving unit 150 pushes the drawer 30 in a state in which the door 20 is open. In other words, the driving of the motor assembly 160 may be maintained while the door is kept open such that the moving frame 170 is maintained at the ready position. Of course, as will be described hereinafter, when it is sensed that the door 20 has been closed, the motor assembly 160 may be reversely driven (for example, may be driven in a counterclockwise direction) such that the moving frame returns to the initial position.

On the other hand, if the operation of the electric driving unit 150 is maintained at the ready position of the drawer 30, the electric driving unit 150 may be overloaded. This is because the connection member 163 does not move forward any longer, whereby the motor idles. Consequently, the electric driving unit 150 may move the drawer 30 to the ready position, may continue to operate for a predetermined time, and may be reversely driven to return the moving frame 170 to the initial position. That is, the transfer member 171 may be returned rearward.

The predetermined time may be determined in consideration of the time taken by the user to select a specific drawer and withdraw the selected drawer. For example, the electric driving unit 150 may move the moving frame 170 to the ready position, may stay at the ready position for about 10 seconds, and may then be reversely driven.

As previously described, automatic withdrawal of the drawer 30 by the electric driving unit 150 may be performed from the initial position to the ready position. Consequently, the withdrawal of the drawer from the ready position to the maximum withdrawal position may be manually performed. That is, the user may directly pull the drawer 30 in order to withdraw the drawer 30.

For example, in the case in which a plurality of drawers is provided vertically, the drawers may be automatically withdrawn to the ready position. In the state in which the drawers are at the ready position, the user may further withdraw one of the drawers before a predetermined time. After the predetermined time, the remaining drawers, which have not been withdrawn further, may be automatically inserted by the elastic device. In the case in which the further withdrawn drawer is a lower drawer, a space for access to the interior of the drawer may be increased due to the insertion of an upper drawer. Consequently, it is possible for the user to more easily access the storage space in the drawer. When the drawer 30 is withdrawn from the ready position to the maximum withdrawal position, the elastic device may be elastically deformed in a direction in which the withdrawal of the drawer is impeded. When the drawer 30 is manually withdrawn, therefore, the connection between the elastic device 180 and the drawer 30 may be released.

To this end, an inclined slot 185 may be formed in the slot formed in the housing 182 of the elastic device. Specifically, the inclined slot 185 may be formed at the front of one of the two slots 183 and 184, which are vertically arranged side by side, e.g. the slot 184. For the sake of convenience, the inclined slot 185 may be referred to as a first inclined slot 185 such that the inclined slot 185 is distinguished from another inclined slot, which will be described hereinafter.

The first inclined slot 185 is positioned at the front of the slot 184. When the user withdraws the drawer 30 slightly forward from the ready position, the hanging member 181 may be constrained in the first inclined slot 185. At this time, the hanging member 181 is rotated, whereby the coupling between the hanging member 181 and the second catching member 34 is released. The position at which the coupling between the hanging member 181 and the second catching member 34 is released may be referred to as an elasticity end position. In this embodiment, therefore, the elasticity start position may be in front of the initial position, and the elasticity end position may be in front of the ready position.

When the coupling between the hanging member 181 and the second catching member 34 is released, the user may easily manually withdraw the drawer to the maximum withdrawal position without impedance from the elastic device 180.

In this embodiment, the moving frame 170 may remain at the ready position in a state in which the door is open, as previously described. In a state in which the door is open, therefore, the user may withdraw the drawer, and may then insert the drawer 30 to the ready position. That is, the drawer may be reconnected to the elastic device.

At this time, the user may not insert the drawer 30 to the ready position. In this case, the elastic restoring force of the elastic device 180 is not transferred to the drawer 30, since the connection between the drawer 30 and the elastic device 180 is released.

In this embodiment, however, the distance between the elasticity end position and the ready position is relatively small, as previously described. When the door is closed, therefore, the door may push the drawer 30 rearward. That is, the drawer 30 may be pushed to restore the connection between the second catching member 34 and the hanging member 181. Since the moving frame 170 returns to the initial position when the door is closed, the force acting to withdraw the drawer 30 is removed. As a result, the hanging member 181 pulls the second catching member 34 due to the elastic restoring force of the elastic device 180 such that the drawer 30 automatically returns to the initial position.

Meanwhile, the electric driving unit may be controlled such that the transfer member 171 stays at the ready position for about 10 seconds, as previously described. The user may further withdraw a specific drawer in order to take goods out of the drawer and may then manually insert the specific drawer to the ready position. On the assumption that the time taken at this time is about 12 seconds, the specific drawer may be inserted to the ready position, and at the same time the specific drawer may be automatically returned to the initial position by the elastic restoring force.

As previously described, the elastic start position may be set to be identical to the initial position. In this case, however, impact may be applied to the drawer 30 when the drawer 30 returns to the initial position. Furthermore, in this case, the elastic restoring force of the spring may be reduced over time since the elastic variation of the spring is relatively increased (i.e. the elastic section of the spring is increased).

Consequently, the elastic start position may be set to be spaced apart forward from the initial position such that the initial return speed of the drawer is relatively high while the final return speed of the drawer is relatively low.

The initial return speed is related to the door closing speed. For example, if the door is very rapidly closed and the initial return speed of the drawer is lower than the door closing speed, the door may apply impact to the drawer. On the other hand, if the final return speed of the drawer is higher than the door closing speed, the drawer may apply great impact to the rail 120. For this reason, it may be necessary for the drawer to rapidly return at the early stage and to softly and slowly return at the late stage. That is, the drawer may be returned by inertia at the late stage.

Meanwhile, when the drawer 30 is withdrawn, the second catching member 34 is connected to the hanging member 181 at the elasticity start position. On the other hand, when the drawer 30 is inserted, the connection between the second catching member 34 and the hanging member 181 is released at the elasticity start position. These operations may be performed in the same manner as the operations at the elasticity end position. In the same manner, a second inclined slot 186 may be formed at the rear end of the upper slot 183 such that the hanging member 181 can be rotated at the elasticity start position. The hanging member 181 is rotated in the first inclined slot in the counterclockwise direction such that the connection between the hanging member 181 and the first inclined slot is released, whereas the hanging member 181 is rotated in the second inclined slot 186 in the clockwise direction such that the connection between the hanging member 181 and the second inclined slot is released.

According to the above embodiment, the withdrawal of the drawer from the initial position to the ready position may be automatic withdrawal of the drawer performed by the driving of the electric driving unit, and the insertion of the drawer from the ready position to the initial position may be automatic insertion of the drawer performed by the elastic device. The automatic withdrawal of the drawer may be performed using the driving force of the motor based on electrical energy, and the automatic insertion of the drawer may be performed using the elastic restoring force of the spring.

According to the above embodiment, the withdrawal of the drawer from the ready position to the maximum withdrawal position may be manual withdrawal of the drawer performed by the user, and the insertion of the drawer from the maximum withdrawal position to the ready position may be manual insertion of the drawer performed by the user.

According to the above embodiment, the spring of the elastic device may start to be elastically deformed at the elasticity start position, which is spaced apart forward from the initial position of the drawer by a predetermined distance, and the elastic deformation may be continuously performed from the elasticity start position to the ready position of the drawer.

According to the above embodiment, the spring may be continuously elastically deformed until the drawer reaches the elasticity end position, which is spaced apart forward from the ready position of the drawer by a predetermined distance. The withdrawal of the drawer from the ready position to the elasticity end position may be performed manually. The drawer may be manually withdrawn from the elasticity end position to the maximum withdrawal position of the drawer. At this time, the connection between the spring and the drawer may be released. When the user manually inserts the drawer, therefore, the drawer may be automatically inserted to the initial position by the elastic restoring force even if the drawer is inserted to the elasticity end position. That is, the drawer may be automatically inserted to the initial position by the elastic restoring force even if the drawer is not manually inserted to the ready position.

Figure 18:
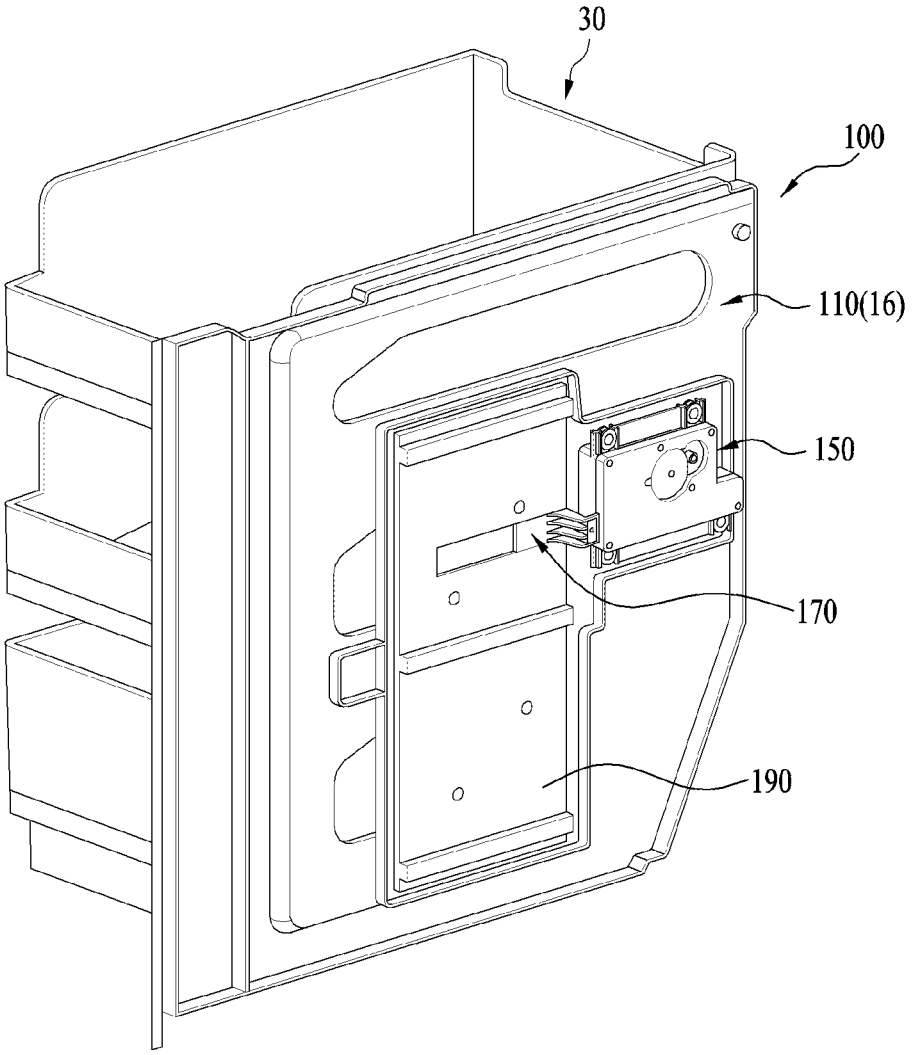
FIG. 18 is a view showing a support assembly or a sidewall and a plurality of drawers according to another embodiment of the present invention.
Figure 19:
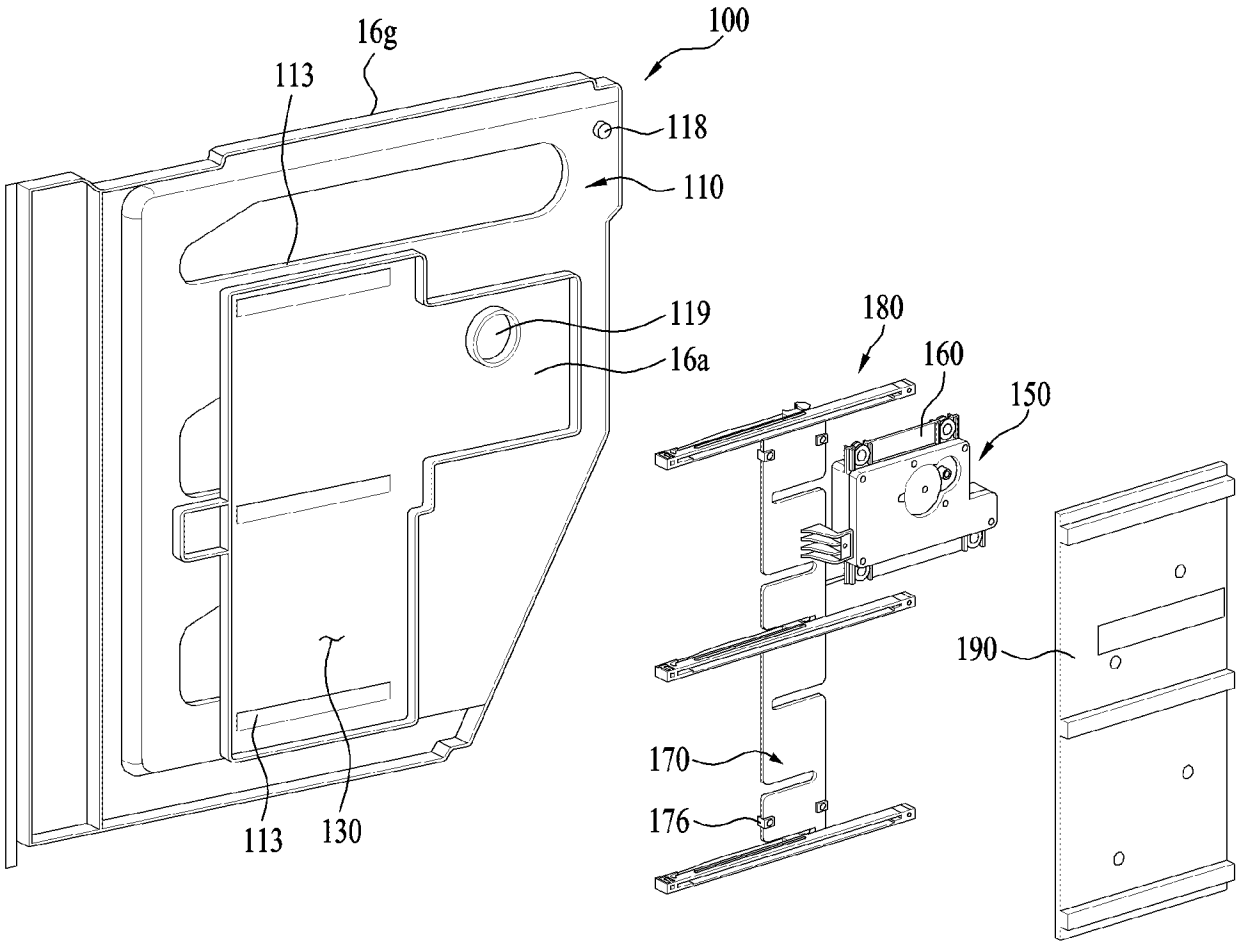
FIG. 19 is an exploded view of the support assembly shown in FIG. 18.

Hereinafter, another embodiment of the present invention will be described in detail with reference to FIGS. 18 and 19.

In this embodiment, a drawer 30 in a single storage compartment may be automatically withdrawn. For example, in a case in which storage compartments are formed on opposite sides of a partition wall 16, a drawer 30 in one of the storage compartments may be automatically withdrawn. In addition, in this embodiment, an electric driving unit 150 is mounted to the left sidewall or the right sidewall of the storage compartment.

Basically, this embodiment is identical to the previous embodiment with respect to the mechanism for automatically withdrawing the drawer 30. Of course, this embodiment is also identical to the previous embodiment with respect to the mechanism for automatically inserting the drawer 30. Consequently, this embodiment may be identical or similar to the previous embodiment with respect to the basic functions and connection relationships thereof, even though this embodiment may be different in structure or shape from the previous embodiment.

At least one drawer 30 may be movably supported by the sidewall of the storage compartment or the partition wall via a rail. In this embodiment, a support assembly 100 or a support cover 110 may be defined by the sidewall of the storage compartment or the partition wall. Alternatively, the support assembly 100 or the support cover 110 may be mounted to the sidewall of the storage compartment or the partition wall.

An electric driving unit 150 is mounted to the support cover 110, and a moving frame 170 is connected to the electric driving unit 150. Consequently, the moving frame 170 may be moved forward and rearward by the driving of the electric driving unit 150.

In this embodiment, the support cover 110 may be provided with a through part or slit 113, a recess 16*g*, a motor avoidance recess 119, and a plurality of fastening parts 118, in the same manner as in the previous embodiment. In addition, an elastic device 180 may be provided in order to automatically insert the drawer 30 using an elastic restoring force.

In this embodiment, a moving frame cover 190 may be further provided. The recess 16*g* may be formed in order to mount the motor assembly 160 and, in addition, to mount and move the moving frame 170. The recess 16*g* may be further extended to define a predetermined space 130.

Consequently, the moving frame cover 190 may be configured to cover a space in which the moving frame moves. That is, the moving frame cover 190 may be coupled to the support cover 110 to protect the moving frame.

In addition, the moving frame 170 may be provided with rollers 176. The rollers 176 may be formed at corners of the moving frame 170. The rollers 176 may slidably support the moving frame 170 relative to the moving frame cover 190. As a result, the moving frame 170 may be stably supported such that the moving frame 170 can move forward and rearward.

Figure 20:
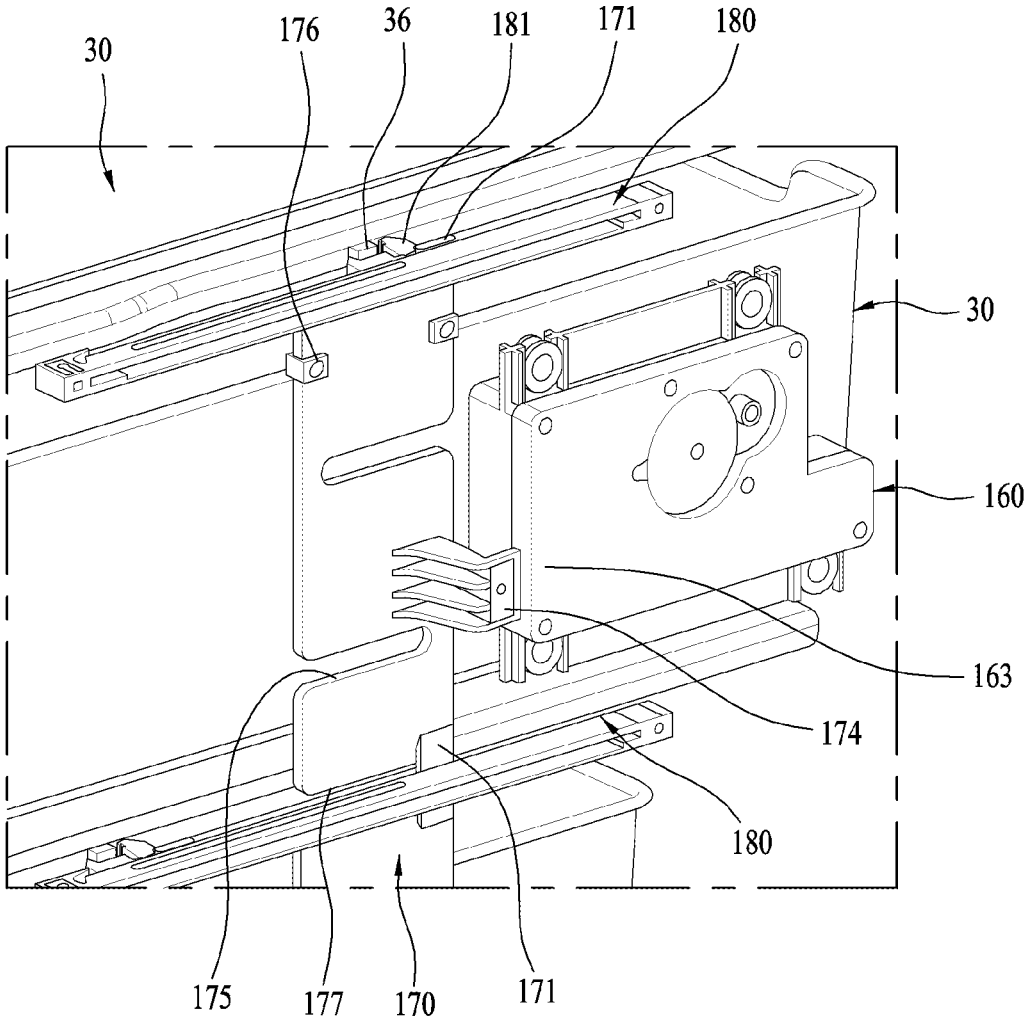
FIG. 20 is a view showing a connection between the moving frame and the drawer shown in FIG. 18.

Hereinafter, this embodiment will be described in more detail with reference to FIGS. 20 to 22.

In this embodiment, automatic withdrawal and automatic insertion of the drawer may be performed using a single transfer member. The basic mechanism and construction of this embodiment may be similar or identical to those of the previous embodiment. Therefore, features of this embodiment that differ from the previous embodiment will be described hereinafter in detail.

In this embodiment, a motor assembly 160 and a moving frame 170 may be provided, in the same manner as in the previous embodiment. The motor assembly 160 may be mounted to one sidewall of the storage compartment. The motor assembly 160 is connected to the moving frame 170. The motor assembly 160 is operated to move the moving frame 170 forward and rearward in the same manner as in the previous embodiment.

In addition, in this embodiment, an elastic device 180 may be provided, in the same manner as in the previous embodiment. The elastic device 180 may be mounted to one sidewall of the storage compartment. The elastic device 180 of this embodiment may be identical to the elastic device of the previous embodiment. In this embodiment, however, the elastic device 180 may be configured such that a hanging member 181 does not protrude downward or upward but protrudes laterally. In other words, the hanging member 181 may protrude toward the drawer 30. This means that the hanging member 181 of the elastic device 180 extends to the drawer through the slit 113.

The drawer 30 may be provided with a catching member 36. The catching member 36 is pushed to move the drawer 30 forward. The catching member 36 may be selectively connected to the hanging member 181 of the elastic device 180. As the result of the forward movement of the drawer 30, therefore, the catching member 36 moves the hanging member 181 forward. That is, the catching member 36 of this embodiment may correspond to the second catching member 34 of the previous embodiment in that the catching member 36 is selectively connected to the hanging member 181.

However, the catching member 36 is configured to be moved forward by a transfer member 171 provided at the moving frame 170. That is, the catching member 36 of this embodiment may correspond to the first catching member 33 of the previous embodiment. In this embodiment, therefore, the catching member 36 is connected to the elastic member 180 and to the moving frame 170.

Figure 21:
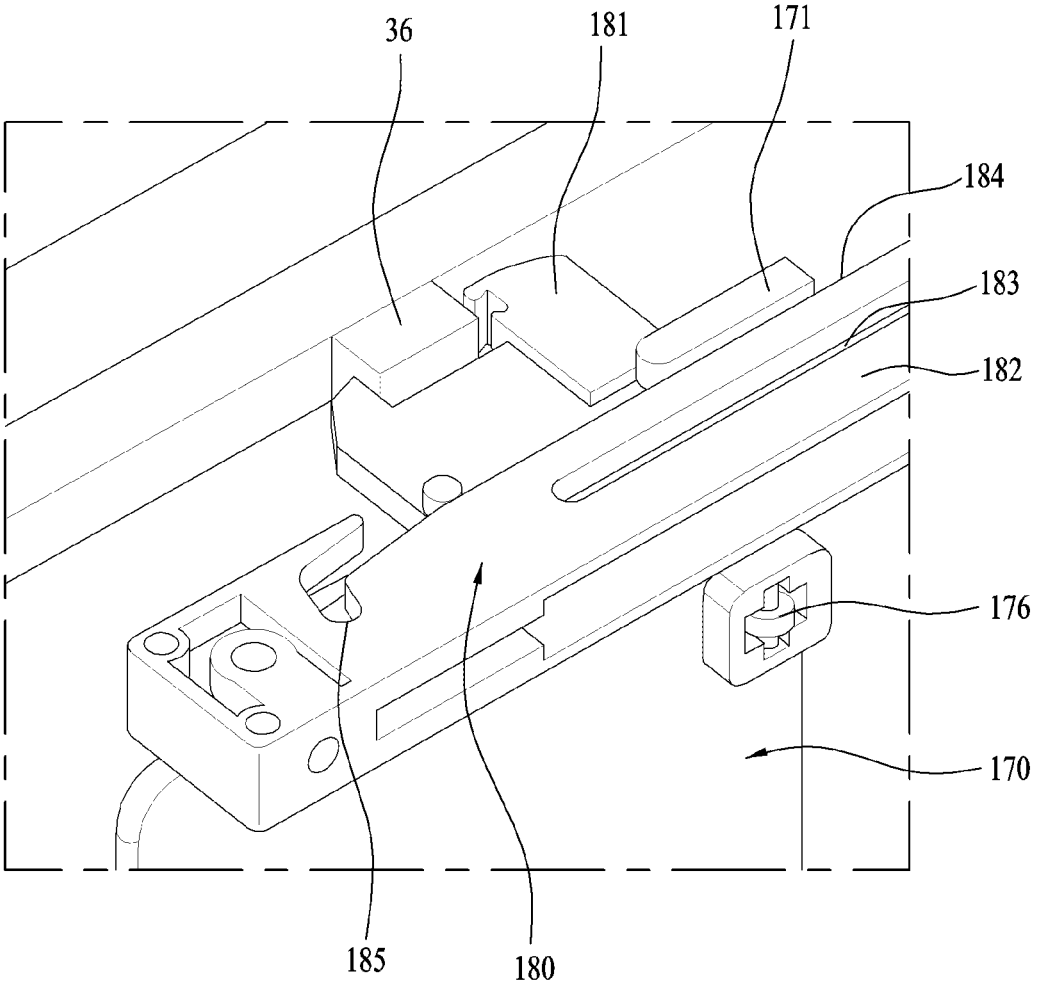
FIG. 21 is an enlarged view showing a connection between a hanging member and the drawer shown in FIG. 20.

Specifically, as shown in FIG. 21, the transfer member 171, which is provided at the moving frame 170, may be configured to push the hanging member 181 of the elastic device 180. That is, the transfer member 171 pushes the hanging member, which is connected to the catching member 36, with the result that the transfer member 171 pushes the catching member 36. In other words, the transfer member 171 may be configured to push the hanging member 181 at one side of the rear of the hanging member 181, which protrudes toward the drawer.

For example, in FIG. 21, a state in which the drawer 30 is inserted to the ready position is shown. That is, at the initial position, the transfer member 171 may simultaneously push the hanging member 181 of the elastic device 180 and the catching member 36 of the drawer to automatically withdraw the drawer to the ready position.

Figure 22:
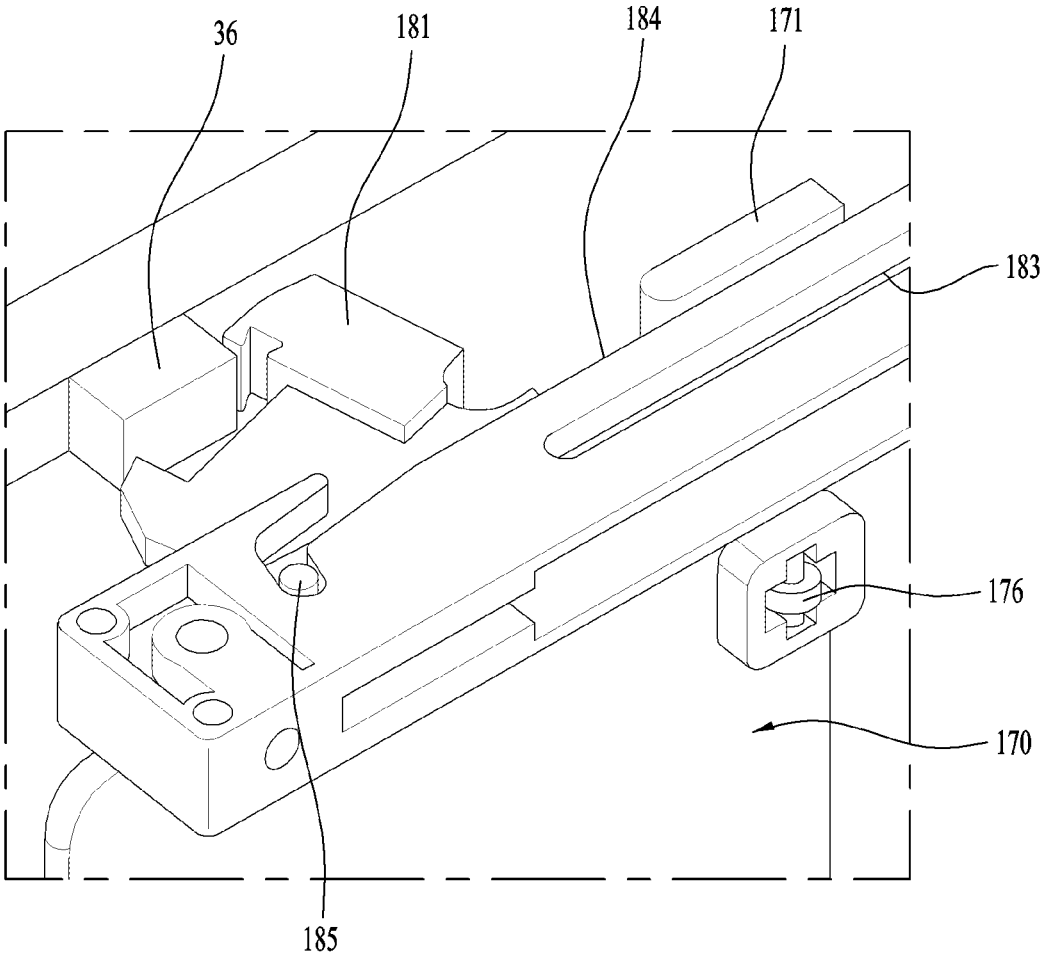
FIG. 22 is an enlarged view showing the hanging member and the drawer shown in FIG. 23 in a disconnected state.
Figure 23:
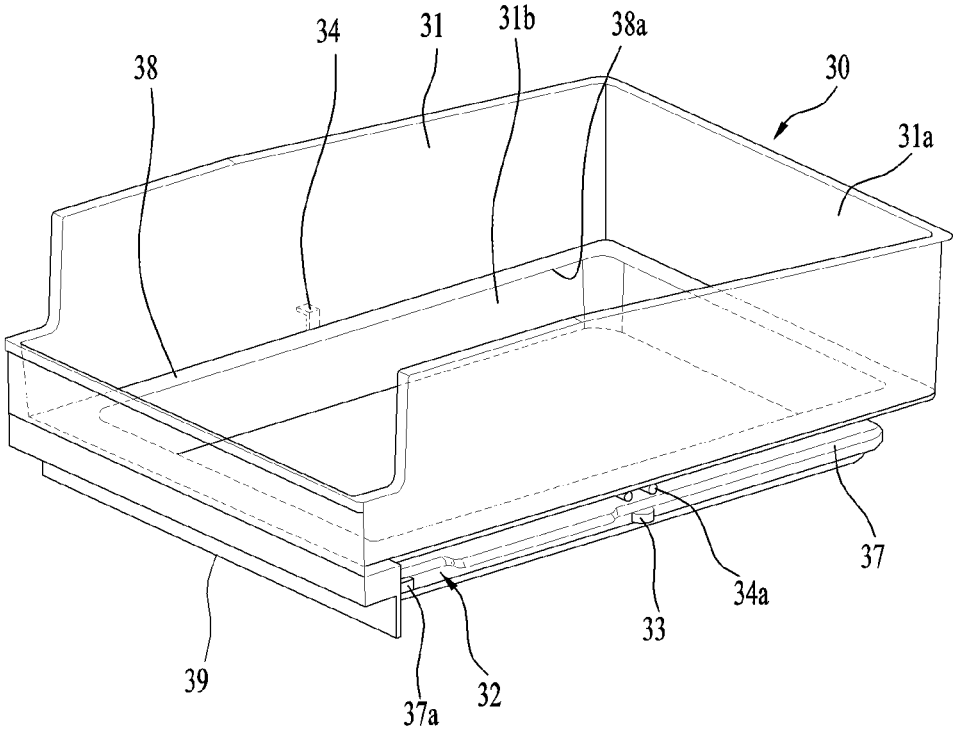
FIG. 23 is a view showing a drawer that is applicable to an embodiment of the present invention.

For example, in FIG. 22, a state in which the drawer 30 is manually withdrawn forward from the ready position is shown. When the user manually withdraws the drawer 30, the catching member 36 of the drawer 30 moves the hanging member 181 forward. As a result, the connection between the hanging member 181 and the transfer member 171 is released. In addition, as the drawer is withdrawn forward from the ready position by a predetermined distance, the connection between the catching member 36 and the hanging member 181 is released. That is, as the hanging member 181 enters the inclined slot 185, the connection between the catching member 36 and the hanging member 181 is released. As a result, the connection between the elastic device 180 and the drawer 30 is released. Consequently, it is possible for the user to easily manually withdraw the drawer 30. Of course, even in this embodiment, the ready position may be set to correspond to the position at which the connection between the elastic device 180 and the drawer 30 is released.

In this embodiment, the moving frame 170 may be provided with a connection member coupling part 174, which is coupled to a connection member. In addition, the moving frame 170 may be provided with rollers 176 for allowing the moving frame 170 to stably move forward and rearward.

Two rollers 176 may be formed at the upper end of the moving frame, and two rollers 176 may be formed at the lower end of the moving frame. Consequently, the moving frame may stably move in a state in which the moving frame is supported by four support points. Of course, the rollers 176 may be provided on one sidewall of the storage compartment such that the rollers 176 can be rolled.

The moving frame 170 may be provided between the elastic device 180 and the drawer 30 such that the moving frame 170 can move forward and rearward. In particular, the transfer member 171 of the moving frame 170 may be provided between the catching member 36 of the drawer and the elastic device 180 such that the transfer member 171 can move forward and rearward.

The moving frame 170 may be formed in the shape of a plate. In order to reduce the weight of the moving frame 170, a plurality of slits 175 may be formed in the moving frame 170. In a case in which the moving frame 170 is configured to move three vertically arranged drawers, three transfer members 171 may be provided. At this time, two of the transfer members 171 may be provided at the upper end and the lower end of the moving frame. The middle transfer member 171 may be formed through one of the slits 175. Specifically, the middle transfer member 171 may be formed through the middle slit 177. That is, the portion of the moving frame 170 in which the slits are not formed excluding the slit 177 may be the middle transfer member. The middle transfer member 171 may be the vertically middle portion of the moving frame 170 for interconnecting the upper and lower parts of the moving frame 170.

Meanwhile, even in this embodiment, it is necessary to minimize the reduction of the inner space of the storage compartment due to the electric driving unit 150. To this end, the electric driving unit 150 may be positioned at the sidewall of the storage compartment or the partition wall. In addition, the electric driving unit 150 may be positioned between the rails. This is because the rails may protrude toward the storage compartment and the drawer may be coupled to the protruding rails. A predetermined space may be defined between the upper rail and the lower rail due to the protruding structure of the rails, and the electric driving unit 150 may be mounted in the space.

Hereinafter, an embodiment of a drawer configured to be easily separated from the refrigerator such that the drawer can be conveniently used will be described in detail with reference to FIGS. 23 to 26. The drawer that can be automatically withdrawn and automatically inserted as described above may be embodied based on the drawer according to this embodiment. That is, a drawer that can be used independently of the previous embodiments and can be applied to the previous embodiments will be described in detail. The drawer may equally apply to a general drawer that is manually withdrawn and manually inserted.

The drawer 30 may include a basket 31 and a drawer frame 32. The basket 31 may be configured to receive goods. The drawer frame 32 may be configured to support the basket 31. Specifically, the drawer frame 32 may include a basket location part 38 and rail coupling parts 37 coupled to rails 120.

The basket 31 is located in the basket location part 38 such that the basket 31 is coupled to the drawer frame 32. In particular, the basket 31 may be moved vertically downward in the basket location part 38 such that the basket 31 is coupled to the drawer frame 32. On the other hand, the basket 31 may be moved vertically upward in the basket location part 38 such that the basket 31 is separated from the drawer frame 32. Consequently, the basket 31 may be very easily coupled to and separated from the drawer frame 32.

The drawer frame 32 may be provided at the middle part thereof with an opening 38*a*. The basket location part 38 may be formed around the opening 38*a*.

The basket 31 may include an upper basket 31*a* and a lower basket 31*b*. The lower basket 31*b* is inserted through the opening 38*a*, and the upper basket 31*a* is located in the basket location part 38. The upper basket 31*a* and the lower basket 31*b* may be integrally formed.

The rail coupling parts 37 may be provided at the left and right sides of the drawer frame 32 such that the rail coupling parts 37 extend forward and rearward. The rail coupling parts 37 and the rails may not be visible.

To this end, the horizontal width of the upper basket may be greater than the horizontal width of the lower basket such that the upper basket can cover the rail coupling parts 37 when viewed from above. In addition, the drawer frame 32 may include a drawer decoration part 39. The drawer decoration part 39 may be provided at the front of the drawer frame 32. In particular, the drawer decoration part 39 may be provided at the lower part of the front of the basket 31 such that the drawer decoration part 39 extends leftward and rightward. That is, the drawer decoration part 39 may be provided at the front of the drawer 30 in order to cover the rail coupling parts 37.

Meanwhile, the catching member 33 may be formed at the drawer frame 32. The drawer may be commonly used in the left freezing compartment and the right freezing compartment. Catching members 33 may be formed at the left and right sides of the drawer frame 32. In a case in which the drawer 30 is disposed in the right freezing compartment, as previously described, only the left catching member 33 may be used.

The drawer frame 32 may be provided with a catching member mounting part 34*a*, to which a catching member 34, configured to be coupled to the elastic device, is mounted. In the same manner, catching member mounting parts 34*a* may be formed at the left and right sides of the drawer.

The catching member 34, which is configured to be coupled to the elastic device, is provided to automatically insert the drawer. If it is not necessary to automatically insert the drawer, therefore, the catching member 34 may be omitted. Consequently, the catching member 34 may be separably provided at the drawer frame 32 even though the catching member 33 is integrally formed at the drawer frame 32.

Figure 24:
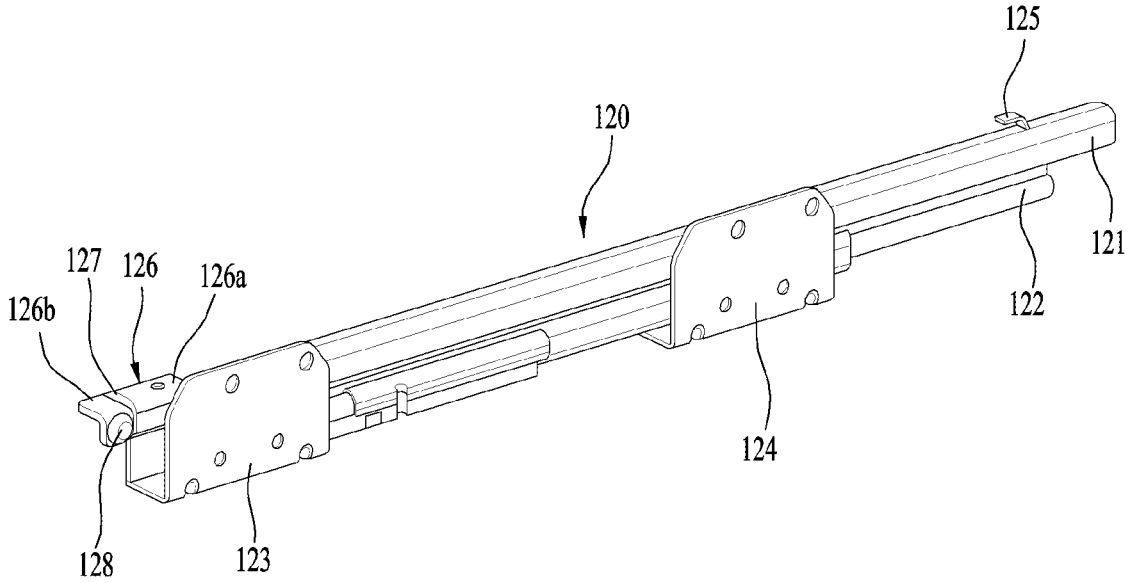
FIG. 24 is a view showing a rail that is applicable to an embodiment of the present invention.

Hereinafter, a rail 120 will be described in detail with reference to FIG. 24.

The rail 120 is configured to support the drawer 30 such that the drawer 30 can move forward and rearward. Consequently, the rail 120 may include a moving rail 121, configured to move forward and rearward together with the drawer 30. In addition, the rail coupling part 37 may be coupled to the moving rail 121.

Specifically, the rail coupling part 37 may be formed in the sectional shape of a channel such that the rail coupling part 37 can be located while surrounding the moving rail 121. That is, the rail coupling part 37 may be coupled to the moving rail 121 in a state in which the rail coupling part 37 is located on the moving rail 121.

A catching part 125 may be formed at the rear end of the moving rail 121. The catching part 125 may be configured such that the rear end of the rail coupling part 37 is inserted into the catching part 125. When the rail coupling part 37 is inserted into the catching part 125, therefore, the rearward movement and the upward movement of the rail coupling part 37 may be limited at the rear end of the rail coupling part 37.

An elastic protrusion 128 may be formed at the front end of the moving rail 121. The rail coupling part 37 may be provided at the front end thereof with a mounting hole 37*a*, into which the elastic protrusion 128 is inserted.

The moving rail 121 may be provided with an elastic protrusion bracket 126, which is coupled to the moving rail 121 in order to form the elastic protrusion 128. A mounting part 126*a* may be provided at one side of the elastic protrusion bracket 126, and an elastic protrusion support part 126*b* may be provided at the other side of the elastic protrusion bracket 126. Consequently, the elastic protrusion bracket 126 may be coupled to the moving rail 121 through the mounting part 126*a*.

A cutout part 127 may be formed between the elastic protrusion support part 126*b* and the mounting part 126*a*. The elastic protrusion 128 may be bent from the elastic protrusion support part 126*b*. Consequently, the elastic protrusion 128 may be elastically deformed through the cutout part 127 with respect to the elastic protrusion support part 126*b*.

Specifically, the elastic protrusion support part 126*b* may be formed horizontally, and the elastic protrusion 128 may be bent vertically downward from the elastic protrusion support part 126*b*. Consequently, the elastic protrusion 128 may be elastically deformed in a direction in which the angle between the elastic protrusion 128 and the elastic protrusion support part 126*b* is decreased. That is, the elastic protrusion 128 may be elastically deformed toward the left and right middle parts of the drawer.

Meanwhile, the rail 120 may include a fixed rail 122. The fixed rail 122 is disposed under the moving rail 121 to support the moving rail 121 such that the moving rail 121 can slide.

The rail 120 may be fixed to the sidewall of the storage compartment or the support cover 110 via rail brackets 123 and 124. The rail brackets may include a front rail bracket 123 and a rear rail bracket 124. That is, at least two support points may be formed at the front and rear of a single rail. The rail 120 is provided at each side of the drawer 30.

The front rail bracket 123 and the rear rail bracket 124 are spaced apart from each other by a predetermined distance in a forward and rearward direction. The transfer member 171 may be movably provided between the front rail bracket 123 and the rear rail bracket 124. That is, a section of the transfer member 171 between the initial position and the ready position is positioned between the front rail bracket 123 and the rear rail bracket 124. Consequently, interference between the transfer member 171 and the brackets 123 and 124 is prevented. This means that the slit 113 in the support cover 110 is formed between the front rail bracket and the rear rail bracket.

Figure 29:
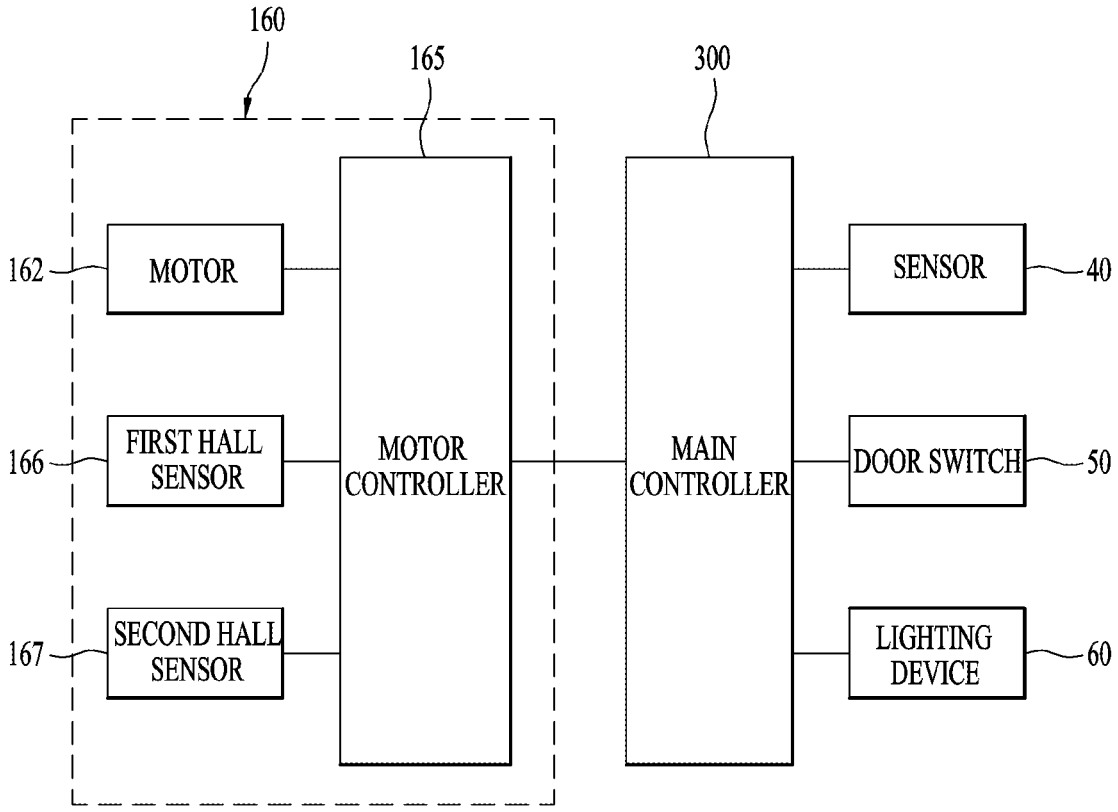
FIG. 29 is a block diagram showing a control construction that is applicable to an embodiment of the present invention.

Hereinafter, the coupling structure between the drawer 30 and the rail 120 will be described in more detail with reference to FIGS. 25 and 29. FIG. 26 is an enlarged view of part "B" shown in FIG. 25 after the drawer 30 is coupled to the rail 120.

Figure 25:
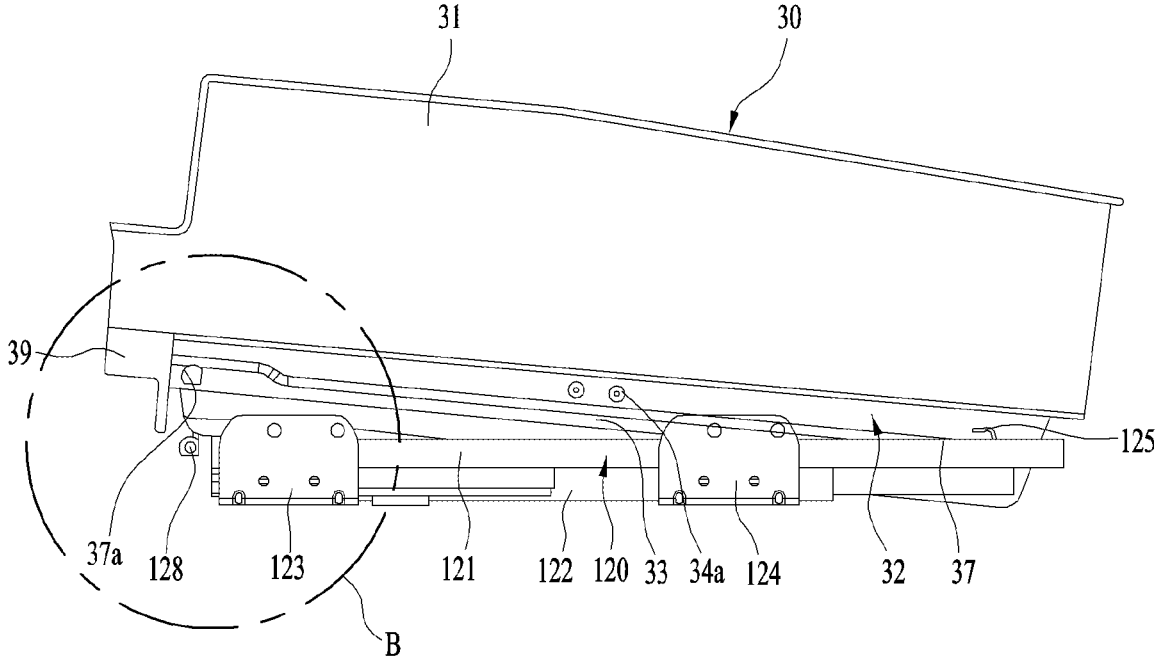
FIG. 25 is a view showing a state in which the drawer shown in FIG. 23 and the rail shown in FIG. 24 are coupled to each other.
Figure 26:
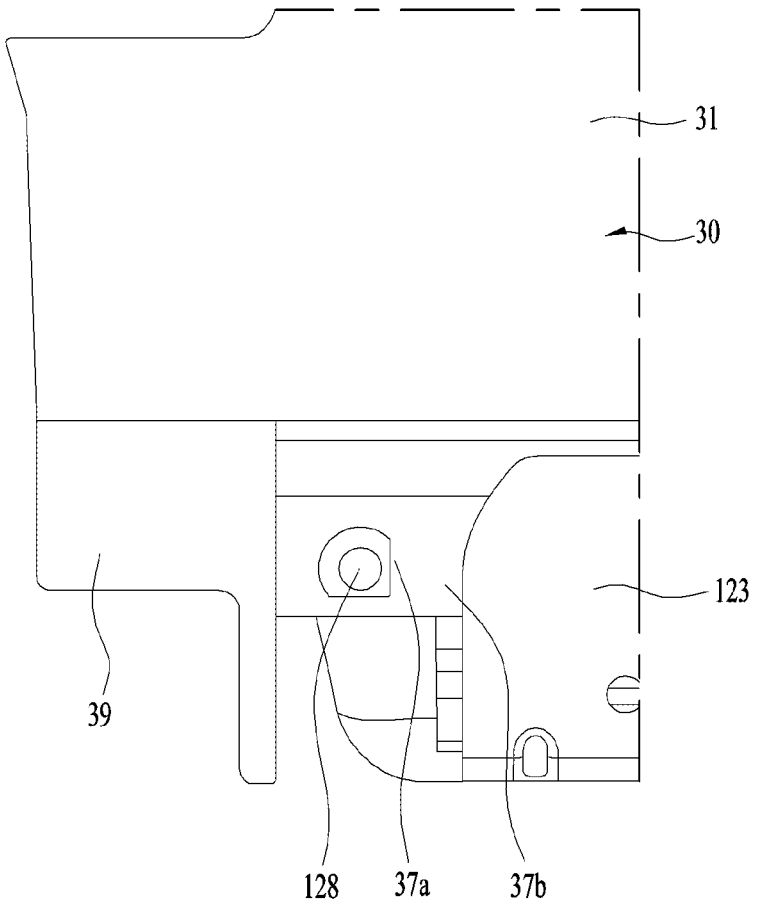
FIG. 26 is an enlarged view of part "B" shown in FIG. 25 after the drawer and the rail are coupled to each other.

In order to couple the drawer frame 32 to the rail 120, as shown in FIG. 25, the user may move the drawer frame 32 rearward in a state in which the front of the drawer is higher than the rear of the drawer. That is, the user may move the drawer rearward in a state in which the drawer is inclined rearward. At this time, the rear end of the rail coupling part 37 is inserted and caught into the catching part 125, which is provided at the rail.

As shown in FIGS. 11 and 14, the rail coupling part 37 may be mounted on the rail 120, particularly the moving rail 121, while surrounding the moving rail 121. When the rail coupling part 37 may be mounted on the moving rail 121, therefore, the leftward and rightward movement of the drawer is limited.

Subsequently, in a state shown in FIG. 25, the user may move the front of the drawer frame 32 downward. At this time, the elastic protrusion 128 is elastically deformed toward the left and right middle parts of the drawer. When the rail coupling part 37 is completely mounted on the moving rail 121, the elastic protrusion 128 is elastically restored and is then inserted into the mounting hole 37*a*. The mounting hole 37*a* may be formed in a side flange 37*b* configured to cover the outside surface of the moving rail. Consequently, the elastic protrusion 128 may be fixed in the mounting hole 37*a*. As a result, the drawer frame 32 may be fixed to the moving rail 121 by the catching part 125 and the elastic protrusion 128.

Meanwhile, the drawer 30 may be separated from the rail 120 in the reverse order.

The user may lift the front of the drawer 30 upward while pushing the elastic protrusion 128 on each side of the drawer 30. At this time, the elastic protrusion 128 may escape from the mounting hole 37*a*, with the result that the rail coupling part 37 provided at the front of the drawer 30 may be separated from the rail 120. Subsequently, the user may lift the drawer 30 upward while pulling the drawer 30 forward. At this time, the rail coupling part 37 provided at the rear of the drawer 30 may be separated from the catching part 125 of the rail 120. Consequently, it is possible for the user to easily couple the drawer 30 to the rail 120 and, in addition, to easily separate the drawer 30 from the rail 120.

Meanwhile, in FIG. 25, the drawer 30 is positioned at the initial position. As shown, the catching member 33 and the catching member mounting part 34*a* are positioned between the front rail bracket 123 and the rear rail bracket 124 at the initial position of the drawer 30. In particular, the catching member 33 and the catching member mounting part 34*a* are positioned so as to be closer to the rear rail bracket 124.

When the drawer 30 moves to the ready position, the catching member 33 and the catching member mounting part 34*a* move forward, with the result that the catching member 33 and the catching member mounting part 34*a* may be closer to the front rail bracket 123. Consequently, the catching member 33 and the catching member mounting part 34*a* may always be positioned between the front rail bracket 123 and the rear rail bracket 124 within a section defined between the ready position and the initial position of the drawer 30.

Hereinafter, a sensor 40 for sensing a condition in which the electric driving unit 150 is operated will be described briefly. FIG. 2 shows an example of the sensor 40.

Specifically, the sensor 40 is configured to sense whether the door 20 is open. When the sensor 40 senses that the door 20 is open, the electric driving unit 150 is operated to move the drawer 30 from the initial position to the ready position. The electric driving unit 150 generates force for moving the drawer forward. That is, when the sensor 40 senses that the door 20 is open, the electric driving unit 150 may drive the drawer in one direction to withdraw the drawer forward.

The door 20 may be a swing type door configured to rotate about a vertical shaft. That is, on the assumption that the opening angle of the door 20 when the door 20 completely closes the food introduction port 17 is 0 degrees, the door 20 may be rotated such that the opening angle of the door 20 exceeds 90 degrees.

However, in a case in which the door 20 is even slightly separated from the food introduction port 17, the door 20 may be considered to be open. For example, when the tight contact between the door 20 and the food introduction port 17 is released, the door 20 may be considered to be open. More specifically, as shown in FIG. 2, when the tight contact between a gasket 22 provided at the rear of the door 20 and the cabinet 10 is released, the door 20 may be considered to be open. In this state, cool air may be lost. When the tight contact between the gasket 22 and the cabinet 10 is maintained, the door 20 may be considered to be closed.

In order to sense whether the door 20 is in tight contact with the cabinet 10, a door switch, which will be described hereinafter, may be provided. The door switch may be operably connected to a lighting device provided in the storage compartment. That is, upon determining that the tight contact between the door 20 and the cabinet 10 is released through the door switch, the lighting device may be controlled to be turned on. When it is determined through the door switch that the door 20 has come into tight contact with the cabinet 10 after the lighting device is turned on, the lighting device may be controlled to be turned off.

In general, the door switch may be configured to have a structure that can be mechanically switched based on the distance between the door and the cabinet. The distance is very small. The reason for this is that the distance necessary to distinguish between the maintenance and release of tight contact between the cabinet and the door is very small. Consequently, the door switch may sense whether the door is open or closed substantially irrespective of the opening angle of the door.

Meanwhile, the door switch may be configured so sense whether the door is open or closed based on the determination as to whether cool air leaks outside. On the other hand, the sensor 40 may be configured to sense whether the door is open or closed based on interference between the drawer and the door during the movement of the drawer and the door.

The door switch and the lighting device will be described hereinafter in detail.

In this embodiment, however, the opening of the door is based on the withdrawal of the drawer, as previously described. That is, when the user opens the door 20 in order to withdraw and use the drawer, the drawer may move to the ready position. Consequently, the opening angle of the door at which it is sensed that the door is open is an important factor to consider. That is, the opening angle of the door required in order to automatically withdraw the drawer or the opening angle of the door at which automatic withdrawal of the drawer starts may be an important factor to consider.

For example, when the user wishes to withdraw only goods received in the door storage region 21 provided at the rear of the door 20, the door may be opened by 40 to 50 degrees. In this case, the drawer may remain at the initial position. That is, the drawer may remain in a state of not being withdrawn. The reason for this is that it is not necessary to withdraw the drawer when the drawer is not used since cool air may leak from the drawer. In addition, it is not necessary to withdraw the drawer when the drawer is not used since the drawer may collide with the rear of the door 20.

For example, when the door is opened by 40 or 50 degrees, the door switch may determine that the door has been opened. That is, in the case in which a door switch for determining only whether the door is open or closed is provided, a condition for automatic withdrawal of the drawer may be satisfied after the door switch senses that the door is open. Consequently, it is possible to realize more effective and stable control logic based on the relationship between the door switch and the sensor 40, a description of which will follow. When the user wishes to withdraw and use the drawer, the user may know from experience that the door must be opened by 90 degrees or more. This is because when the opening angle of the door is less than 90 degrees, the drawer is caught by the door or the basket 25 provided at the rear of the door before the drawer is completely withdrawn. In order to completely withdraw the drawer without interference with the door, the door should typically be opened by 100 degrees or more.

Consequently, the opening angle of the door at which the drawer is automatically moved may be 80 degrees or more, preferably about 90 degrees. In some cases, the opening angle of the door at which the drawer is automatically moved may be equal to or greater than 90 degrees. It may be sensed that the door is open at the above-mentioned opening angle of the door in order to drive the electric driving unit. This is because it takes a predetermined time for the drawer to move to the ready position. That is, the opening angle of the door at which it is sensed that the door is open may be less than the opening angle of the door at which the interference between the drawer and the door is completely eliminated. Of course, the opening angle of the door at which it is sensed that the door is open and the drawer starts to move automatically may be set such that the door does not interfere with the drawer at the ready position.

Meanwhile, the opening angle of the door at which the drawer is automatically moved may be an angle at which the drawer does not interfere with the basket 25 provided at the rear surface of the door in a state in which the drawer is withdrawn to the ready position. As shown in FIG. 2, the basket 25 may protrude perpendicularly from the rear of the door. In a state in which the door is open by 90 degrees, therefore, the basket 25 may escape from the opening 17. This means that the drawer 30 does not interfere with the basket 25 until the drawer is withdrawn to the opening 17. Of course, in a state in which the drawer is further withdrawn in a state in which the door is open by 90 degrees, interference between the drawer 30 and the basket 25 may occur. In order to completely withdraw the drawer, therefore, it is necessary to increase the opening angle of the door, as previously described.

For this reason, the sensor 40 may be a sensor that is capable of precisely sensing a predetermined opening angle of the door that is required in order to withdraw the drawer. To this end, the sensor 40 may include a magnet 42 and a reed switch 41. Of course, the sensor may include only the reed switch 41, or the reed switch 41 may sense the predetermined opening angle of the door using the magnet 42. Other types of sensors or switches that are able to detect changes in the magnetic field may be used.

As the distance between the sensor, such as the reed switch 41, and the magnet 42 varies, the sensed magnetic field varies. For example, the intensity of the magnetic force applied to the reed switch 41 varies according to the opening angle of the door. The distance between the reed switch 41 and the magnet 42, i.e. the distance at which the contact of the reed switch 41 is changed, may be precisely predicted by changing the magnetic force of the magnet 42.

Figure 27:
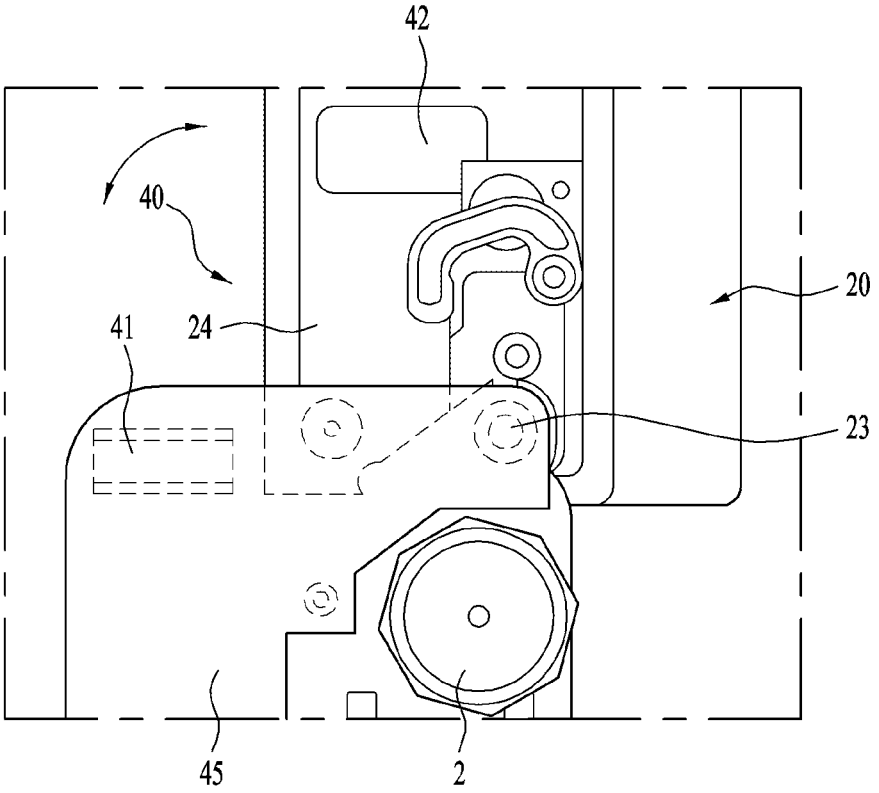
FIG. 27 is a view showing an embodiment of a sensor shown in FIG. 2 and a state in which the sensor is mounted.
Figure 28:
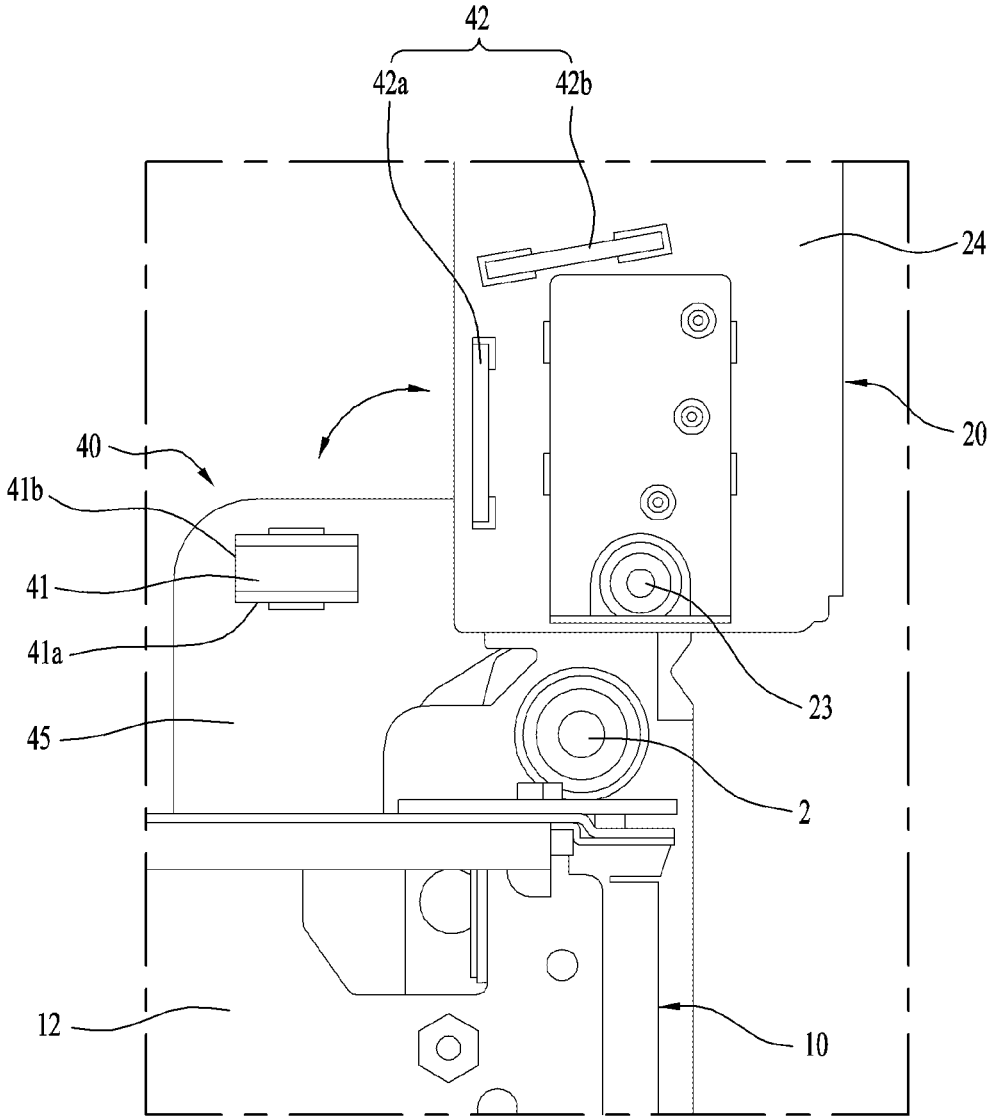
FIG. 28 is a view showing another embodiment of the sensor shown in FIG. 2 and a state in which the sensor is mounted.

Hereinafter, a sensor 40 that can be applied to the embodiments of the present invention will be described in detail with reference to FIGS. 27 and 28. FIGS. 27 and 28 are enlarged sectional views showing the lower part of the door.

In FIG. 27, which shows an embodiment of the sensor 40, the positional relationship between the reed switch 41 and the magnet 42 is shown. Specifically, in FIG. 27, the door 20 is opened by 90 degrees. That is, the door 20 is rotated open by 90 degrees with respect to a hinge cover 45 positioned in the vicinity of a leg 2 fixed to the ground. FIG. 27 is a view showing the lower part of the door when viewed upward from the ground.

The reed switch 41 may be provided at the hinge cover 45, and the magnet 42 may be provided at the lower part of the door 20. Specifically, the magnet 42 may be provided at a cap decoration part 24. Of course, the reed switch 41 may be provided at the door 20, and the magnet 42 may be provided at the hinge cover. However, a reed switch has a contact point and is configured to transmit a door opening signal or a door closing signal to the outside. Consequently, the reed switch may be positioned at a fixed member, such as the hinge cover 45.

Since the door 20 is rotated about a hinge shaft 23, i.e. a rotational shaft of the door, the vertical distance between the reed switch 41 and the magnet 42 is uniform regardless of the opening angle of the door 20. As the opening angle of the door 20 is changed, however, the horizontal distance between the reed switch 41 and the magnet 42 is changed. That is, the magnet 42 is rotated about the hinge shaft 23 at a consistent radius, and the horizontal distance between the reed switch 41 and the magnet 42 changes depending upon the rotational angle of the magnet.

In a state in which the door 20 is closed, the magnet 42 is positioned in the vicinity of the reed switch 41. In a state in which the door 20 is closed, therefore, the magnetic force of the magnet 42 may affect the reed switch 41. As the opening angle of the door is increased, the magnet 42 approaches the reed switch 41 and then moves away from the reed switch 41. That is, as the opening angle of the door is further increased, the magnetic force of the magnet 42 does not affect the reed switch 41. For example, when the opening angle of the door reaches 90 degrees, therefore, the contact point of the reed switch 41 may be changed. As the result of the change of the contact point of the reed switch 41, a door opening on signal, which is a drawer withdrawal condition, may be generated. That is, when the door is opened by a predetermined angle, it may be sensed that the door has been opened. In other words, in a section between a state in which the door 20 is closed and a state in which the opening angle of the door 20 is less than a predetermined angle (for example, 90 degrees), the magnetic force of the magnet 42 affects the reed switch 41, with the result that the contact point of the reed switch 41 is maintained. When the opening angle of the door 20 reaches the predetermined angle, the magnetic force of the magnet 42 does not affect the reed switch 41, with the result that the contact point of the reed switch 41 is changed.

In other words, when the opening angle of the door 20 reaches the predetermined angle, the reed switch has a critical point of effective magnetic intensity for contact point switching. That is, when the reed switch reaches the critical point, the contact point of the reed switch 41 is changed, which means that it is sensed that the door has been opened.

Consequently, it is possible to generate a door opening on signal, which is a drawer withdrawal condition, at a desired door opening angle (a predetermined door opening angle) by the provision of a sensor that is capable of sensing whether the door is open using the reed switch 41 and the magnet 42.

As previously described, when the door is opened and the opening angle of the door 20 reaches the predetermined degrees, the magnetic force of the magnet 42 does not affect the reed switch 41. That is, the reed switch escapes from the critical point. This means that when the door starts to be closed, in a state in which the door is open at an angle greater than the predetermined angle, and then the opening angle of the door reaches the predetermined angle, the magnetic force of the magnet 42 affects the reed switch 41. Consequently, the door opening angle, at which it is sensed that the door is open, and the door closing angle, at which it is sensed that the door is closed, may be set to be substantially equal. In addition, it is possible for a single sensor 40 to sense whether the door is open or closed based on substantially the same angle.

In other words, it is possible for the sensor 40 to sense whether the door is open or whether the door is closed based on the same angle. For example, after it is sensed that the door is open at a particular angle, the subsequent sensing at the same angle may be sensing that the door is closed. In addition, after it is sensed that the door is closed at a particular angle, the subsequent sensing at the same angle may be sensing that the door is open. That is, it is possible to sense whether the door is open or closed using a single sensor 40. Alternatively, a sensor for sensing whether the door is open and a sensor for sensing whether the door is closed may be separately provided in place of a single sensor. In this case, the sensors may be of the same type. This is because it is necessary to eliminate the interference between the door and the drawer when the door is closed as well as when the door is opened, as previously described. That is, as will be described hereinafter, it is necessary to automatically insert the drawer before the door interferes with the drawer even when the drawer is automatically inserted.

In a case in which a single magnet 42 is used, as shown in FIG. 27, however, there may be tolerance in the door opening angle preset for individual products. For example, in a case in which a single magnet 42 and a single reed switch 41 are mounted in a state in which a door opening angle is set to 90 degrees, the door opening angle for individual products may have tolerance. That is, it may be sensed that the door is open when the door opening angle is 85 degrees for some products, it may be sensed that the door is open when the door opening angle is 90 degrees for some products, and it may be sensed that the door is open when the door opening angle is 95 degrees for some products. As a result, the door opening angle for individual products may vary. This variation in the door opening angle may result from variation in magnetic force of the magnet 42, variation in mounting of the magnet 42 and the reed switch 41, etc.

In addition, in a case in which a single magnet 42 is used, it is not easy to change the door opening angle. This is because the door opening angle may be 90 degrees for some models while the door opening angle may be 85 degrees for some models.

Consequently, it is necessary to provide a sensor 40 that is capable of flexibly changing the door opening angle while reducing the variation in a predetermined door opening angle. In order to solve a problem caused by a sensor 40 including a single magnet 42, the present invention provides a sensor using a plurality of magnets.

Hereinafter, another embodiment of the sensor 40 will be described in detail with reference to FIG. 28. Basically, this embodiment is very similar to the previous embodiment. In this embodiment, however, a plurality of magnets 42 may be provided Even in this embodiment, the reed switch 41 may be provided at the hinge cover 45, and the magnets 42 may be provided at the cap decoration part 24 of the door 20. The cap decoration part 24 may be provided to define the lower surface of the door 20. Consequently, the magnets 42 are positioned in the door 20.

The reed switch 41 may be fixedly provided at the cabinet 10. For example, the reed switch 41 may be provided at the hinge cover 45, which protrudes forward from the cabinet 10. The door 20, particularly the cap decoration part 24, is rotated open and closed about the hinge shaft 23 while having a predetermined vertical gap at the upper part of the hinge cover 45.

As an example, the magnets 42 may include a horizontal magnet 42*a* and a vertical magnet 42*b*. The horizontal magnet 42*a* may be a magnet that is provided parallel to the front surface of the door 20 or the front surface of the cabinet 10, and the vertical magnet 42*b* may be a magnet that is substantially perpendicular to the horizontal magnet 42*a*. Of course, the vertical magnet 42*b* may be positioned at an obtuse angle relative to the horizontal magnet 42*a* in order to form an arc shape together with the horizontal magnet 42*a*.

In a state in which the door 20 is closed, the horizontal magnet 42*a* may be positioned so as to be parallel to one surface of the reed switch 41. The reed switch 41 may be formed in a quadrangular shape. The horizontal magnet 42*a* may be positioned so as to be parallel to the horizontal side 41*a* of the reed switch 41. The vertical magnet 42*b* may be positioned so as to be parallel to the vertical side 41*b* of the reed switch 41. The horizontal side of the reed switch 41 may be larger than the vertical side of the reed switch 41.

The horizontal magnet 42*a* and the vertical magnet 42*b* are bar-type magnets. As shown in the vertical sectional view of FIG. 28, the length of the horizontal magnet 42*a* and the vertical magnet 42*b* may be greater than the height of the horizontal magnet 42*a* and the vertical magnet 42*b*.

In a state in which the door 20 is closed, the horizontal magnet 42*a* may be positioned while extending leftward and rightward at the rear of the reed switch 41. The vertical magnet 42*b* may be positioned while extending forward and rearward at the left side or the right side of the reed switch 41. That is, the two magnets 42*a* and 42*b* may be positioned so as to surround the reed switch 41 while being spaced apart from each other. Consequently, the horizontal magnet 42*a* and the vertical magnet 42*b* may be provided in a state in which the horizontal magnet 42*a* and the vertical magnet 42*b* have different horizontal angles with respect to the reed switch 41.

In a state in which the door 20 is closed, therefore, the two magnets 42*a* and 42*b* simultaneously provide effective magnetic forces to the reed switch 41.

In addition, the distance between the horizontal magnet 42*a* and the hinge shaft 23 may be less than the distance between the vertical magnet 42*b* and the hinge shaft 23. That is, the turning radius of the horizontal magnet 42*a* is less than the turning radius of the vertical magnet 42*b*. In addition, the distance between the reed switch 41 and the hinge shaft 23 may be set to be approximate to the turning radius of the horizontal magnet 42*a*.

As the door 20 is opened, therefore, the horizontal magnet 42*a* is turned toward the reed switch 41, and the vertical magnet 42*b* is turned away from the reed switch 41. This means that the overlapping area between the horizontal magnet 42*a* and the reed switch 41 is greater than the overlapping area between the vertical magnet 42*b* and the reed switch 41.

Consequently, the magnetic force generated by the horizontal magnet 42*a* is basically sensed by the reed switch 41, and the magnetic force generated by the vertical magnet 42*b* auxiliarily affects the reed switch 41.

Since the intensity of the magnetic force is inversely proportional to the square of the distance, the intensity of the magnetic force is very rapidly reduced as the magnet 42*a* moves away from the reed switch 41. This means that the intensity of the magnetic force may be greatly changed even if the magnet moves a very short distance. For this reason, it is very difficult to precisely set a critical point at which the magnetic force has no effect, i.e. a door opening angle, at a position at which the magnetic force has an effect. In other words, in a case in which only one magnet, for example only the horizontal magnet 42*a*, is provided, it is difficult to set the critical point, since the intensity of the magnetic force is rapidly changed before and behind the critical point.

In this embodiment, the intensity of the magnetic force may be gently changed by the vertical magnet 42*b* until the critical point is reached, and the intensity of the magnetic force may be sharply changed by the vertical magnet 42*b* after the critical point is exceeded. That is, the vertical magnet 42*b* continuously provides an auxiliary magnetic force until the critical point is reached, whereby a rapid change in the magnetic force may be limited until the critical point is reached.

Meanwhile, in this embodiment, it is possible to easily set the critical point, i.e. the door opening angle, to about 90 degrees. That is, it is possible to easily adjust the door opening angle that is sensed by the reed switch 41.

Specifically, the horizontal magnet 42*a*, shown in FIG. 28, may be moved forward and rearward in a state in which the vertical magnet 42*b* is fixed. That is, the vertical magnet 42*b* may be a fixed magnet, and the horizontal magnet 42*a* may be a moving magnet.

When the horizontal magnet 42*a* is moved rearward, the distance between the horizontal magnet 42*a* and the hinge shaft 23 is decreased. In other words, the distance between the horizontal magnet 42*a* and the reed switch 41 is decreased in a state shown in FIG. 4 (i.e. in a state in which the door is open by 90 degrees). In order to prevent the application of the magnetic force of the horizontal magnet 42*a* to the reed switch 41, therefore, it is necessary to open the door 20 further. That is, the horizontal magnet 42*a* may be horizontally moved so as to be close to the hinge shaft 23 such that the door opening angle exceeds 90 degrees.

On the other hand, the horizontal magnet 42*a* may be moved forward. That is, the horizontal magnet 42*a* may be horizontally moved so as to be distant from the hinge shaft 23. In this case, the distance between the horizontal magnet 42*a* and the reed switch 41 may be increased. In a state in which the door opening angle is less than 90 degrees, the effect of the horizontal magnet 42*a* may be eliminated.

Eventually, it is possible to flexibly set the door opening angle using the fixed magnet 42*b*, which is an auxiliary magnet, and the moving magnet 42*a*, which is a main magnet.

Meanwhile, in the above embodiment of the sensor 40, the reed switch is provided under the magnet. Alternatively, the reed switch may be provided above the magnet. For example, the magnet may be provided at a door decoration part, which defines the upper surface of the door 20, and the reed switch may be provided so as to face the door decoration part. In any case, the vertical distance between the magnet and the reed switch may be fixed regardless of the door opening angle, and the horizontal distance between the magnet and the reed switch may be changed as the door opening angle is changed.

In this embodiment, it is possible to simply and precisely sense whether the door is open or closed at the predetermined door opening angle using the reed switch and the magnet, which are very simple. In addition, the door opening angle may be set differently for individual refrigerator models. In this case, the position of one of the magnets may be changed.

Meanwhile, as to the sensor 40, a hall sensor may be used in place of the reed switch.

The magnet may be provided above or under the hall sensor such that the magnet and the hall sensor are arranged vertically. For example, at the position at which the door is open by 90 degrees, the magnet may be positioned vertically above or below the hall sensor. When the door opening angle is increased to 90 degrees, therefore, the hall sensor recognizes the magnet and thus senses that the door is open.

For example, the magnet may always be positioned vertically above or under the hall sensor until the door is open by 90 degrees. That is, the magnet may be formed in an arc shape, or a plurality of magnets may be provided such that the hall sensor can always recognize the magnet(s) until the door is open by 90 degrees. When the door is open by 90 degrees, the magnet may escape from a region that is sensed by the hall sensor, with the result that the open state of the door may be sensed.

Hereinafter, control construction elements that can be applied to an embodiment of the present invention will be described in detail with reference to FIG. 29.

A refrigerator according to an embodiment of the present invention includes a main controller 300. The main controller 300 may control the basic operation of the refrigerator.

The refrigerator according to an embodiment of the present invention may further include a motor assembly 160. The motor assembly 160 may include a motor 162 and a motor controller 165. The motor 162 may be driven in forward and reverse directions. For example, the motor 162 may be driven in the forward direction (the clockwise direction) to move the transfer member 171 forward. On the other hand, the motor 162 may be driven in the reverse direction to move the transfer member 171 rearward. The electric driving unit, i.e. the motor, may be driven in the forward direction to generate force necessary to move the drawer forward. The force by which the drawer is moved forward may be released when the motor is driven in the reverse direction.

The direction in which the motor 162 is driven, the duty ratio applied to the motor 162, and the driving and stoppage of the motor 162 may be controlled by the motor controller 165.

The motor assembly 160 may include a connection member 163, which is configured to move forward and rearward as previously described. The maximum protruding length of the connection member 163 corresponds to the ready position of the transfer member, and the minimum protruding length of the connection member 163 corresponds to the initial position of the transfer member. Consequently, the connection member 163 moves between the maximum protruding length and the minimum protruding length.

Therefore, it is possible to determine whether the connection member 163 of the motor assembly 160 is at a position corresponding to the initial position of the drawer or at a position corresponding to the ready position of the drawer. That is, the motor assembly 160 may be provided with two hall sensors 166 and 167.

As shown in FIGS. 6 and 7, the motor assembly 160 may be provided with a magnet 168. The magnet 168 may be configured so as to move in the housing 161 when the connection member 163 moves. When the first hall sensor 166 recognizes the magnet 168, therefore, it is determined that the transfer member is at the initial position. On the other hand, when the second hall sensor 167 recognizes the magnet 168, it is determined that the transfer member is at the ready position.

It is possible to determine whether the motor assembly 160 is operating normally using the hall sensors 166 and 167 and the magnet 168, which will be described hereinafter in detail when describing the control method of the refrigerator.

When it is sensed that the door is open through the sensor 40, the motor controller 165 operates the motor 162. That is, the motor controller 165 drives the electric driving unit. Here, the sensor 40 may be a sensor for sensing that the door is open at a predetermined opening angle (for example, 90 degrees). That is, for example, when the sensor 40 senses that the door is open by 90 degrees, the motor controller 165 operates the motor 162 such that the drawer is withdrawn from the initial position to the ready position. Consequently, the motor controller 165 controls the driving of the electric driving unit to withdraw the drawer.

When the sensor 40 senses that the door is open, which is a drawer withdrawal condition, a door opening signal or a signal for driving the motor assembly 160 in the forward direction may be generated and transmitted to the motor controller 165 via the main controller 300. Of course, the door opening signal or the signal for driving the motor assembly 160 in the forward direction may be directly transmitted to the motor controller 165. Meanwhile, the refrigerator according to the embodiment of the present invention may further include a door switch 50. The door switch 50 may be an element that is generally used in refrigerators. When the door switch 50 senses that the door is open, a lighting device 60, configured to illuminate the storage compartment, may be operated. The door switch 50 may be provided separately from the sensor 40.

Hereinafter, a control method that can be applied to an embodiment of the present invention will be described in detail with reference to FIGS. 30 to 36.

Figure 30:
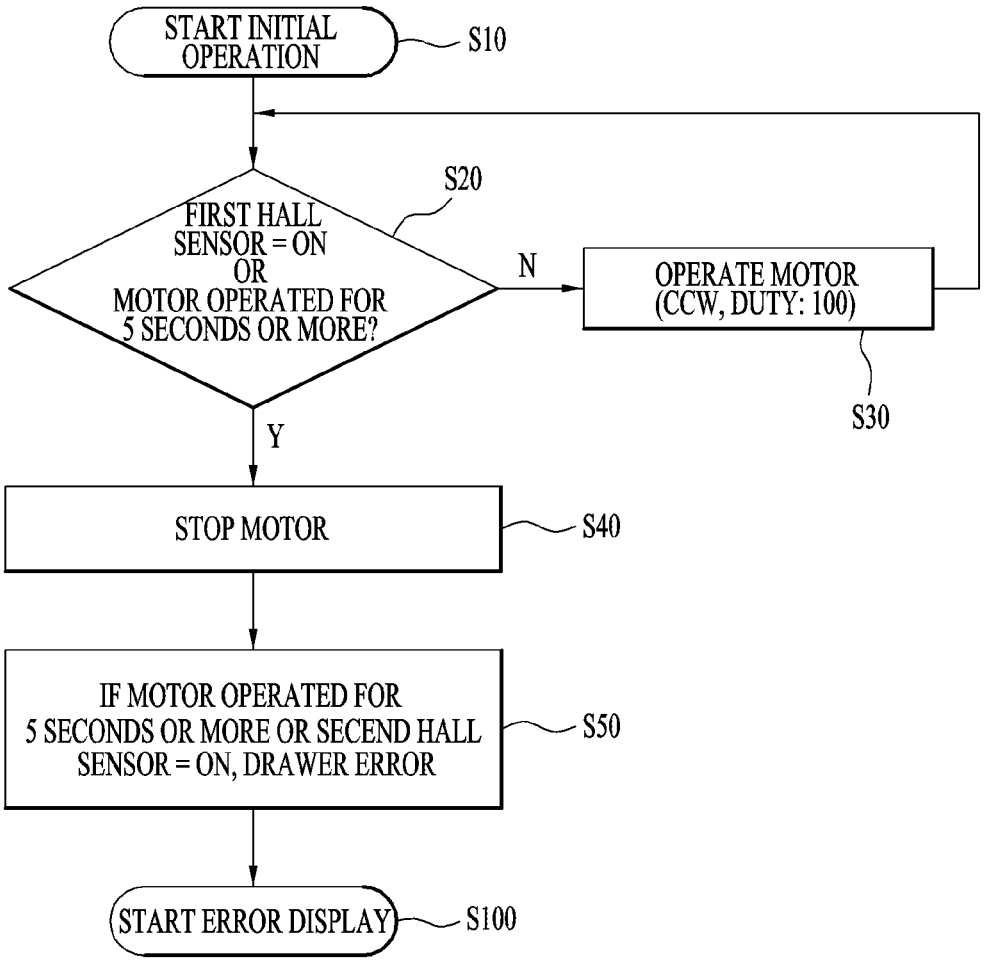
FIGS. 30 to 36 are flowcharts showing steps of a control method that is applicable to an embodiment of the present invention.

First, an initial step (S10) will be described in detail with reference to FIG. 30. The initial step may be a step at which the motor 162 is initially driven when the refrigerator is powered on. That is, the initial step may be a step at which the motor 162 is initially driven to move the transfer member to the initial position such that an electric drawer system is initialized.

When the initial step (S10) is started, therefore, the motor is operated (S30). That is, the motor is operated to return the transfer member 171 to the initial position. At this time, the motor may be driven, for example, in the counterclockwise direction or in the reverse direction. In the following description, the transfer member 171 moves rearward when the motor is driven in the counterclockwise direction, and the transfer member 171 moves forward when the motor is driven in the clockwise direction.

The operation of the motor may be controlled using a predetermined duty ratio. Upon determining through the first hall sensor 166 that the transfer member 171 has returned to the initial position, the operation of the motor is stopped. For example, when an ON signal is generated by the first hall sensor 166, the operation of the motor is stopped (S40).

In addition, the operation of the motor may be controlled to be stopped when the operation time of the motor exceeds a predetermined time. For example, the predetermined time may be 5 seconds. Here, the predetermined time may be set so as to be greater than the allowable maximum motor operation time in consideration of a margin. Consequently, the operation of the motor may be performed until an ON signal is generated by the first hall sensor 166 before the predetermined time is reached.

Consequently, when the operation time of the motor is equal to or greater than the predetermined time or when it is sensed that an ON signal has been generated by the second hall sensor 167 (S50) after the motor is stopped (S40), it may be determined that an error has occurred in the electric drawer system. When the error has occurred, therefore, a notification step (S100) may be performed. That is, a step of displaying the error may be performed.

The ON signal may be generated by the second hall sensor 167 at the ready position of the transfer member 171, rather than at the initial position of the transfer member 171. When the ON signal is generated by the second hall sensor 167 at the initial step (S10), therefore, it may be determined that an error has occurred in the entire electric drawer system including the hall sensors.

In addition, even when the motor is operated for a predetermined time or more, it may be determined that an error has occurred in the entire electric drawer system, as previously described. This is because when the transfer member returns to the initial position, the load of the drawer is not applied to the motor 162.

Figure 31:
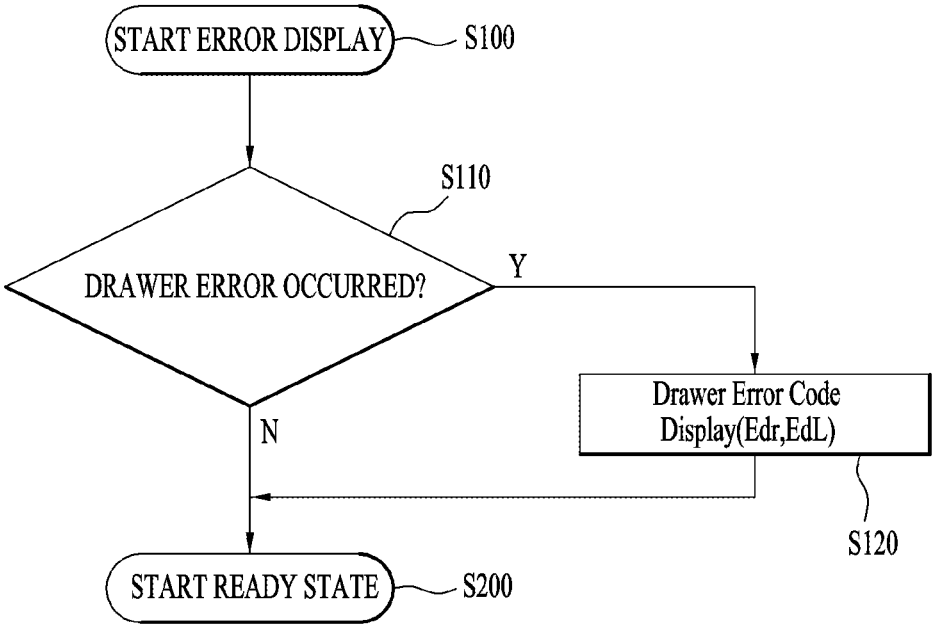

Meanwhile, when an error has occurred, the notification step (S100) may be performed, as shown in FIG. 31. At the notification step (S100), it is determined again whether the error has occurred (S110). At this time, the drawer in which the error has occurred may be determined. That is, in a case in which electric drawers are mounted in the left and right freezing compartments, it may be determined whether the error has occurred in the left drawer or the right drawer. In a case in which the error has occurred in the electric drawer, an error display step (S120) may be performed. At this time, an error code may be displayed on a display unit.

After the error is displayed or if it is determined that no error has occurred, the state of the refrigerator is switched to a ready state (S200). The ready state (S200) may be a state in which the driving of the motor is stopped.

Figure 32:
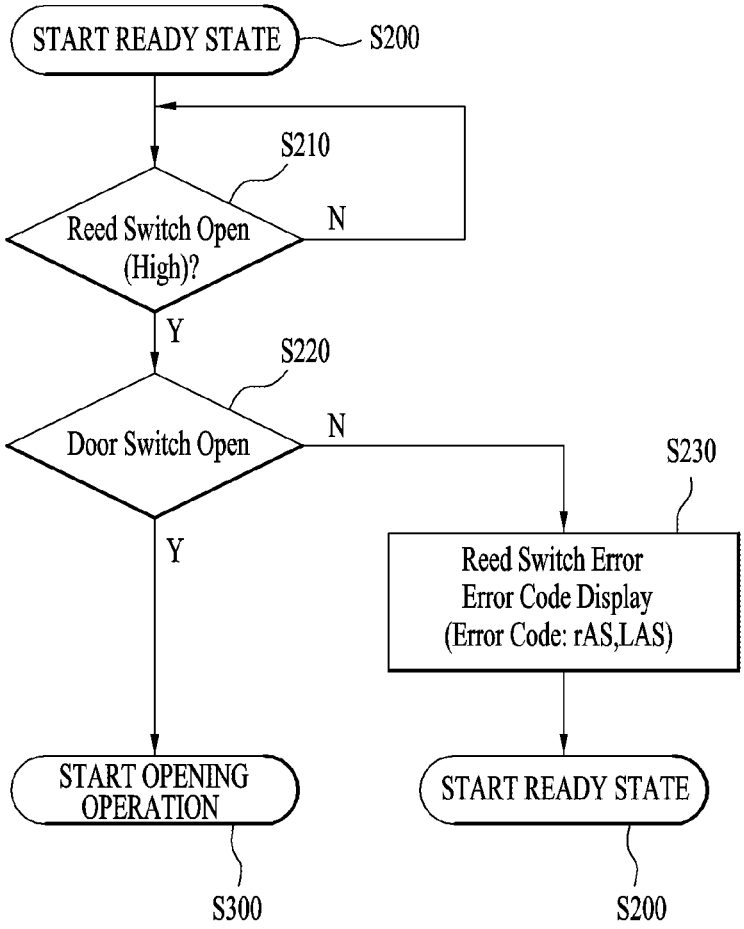
Figure 33:
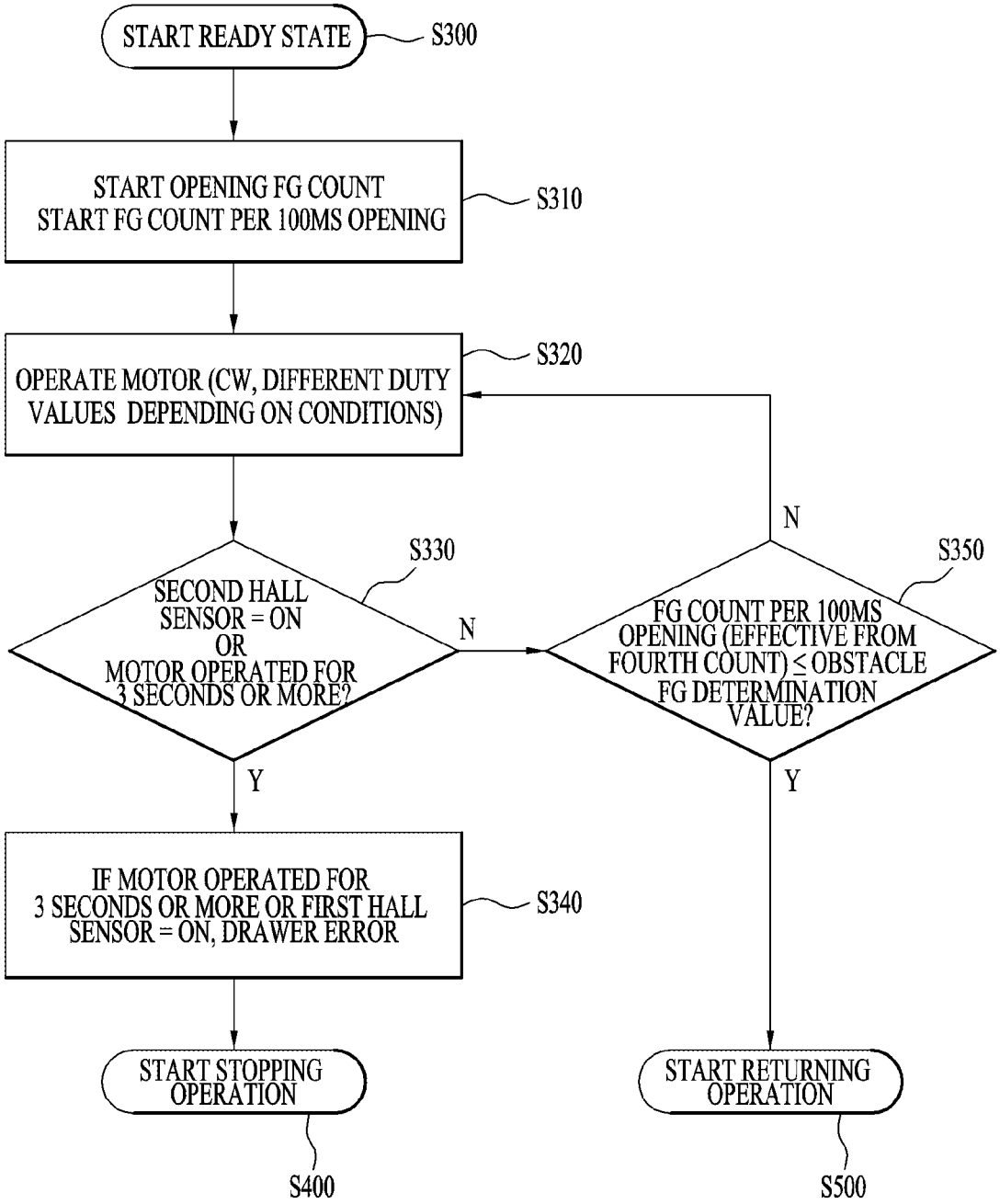

As shown in FIG. 32, determination steps (S210 and S220) of determining a condition for automatically withdrawing the drawer in the ready state (S200) may be performed. The condition for automatically withdrawing the drawer may be sensing whether the door is open through the sensor 40. Specifically, when the reed switch 41 senses that the door is open (S210), it may be determined that the above condition has been satisfied.

Consequently, the motor 162 may remain in the ready state (S200) until it is sensed that the door is open through the sensor 40.

Meanwhile, as previously described, sensing whether the door is open through the sensor 40 must be performed based on sensing whether the door is open through the door switch 50. When it is sensed that the door is open through the door switch 50, therefore, a withdrawal step (S300) may be performed.

When the sensor 40 senses that the door is open but the door switch 50 does not sense that the door is open, it is determined that an error has occurred in the sensor 40 (S230), and the error may be displayed on the display unit. Subsequently, the state of the refrigerator may be switched to the ready state (S200).

At the withdrawal step (S300), the motor 162 may be operated to push the drawer 30 forward. At the withdrawal step, therefore, a relatively high load is applied to the motor 162. In particular, in a case in which a large amount of goods is stored in the drawer 30, a higher load is applied to the motor 162. At the withdrawal step (S300), therefore, the motor may be controlled to generate high output based on the load. That is, control may be performed so as to increase the duty ratio as the load is increased.

Specifically, the withdrawal step (S300) may include a step (S310) of calculating a signal (frequency generator; FG), which is generated when the motor is rotated. FG may be calculated at predetermined time intervals, e.g. every 100 ms.

In addition, the withdrawal step (S300) may further include a motor withdrawal driving step (S320) of driving the motor in the clockwise direction while changing the duty ratio based on the calculated FG. That is, a plurality of load conditions may be set based on the calculated FG, and the motor may be driven using a predetermined duty ratio in each load condition.

For example, in a case in which the calculated FG is 0 to 50, the motor may be driven at a duty ratio of 180. In addition, in a case in which the calculated FG is 51 to 100, the motor may be driven at a duty ratio of 200. As the calculated FG is increased, the duty ratio may also be increased. For example, in a case in which the calculated FG is 251 or more, the motor may be driven at a duty ratio of 250.

In other words, in a case in which the calculated FG is greater, it is determined that the load is higher, with the result that the output of the motor is increased.

The motor withdrawal driving step (S320) may be performed until an ON signal is generated by the second hall sensor 167. In addition, the motor withdrawal driving step (S320) may be performed until a predetermined time is reached. For example, the predetermined time may be 3 seconds.

Meanwhile, an obstacle that disturbs the withdrawal of the drawer may arise while the motor withdrawal driving step (S320) is being performed. That is, a very heavy object may be placed in front of the drawer, or foreign matter may be introduced into the rail 120 such that the moving rail 121 cannot move. In this case, a high load may be applied to the motor if the motor is continuously driven in the clockwise direction. That is, the motor may be broken or damaged. When an obstacle is present, therefore, the motor withdrawal driving step (S320) may be stopped, and a returning step (S500) may be performed.

Of course, an obstacle determination step (S350) of determining whether an obstacle is present may be performed before the returning step (S500) is performed.

The obstacle determination step (S350) may be performed during the motor withdrawal driving step. The obstacle determination step (S350) may be performed when the FC calculation cycle reaches a predetermined number of times. For example, the obstacle determination step (S350) may be performed when a fourth FG calculation is performed. That is, the first three FG calculations may not be considered in the determination of the obstacle. The reason for this is that a relatively high load may be applied to the motor at the motor withdrawal driving step due to an initial static frictional force. Consequently, the obstacle determination step (S350) may be performed after execution a predetermined number of times. The obstacle determination step (S350) may be performed until the motor withdrawal driving step (S320) is finished.

In a case in which the calculated FG is greater than a predetermined obstacle FG, it is determined at the obstacle determination step (S350) that there is no obstacle, and the motor withdrawal driving step may be continuously performed. On the other hand, in a case in which the calculated FG is equal to or less than the predetermined obstacle FG, it is determined at the obstacle determination step (S350) that an obstacle is present. That is, it may be determined that an overload is generated in the motor due to an obstacle, whereby the motor is not driven normally. When it is determined that there is an obstacle, therefore, the driving of the motor is stopped, and the returning step (S500) is performed.

Meanwhile, when it is determined that there is no obstacle and the motor withdrawal driving step is finished, an error determination step (S340) may be performed. It may be determined whether a predetermined time, for example 3 seconds or more, elapses before the motor withdrawal driving step is finished. The predetermined time may be the allowable maximum time. In a case in which 3 seconds or more elapse, it may be determined that an error has occurred. In addition, in a case in which an ON signal is generated by the first hall sensor 166, it may be determined that an error has occurred. When the motor withdrawal driving step (S320) is finished, i.e. the withdrawal step (S300) is finished, a stopping step (S400) may be performed.

Figure 34:
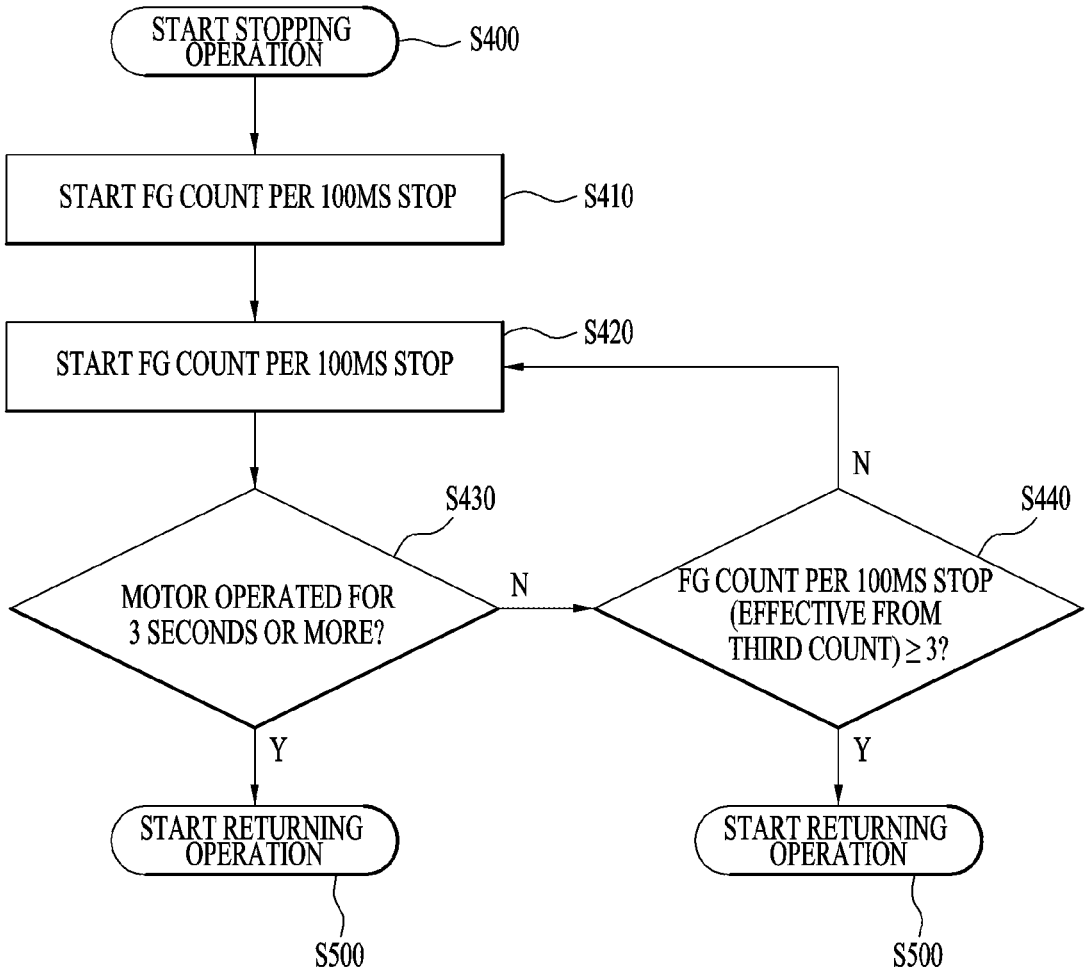

As shown in FIG. 34, the stopping step (S400) is not a step of stopping the driving of the motor but a step of stopping the withdrawal of the drawer. In other words, the motor withdrawal driving step (S320) is a step of moving the transfer member forward. When it is determined that the transfer member has moved to the ready position through the second hall sensor 167, the forward movement of the transfer member is stopped. That is, the stopping step (S400) is a step of stopping the forward movement of the transfer member.

As previously described, the motor is driven in the clockwise direction (i.e. the forward direction) at the withdrawal step (S300). In the same manner, the motor may remain driven in the clockwise direction even at the stopping step (S400). Since the drawer is not pushed at the stopping step (S400), however, the driving of the motor may be maintained at the minimum output.

At the stopping step (S400), the motor may be controlled to be driven (S420) at the minimum duty ratio that can be applied to the motor. That is, in the driving of the motor connected to the automatic withdrawal of the drawer, the motor may be controlled to be driven at the smallest duty ratio that can be applied to the motor. This is performed in order to prevent the drawer from being automatically inserted before the user manipulates the drawer due to the elastic force of the automatic closing unit (i.e. the elastic device) at the stopping step (S400).

Meanwhile, the stopping step (S400) may be performed for a predetermined time. For example, the stopping step may be performed for 10 seconds (S430). After the predetermined time, the returning step (S500) may be performed.

When the user further withdraws the drawer within the predetermined time, the connection between the elastic device and the drawer is released. The connection between the elastic device and the drawers that have not been further withdrawn is maintained. After the predetermined time, therefore, the drawers that have not been further withdrawn may be returned rearward by the elastic device. At this time, the return speed of the drawers is not faster than the return speed of the transfer member. The reason for this is that when the drawers are returned by the elastic device, the drawers follow the transfer member, which is returned.

The characteristics in which the drawers can be individually further withdrawn and automatically returned lead to convenience in using the drawers and reduced loss of cool air. The reason for this is that the opening region of the drawer that is used may be further extended by these characteristics. In addition, the drawers that are not used may be inserted to the initial position such that the loss of cool air is further reduced than at the ready position.

Meanwhile, at the stopping step (S400), the user may push the drawer 30 in a direction in which the drawer 30 is inserted. In this case, the returning step (S500) may be performed even during the stopping step. To this end, an FG calculation step (S410) may be performed even during the stopping step (S400). In addition, a step (S440) of determining whether the user has pushed the drawer in the direction in which the drawer is inserted based on the calculated FG may be performed. For example, in a case in which the calculated FG is less than a predetermined FG, it may be determined that the user has pushed the drawer.

Even in this case, the determination step (S440) may be performed after a predetermined number of FG calculations.

As previously described, the stopping step (S400) may be performed normally, for example for 10 seconds. Subsequently, the motor may be driven to return the transfer member 171 to the initial position, which is the returning step (S500). At the returning step (S500), the force applied to the drawer is removed. At the returning step (S500), therefore, the drawer may return automatically due to the elastic restoring force of the automatic closing unit.

Figure 35:
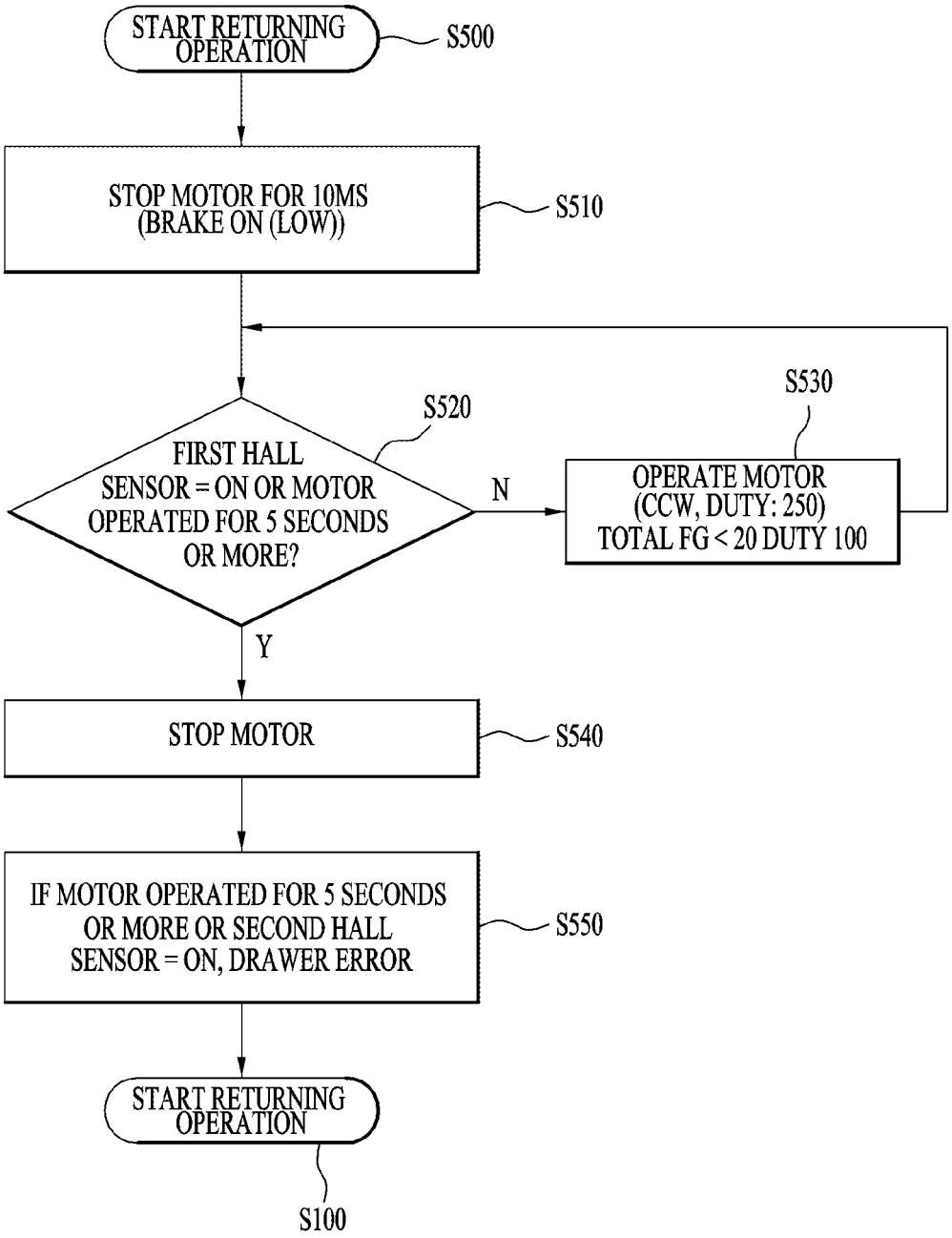
Figure 36:
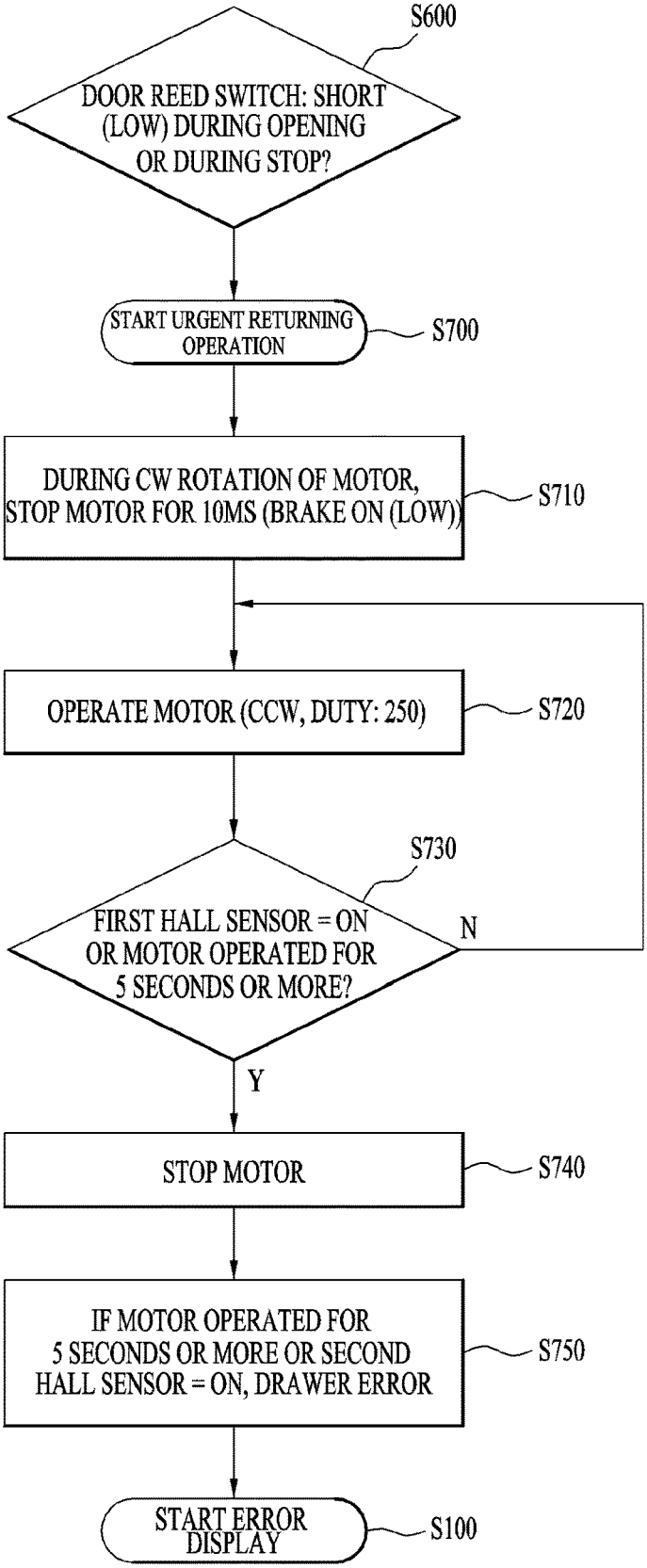

As shown in FIG. 35, the returning step (S500) includes a step (S510) of stopping the driving of the motor. That is, a step of temporarily stopping the driving of the motor in order to change the direction in which the motor is driven may be performed. The motor may be a brushless direct current (BLDC) motor. At this time, a brake input may be performed in order to stop the driving of the motor. The step (S510) may be performed, for example, for 10 ms. The step (S510) may be performed in order to prevent impact from being applied to the motor due to the abrupt change in rotational direction of the motor.

Meanwhile, the returning step (S500) may be performed in a manner similar to the initial step (S10).

That is, when an ON signal is generated by the first hall sensor 166 or the motor is driven in the counterclockwise direction for a predetermined time (S530), the driving of the motor may be stopped (S540). Here, the predetermined time may be the allowable maximum time, for example 5 seconds. When the motor is driven for 5 seconds, it may be determined that an error has occurred in the motor (S550). Of course, even when an ON signal is generated by the second hall sensor 167, it may be determined that an error has occurred in the motor (S550). In this case, the notification step (S100) may be performed.

When the driving of the motor is stopped (S540), the ready state (S200) is performed.

The duty ratio at the returning step (S500) may be higher than the duty ratio at the initial step (S10). In a case in which the FG sensed at the withdrawal step, i.e. the total FG, is less than a predetermined FG, however, the motor may be driven at the same duty ratio as at the initial step (S10). This is because in this case, the motor is driven in the forward direction or in the reverse direction in a state in which the obstacle is substantially eliminated. Consequently, the transfer member may smoothly return even when a relatively low duty ratio is applied.

Meanwhile, when the door is abruptly closed, the drawer at the ready position may collide with the basket of the door. For this reason, a step (S700) of urgently returning the drawer may be performed. For example, when the door is abruptly closed during the withdrawal of the drawer, the drawer may collide with the door. In addition, when the door is abruptly closed in the state in which the drawer is withdrawn, the drawer may collide with the door.

In this case, therefore, control logic for urgently returning the drawer may be performed.

That is, the step (S700) of urgently returning the drawer may be performed during the withdrawal step (S300) and the stopping step (S400). Of course, it is not necessary to perform the urgent returning step in a case in which the drawer is positioned at the initial position.

Consequently, a step (S600) of determining whether an urgent returning condition is satisfied may be performed first. When the urgent returning condition is satisfied, the urgent returning step (S700) may be performed.

As previously described, the urgent returning condition may be satisfied during the withdrawal step or the stopping step. Specifically, the urgent returning condition may be satisfied when the sensor 40 senses that the door is being closed. That is, the urgent returning condition may be satisfied when the reed switch 41 senses that the door is being closed.

The urgent returning step may be performed in the same manner as the returning step. That is, the urgent returning step may include a step (S720) of driving the motor in the counterclockwise direction (i.e. the reverse direction), a step (S740) of stopping the motor, and an error determination step (S750). Of course, when it is determined that an error has occurred, the notification step (S100) may be performed.

Meanwhile, the urgent returning step may be started in a state in which the motor is driven in the clockwise direction. In the same manner, therefore, the driving of the motor may be stopped for a predetermined time, for example 10 ms, and then the motor may be driven in the counterclockwise direction.

It is possible to minimize the load applied to the motor using the above-described control method. In addition, in a case in which a high load is applied to the motor due to an obstacle, the returning step or the urgent returning step may be performed in order to prevent the high load from being continuously applied to the motor.

The following list of embodiment is provided to further illustrate some particular embodiments according to the present disclosure. This list is provided for illustrative purposes only and not meant to limit the disclosure to the embodiments contained in this list.

The following is the first list of embodiments.

1. A refrigerator comprising:
   - a cabinet having a storage compartment;
   - a door hingedly connected to the cabinet for opening and closing the storage compartment;
   - a drawer provided in the storage compartment;
   - a sensor configured to sense that the door is open when the door is turned by a predetermined angle;
   - an electric driving unit configured to withdraw the drawer forward when it is sensed that the door is open; and
   - a rail configured to allow the drawer to move forward and rearward relative to the storage compartment.

2-1. The refrigerator according to the first embodiment, wherein the door and the drawer are provided separately, whereby a force applied to open the door is independent of withdrawal of the drawer.

2-2. The refrigerator according to the first embodiment, wherein the electric driving unit is configured to automatically withdraw the drawer to a ready position spaced apart forward from an initial position of the drawer by a predetermined distance.

2-3. The refrigerator according to any one of the first to 2-2 embodiments, wherein the electric driving unit comprises a motor assembly and a moving frame, and the moving frame is configured to be movable forward and rearward between the initial position and the ready position by driving of the motor assembly.

3. The refrigerator according to the 2-3 embodiment, wherein the moving frame is connected with the drawer so as to apply a force to the drawer in a direction in which the drawer is withdrawn from the initial position to the ready position.

4. The refrigerator according to the third embodiment, wherein the moving frame is disconnected from the drawer so as not to apply a force to the drawer in a direction in which the drawer is inserted from the ready position to the initial position.

5. The refrigerator according to the 2-3 embodiment, wherein
   - the electric driving unit further comprises a connection member for interconnecting the motor assembly and the moving frame, and
   - a distance between the moving frame and the motor assembly is changed in proportion to a distance by which the connection member is withdrawn from the motor assembly.

6. The refrigerator according to the 2-3 embodiment, further comprising a sidewall defining the storage compartment and a support cover coupled to the sidewall for movably supporting the drawer along the rail.

7. The refrigerator according to the sixth embodiment, wherein a predetermined space is defined between the sidewall and the support cover, and the motor assembly is mounted to an inside surface of the support cover such that the motor assembly is positioned in the predetermined space.

8. The refrigerator according to the seventh embodiment, wherein the rail is mounted to an outside surface of the support cover.

9. The refrigerator according to the seventh embodiment, wherein the support cover is provided at an upper part and a lower part of the inside surface thereof with guide bars, and the moving frame is supported so as to be movable forward and rearward between the upper guide bar and the lower guide bar.

10. The refrigerator according to the seventh embodiment, wherein a slit is formed through the support cover, and the moving frame is provided with a transfer member, the transfer member extending through the slit so as to be connected with the drawer.

11. The refrigerator according to the tenth embodiment, wherein the drawer is provided with a first catching member, the first catching member being formed at a front of the transfer member so as to correspond to the transfer member, and, when the transfer member moves forward, the first catching member is pushed forward such that the drawer is moved in a direction in which the drawer is withdrawn.

12. The refrigerator according to the 2-3 embodiment, wherein the drawer comprises a basket and a drawer frame provided outside the basket.

13. The refrigerator according to the twelfth embodiment, wherein the moving frame is selectively connected with the drawer frame, and when the moving frame is connected with the drawer frame, movement of the moving frame is converted into movement of the drawer.

14. The refrigerator according to the thirteenth embodiment, wherein the drawer comprises a plurality of vertically arranged drawers, and the moving frame is selectively connected with the drawer frame of each of the drawers.

15. The refrigerator according to the fourteenth embodiment, wherein the rail is configured to allow the drawer to move forward and rearward between a maximum withdrawal position, which is spaced apart forward from the ready position by a predetermined distance, and the initial position.

16. The refrigerator according to the fifteenth embodiment, wherein a connection between the moving frame and the drawer frame is released from the ready position to the maximum withdrawal position such that the drawer is manually withdrawn.

17. The refrigerator according to the sixteenth embodiment, wherein the motor assembly is continuously driven in a state in which the door remains open such that the moving frame remains at the ready position.

18. The refrigerator according to the seventeenth embodiment, wherein the drawer is manually inserted from the maximum withdrawal position to the ready position, at which the drawer frame is coupled again to the moving frame.

19. The refrigerator according to the eighteenth embodiment, wherein, when it is sensed that the door is closed, the motor assembly is operated to return the moving frame from the ready position to the initial position.

20. The refrigerator according to the nineteenth embodiment, wherein, when it is sensed through the sensor that the door has been opened by a predetermined angle or more in a state in which the door is closed, it is determined that the door is open, and, when it is sensed through the sensor that the door has been closed by a predetermined angle or less in a state in which the door is open, it is determined that the door is closed.

21. The refrigerator according to any one of the 2-3 to twentieth embodiments, further comprising an elastic device configured to be elastically deformed when the drawer moves from the initial position to the ready position and configured to provide an elastic restoring force to the drawer when the drawer moves from the ready position to the initial position.

22. The refrigerator according to the twenty-first embodiment, wherein the elastic device comprises:

a housing having a slot formed therein in a longitudinal direction and a spring mounted therein; and a hanging member configured to move along the slot to elastically deform and elastically restore the spring, the hanging member being selectively connected with the drawer.

23. The refrigerator according to the twenty-second embodiment, wherein the drawer is provided with a second catching member configured to be selectively connected with the hanging member, and the hanging member and the second catching member are connected with each other at the ready position such that the drawer returns to the initial position due to an elastic restoring force of the spring.

24. The refrigerator according to the twenty-third embodiment, wherein the slot is provided at a front end thereof with a first inclined slot for limiting movement of the hanging member and releasing a connection between the hanging member and the second catching member in a state in which the hanging member maximally elastically deforms the spring.

25. The refrigerator according to the twenty-fourth embodiment, wherein the hanging member moves into the first inclined slot at a predetermined position between the ready position and the maximum withdrawal position of the drawer such that the connection between the hanging member and the second catching member is released.

26. The refrigerator according to the twenty-fifth embodiment, wherein, as the drawer returns to the ready position after being withdrawn, the hanging member escapes from the first inclined slot and is connected with the second catching member.

27. The refrigerator according to the twenty-sixth embodiment, wherein the slot is provided at a rear end thereof with a second inclined slot for limiting the movement of the hanging member and releasing the connection between the hanging member and the second catching member in a state in which the hanging member maximally elastically restores the spring.

28. The refrigerator according to the twenty-seventh embodiment, wherein the hanging member moves into the second inclined slot at a predetermined position between the ready position and the initial position of the drawer such that the connection between the hanging member and the second catching member is released.

29. The refrigerator according to the twenty-eighth embodiment, wherein, as the drawer is withdrawn from the initial position to the ready position, the hanging member escapes from the second inclined slot and is connected with the second catching member.

30. A refrigerator comprising:

a cabinet having a storage compartment;

a door hingedly connected to the cabinet for opening and closing the storage compartment;

a drawer provided in the storage compartment;

a sensor configured to sense that the door is open when the door is turned by a predetermined angle;

an electric driving unit configured to move the drawer forward to a ready position spaced apart forward from an initial position by a predetermined distance when it is sensed that the door is open;

a rail configured to allow the drawer to move forward and rearward relative to the storage compartment; and an elastic device selectively connected to the drawer for providing an elastic restoring force to the drawer when the drawer returns from the ready position to the initial position.

31. The refrigerator according to the thirtieth embodiment, wherein the sensor is configured to sense that the door is closed when the door is turned and closed by a predetermined angle after sensing that the door is open.

32. The refrigerator according to the thirty-first embodiment, wherein the predetermined angle at which it is sensed that the door is open is equal to the predetermined angle at which it is sensed that the door is closed.

33. The refrigerator according to the thirty-first embodiment, wherein the predetermined angle at which it is sensed that the door is open is greater than the predetermined angle at which it is sensed that the door is closed.

33. The refrigerator according to any one of the thirtieth to thirty-third embodiment, further comprising:

a door switch for sensing that the door is open when tight contact between the door and the cabinet is released and sensing that the door is closed when the tight contact between the door and the cabinet is performed, wherein the door switch is provided separately from the sensor.

The following is the second list of embodiments.

1. A refrigerator comprising:

a cabinet having a storage compartment;

a door hingedly connected to the cabinet for opening and closing the storage compartment;

a drawer provided in the storage compartment;

a sensor for sensing whether the door is open;

an electric driving unit comprising a motor assembly and a moving frame configured to move forward and rearward by driving of the motor assembly, the moving frame moving forward to move the drawer to a ready position spaced apart forward from an initial position by a predetermined distance when it is sensed that the door is open; and a rail configured to allow the drawer to move forward and rearward relative to the storage compartment, wherein the electric driving unit is driven such that the moving frame returns rearward after moving forward to move the drawer to the ready position.

2-1. The refrigerator according to the first embodiment, wherein it is sensed that the door is open when the door is turned by a predetermined angle.

2-2. The refrigerator according to the first embodiment, wherein the electric driving unit remains driven in a forward direction for a predetermined time in a state in which the moving frame moves forward to move the drawer to the ready position and is then driven in a reverse direction to return the moving frame.

2-3. The refrigerator according to any one of the first to 2-2 embodiments, wherein the moving frame is connected with the drawer so as to apply a force to the drawer in a direction in which the drawer is withdrawn from the initial position to the ready position.

3. The refrigerator according to the 2-3 embodiment, wherein the moving frame is disconnected from the drawer so as not to apply a force to the drawer in a direction in which the drawer is inserted from the ready position to the initial position.

4. The refrigerator according to any one of the first to third embodiments, wherein the electric driving unit further comprises a connection member for interconnecting the motor assembly and the moving frame, and a distance between the moving frame and the motor assembly is changed in proportion to a distance by which the connection member is withdrawn from the motor assembly.

5. The refrigerator according to any one of the first to third embodiments, further comprising a sidewall defining the storage compartment and a support cover coupled to the sidewall for movably supporting the drawer along the rail.

6. The refrigerator according to the fifth embodiment, wherein a predetermined space is defined between the sidewall and the support cover, and the motor assembly is mounted to an inside surface of the support cover such that the motor assembly is positioned in the predetermined space.

7. The refrigerator according to the sixth embodiment, wherein the support cover is provided at an upper part and a lower part of the inside surface thereof with guide bars, and the moving frame is supported so as to be movable forward and rearward between the upper guide bar and the lower guide bar.

8. The refrigerator according to the sixth embodiment, wherein a slit is formed through the support cover, and the moving frame is provided with a transfer member, the transfer member extending through the slit so as to be connected with the drawer.

9. The refrigerator according to the eighth embodiment, wherein the drawer is provided with a first catching member, the first catching member being formed at a front of the transfer member so as to correspond to the transfer member, and, when the transfer member moves forward, the first catching member is pushed forward such that the drawer is moved in a direction in which the drawer is withdrawn.

10. The refrigerator according to any one of the first to ninth embodiments, wherein the drawer comprises a basket and a drawer frame provided outside the basket.

11. The refrigerator according to the tenth embodiment, wherein the moving frame is selectively connected with the drawer frame, and, when the moving frame is connected with the drawer frame, movement of the moving frame is converted into movement of the drawer.

12. The refrigerator according to the eleventh embodiment, wherein the drawer comprises a plurality of vertically arranged drawers, and the moving frame is selectively connected with the drawer frame of each of the drawers.

13. The refrigerator according to the twelfth embodiment, wherein the rail is configured to allow the drawer to move forward and rearward between a maximum withdrawal position, which is spaced apart forward from the ready position by a predetermined distance, and the initial position.

14. The refrigerator according to the thirteenth embodiment, wherein a connection between the moving frame and the drawer frame is released from the ready position to the maximum withdrawal position such that the drawer is manually withdrawn.

15. The refrigerator according to any one of the first to fourteenth embodiments, wherein the electric driving unit is driven such that the moving frame moves to the initial position regardless of whether it is sensed that the door is open or closed after moving to the ready position.

16. The refrigerator according to the fifteenth embodiment, wherein, when the moving frame returns to the initial position, a connection between the moving frame and the drawer frame is released such that the drawer remains at the ready position.

17. The refrigerator according to the sixteenth embodiment, wherein, when the moving frame returns to the initial position, the drawer is manually inserted from a maximum withdrawal position, at which the drawer is maximally withdrawn forward, to the ready position of the drawer.

18. The refrigerator according to the sixteenth embodiment, wherein, when the moving frame moves from the initial position to the ready position, the moving frame is connected with the drawer, whereby the moving frame pushes the drawer.

19. The refrigerator according to any one of the first to eighteenth embodiments, further comprising an elastic device configured to be elastically deformed when the drawer moves from the initial position to the ready position and configured to provide an elastic restoring force to the drawer when the drawer moves from the ready position to the initial position.

20. The refrigerator according to the nineteenth embodiment, wherein the elastic device comprises:

a housing having a slot formed therein in a longitudinal direction and a spring mounted therein; and a hanging member configured to move along the slot to elastically deform and elastically restore the spring, the hanging member being selectively connected with the drawer.

21. The refrigerator according to the twentieth embodiment, wherein the drawer is provided with a second catching member configured to be selectively connected with the hanging member, and the hanging member and the second catching member are connected with each other as the drawer is inserted such that the drawer returns to the initial position due to an elastic restoring force of the spring.

22. The refrigerator according to the twenty-first embodiment, wherein the slot is provided at a front end thereof with a first inclined slot for limiting movement of the hanging member and releasing a connection between the hanging member and the second catching member in a state in which the hanging member maximally elastically deforms the spring.

23. The refrigerator according to the twenty-second embodiment, wherein the hanging member moves into the first inclined slot at the ready position of the drawer such that the connection between the hanging member and the second catching member is released.

24. The refrigerator according to the twenty-second embodiment, wherein the slot is provided at a rear end thereof with a second inclined slot for limiting the movement of the hanging member and releasing the connection between the hanging member and the second catching member in a state in which the hanging member maximally elastically restores the spring.

25. The refrigerator according to the twenty-fifth embodiment, wherein, after the hanging member is connected with the second catching member, the hanging member moves into the second inclined slot at a predetermined position before the drawer is inserted to the initial position such that the connection between the hanging member and the second catching member is released.

26. The refrigerator according to the twenty-fifth embodiment, wherein, as the drawer is withdrawn from the initial position to the ready position, the hanging member escapes from the second inclined slot and is connected with the second catching member.

27. A refrigerator comprising:

a cabinet having a storage compartment;

a door hingedly connected to the cabinet for opening and closing the storage compartment;

a drawer provided in the storage compartment;

a sensor configured to sense whether the door is open or closed based on a turning angle of the door;

an electric driving unit comprising a motor assembly and a moving frame configured to move forward and rearward by driving of the motor assembly, the moving frame moving forward to move the drawer to a ready position spaced apart forward from an initial position by a predetermined distance when it is sensed that the door is open;

a rail configured to allow the drawer to move forward and rearward relative to the storage compartment; and an elastic device selectively connected to the drawer for providing an elastic restoring force to the drawer when the drawer returns to the initial position after being withdrawn, wherein the electric driving unit is driven such that the moving frame returns to the initial position after moving to the ready position.

28. The refrigerator according to the twenty-seventh embodiment, wherein a spring of the elastic device is elastically deformed as the drawer is withdrawn from the initial position, and the elastic device is disconnected from the drawer while remaining elastically deformed when the drawer is withdrawn to the ready position.

The following is the third list of embodiments.

1. A refrigerator comprising:

a cabinet having a storage compartment;

a door hingedly connected to the cabinet for opening and closing the storage compartment;

a sensor for sensing whether the door is open;

a drawer provided in the storage compartment, the drawer being configured to move to a ready position spaced apart forward from an initial position by a predetermined distance when it is sensed that the door is open;

an elastic device configured to be elastically deformed when the drawer moves from the initial position to the ready position and configured to provide an elastic restoring force to the drawer such that the drawer moves from the ready position to the initial position;

an electric driving unit for moving the drawer from the initial position to the ready position and elastically deforming the elastic device; and a rail configured to allow the drawer to move forward and rearward relative to the storage compartment.

2. The refrigerator according to the first embodiment, wherein the elastic device comprises:

a hanging member configured to be selectively connected with the drawer; and a spring configured to be elastically deformed and elastically restored depending on a direction in which the hanging member moves and a distance by which the hanging member moves.

3. The refrigerator according to the second embodiment, wherein the drawer is provided with a catching member configured to be selectively connected with the elastic device.

4. The refrigerator according to the third embodiment, wherein the elastic device further comprises a housing for receiving the spring, the housing being provided with a slot for guiding movement of the hanging member.

5. The refrigerator according to the fourth embodiment, wherein the hanging member protrudes from the housing in a horizontal direction such that the hanging member is selectively connected with the drawer.

6. The refrigerator according to any one of the first to fifth embodiments, wherein the electric driving unit comprises a motor assembly and a moving frame, and the moving frame is configured to be movable forward and rearward between the initial position and the ready position by driving of the motor assembly.

7. The refrigerator according to the sixth embodiment, wherein the moving frame comprises a transfer member for transferring a force to the drawer, and the transfer member pushes the drawer such that the drawer moves from the initial position to the ready position.

8. The refrigerator according to the third embodiment, wherein the electric driving unit comprises a motor assembly and a transfer member configured to be moved forward and rearward by driving of the motor assembly, and the transfer member moves the catching member of the drawer forward via the hanging member.

9. The refrigerator according to the eighth embodiment, wherein the hanging member protrudes from the housing of the elastic device so as to be connected to the catching member of the drawer, and the transfer member pushes the hanging member in a direction perpendicular to a direction in which the hanging member protrudes.

10. The refrigerator according to the ninth embodiment, wherein the hanging member is provided at one side thereof with a location part on which the transfer member is located in contact.

11. The refrigerator according to the tenth embodiment, wherein movement of the transfer member is transferred to the hanging member as the transfer member moves forward while being located on the location part, and a connection between the transfer member and the hanging member is released when the transfer member moves rearward while being separated from the location part.

12. A refrigerator comprising:

a cabinet having a storage compartment;

a door hingedly connected to the cabinet for opening and closing the storage compartment;

a sensor for sensing whether the door is open;

a drawer provided in the storage compartment such that the drawer moves to a ready position spaced apart forward from an initial position by a predetermined distance when it is sensed that the door is open, the drawer comprising a catching member;

an elastic device comprising a hanging member configured to be selectively connected with the catching member and a spring configured to be elastically deformed and elastically restored by a movement of the catching member;

an electric driving unit comprising a transfer member for pushing the hanging member to move the drawer from the initial position to the ready position and a motor assembly for electrically moving the transfer member; and a rail configured to allow the drawer to move forward and rearward relative to the storage compartment.

13. The refrigerator according to the twelfth embodiment, wherein a connection between the catching member and the hanging member is maintained within a section between the initial position and the ready position.

14. The refrigerator according to the thirteenth embodiment, wherein the connection between the catching member and the hanging member is released as the drawer is withdrawn further forward from the ready position such that the drawer is manually withdrawn.

15. The refrigerator according to the thirteenth embodiment, wherein the electric driving unit is driven to move the transfer member rearward such that the drawer moves from the ready position to the initial position.

16. The refrigerator according to the fifteenth embodiment, wherein the hanging member moves the catching member rearward as the spring is elastically restored such that the drawer returns from the ready position to the initial position.

17. The refrigerator according to any one of the first to sixteenth embodiments, wherein the elastic device further comprises a housing for receiving the spring, the housing being provided with a slot for guiding movement of the hanging member.

18. The refrigerator according to the sixteenth embodiment, wherein the hanging member protrudes from the housing toward the drawer such that the hanging member is selectively connected with the drawer.

19. The refrigerator according to the eighteenth embodiment, wherein the transfer member is positioned between the housing and the catching member, the transfer member being configured to push the hanging member forward at a rear of the hanging member.

20. The refrigerator according to the twelfth embodiment, wherein the drawer comprises a plurality of vertically arranged drawers, the transfer member being provided at each of the drawers, and the electric driving unit comprises a moving frame configured to simultaneously move the transfer members by driving of the motor assembly.

21. A refrigerator comprising:

a cabinet having a storage compartment;

a door hingedly connected to the cabinet for opening and closing the storage compartment;

a drawer provided in the storage compartment;

a moving frame configured to be selectively connected with the drawer, the moving frame being movable forward and rearward;

an electric driving unit for moving the moving frame, connected with the drawer, forward to withdraw the drawer from an initial position to a ready position and moving the moving frame rearward to release the connection between the drawer and the moving frame when the door is opened; and a controller for controlling driving of the electric driving unit.

22. A refrigerator comprising:

a cabinet having a storage compartment;

a door hingedly connected to the cabinet for opening and closing the storage compartment;

a drawer provided in the storage compartment; and an electric driving unit for generating a driving force such that the drawer is automatically withdrawn from an initial position to a ready position regardless of application of a user's force to open the door when the door is opened, wherein the drawer is manually inserted from the ready position to the initial position regardless of the driving force of the electric driving unit.

23. A refrigerator comprising:

a cabinet having a storage compartment;

a door hingedly connected to the cabinet for opening and closing the storage compartment;

a drawer provided in the storage compartment;

a moving frame configured to be selectively connected with the drawer, the moving frame being movable forward and rearward; and an electric driving unit for moving the moving frame, connected with the drawer, forward to withdraw the drawer from an initial position to a ready position when the door is opened, wherein the connection between the drawer and the moving frame is released such that the drawer is manually withdrawn from the ready position to a maximum withdrawal position.

24. A refrigerator comprising:

a cabinet having a storage compartment;

a door hingedly connected to the cabinet for opening and closing the storage compartment;

a drawer provided in the storage compartment;

an electric driving unit for driving the drawer such that the drawer is withdrawn from an initial position to a ready position when the door is opened; and a controller for controlling driving of the electric driving unit.

25. A refrigerator comprising:

a cabinet having a storage compartment;

a door hingedly connected to the cabinet for opening and closing the storage compartment;

a drawer provided in the storage compartment;

an electric driving unit for driving the drawer such that the drawer is withdrawn from an initial position to a ready position when the door is opened;

an elastic device configured to be elastically deformed when the drawer is withdrawn and to provide an elastic restoring force to the drawer when the drawer is inserted; and a controller for controlling driving of the electric driving unit.

26. A refrigerator comprising:
a cabinet having a storage compartment;
a door hingedly connected to the cabinet for opening and closing the storage compartment;
a drawer provided in the storage compartment;
an electric driving unit for driving the drawer such that the drawer is withdrawn from an initial position to a ready position when the door is opened; and
an elastic device configured to be elastically deformed when the drawer is withdrawn from the initial position to the ready position and to insert the drawer from the ready position to the initial position using an elastic restoring force such that an insertion speed of the drawer is different from a withdrawal speed of the drawer.

27. A refrigerator comprising:
a cabinet having a storage compartment;
a door hingedly connected to the cabinet for opening and closing the storage compartment;
a drawer provided in the storage compartment;
an electric driving unit for driving the drawer such that the drawer is withdrawn from an initial position to a ready position when the door is opened; and
an elastic device configured to be connected with the drawer such that the elastic device is elastically deformed when the drawer is withdrawn from the initial position to the ready position and configured to be disconnected from the drawer when the drawer is withdrawn from the ready position to a maximum withdrawal position.

28. A refrigerator comprising:
a cabinet having a storage compartment;
a door hingedly connected to the cabinet for opening and closing the storage compartment;
a drawer provided in the storage compartment; and
a support assembly configured to be coupled to the drawer for supporting the drawer so as to be movable forward and rearward relative to the storage compartment, the support assembly being separably coupled to a left sidewall or a right sidewall of the storage compartment, wherein
the support assembly comprises:
a support cover configured to be coupled to the sidewall of the storage compartment;
an electric driving unit configured to be driven to automatically withdraw the drawer, the electric driving unit being mounted to an inside surface of the support cover facing the sidewall of the storage compartment;
a rail mounted to an outside surface of the support cover for supporting the drawer so as to be movable forward and rearward; and
a moving frame configured to transfer a driving force of the electric driving unit to the drawer, the moving frame being movably provided at the support cover separately from the rail.

29. A refrigerator comprising:
a cabinet having a storage compartment;
a door hingedly connected to the cabinet for opening and closing the storage compartment;
a plurality of drawers provided in the storage compartment, the drawers being arranged vertically;
a support cover configured to be separably coupled to a one-side sidewall of the storage compartment;
a plurality of rails mounted to an outside surface of the support cover for supporting the drawers so as to be movable forward and rearward;
an electric driving unit configured to be driven to automatically withdraw the drawers; and
a single moving frame configured to simultaneously transfer a driving force of the electric driving unit to the drawers, the single moving frame being movably provided at the support cover separately from the rail.

30. A refrigerator comprising:
a cabinet having a storage compartment;
a door hingedly connected to the cabinet for opening and closing the storage compartment;
a drawer provided in the storage compartment;
a support cover configured to be fixedly coupled to a one-side sidewall of the storage compartment;
a rail mounted to the support cover for supporting the drawer so as to be movable forward and rearward;
a sensor for sensing that the door is open when the door is opened by a predetermined opening angle;
an electric driving unit;
a moving frame configured to be movable forward and rearward relative to the support cover by driving of the electric driving unit; and
a controller for controlling the electric driving unit to move the moving frame forward such that the drawer is withdrawn from an initial position to a ready position when it is sensed that the door is open.

31. A refrigerator comprising:
a cabinet having a storage compartment;
a door hingedly connected to the cabinet for opening and closing the storage compartment;
a drawer provided in the storage compartment;
a support cover configured to be fixedly coupled to a one-side sidewall of the storage compartment, the storage compartment having a recess or a through part;
an electric driving unit comprising a motor and a housing for receiving the motor, the housing being fixed to an inside surface of the support cover, the housing being inserted into the recess or inserted through the through part when the support cover is coupled to the sidewall of the storage compartment;
a moving frame configured to be movable forward and rearward by driving of the electric driving unit; and
a controller for controlling the electric driving unit to move the moving frame forward such that the drawer is withdrawn from an initial position to a ready position when it is sensed that the door is open.

The following is the fourth list of embodiments.

1. A refrigerator comprising:
a cabinet having a storage compartment;
a door hingedly connected to the cabinet for opening and closing the storage compartment;
a magnet provided at the door, the magnet being configured to turn about a rotary shaft of the door while maintaining a predetermined turning radius as the door is opened; and
a reed switch provided above or under the magnet such that the reed switch is spaced apart from the magnet, the reed switch being fixed to the cabinet regardless of a hinged rotation of the door, the reed switch having a critical point of effective magnetic intensity for contact point switching when an opening angle of the door reaches a predetermined opening angle.

2. The refrigerator according to the first embodiment, wherein the magnet is configured such that a vertical distance between the magnet and the reed switch is not changed while a horizontal distance between the magnet and the reed switch is changed as the opening angle of the door is changed.

3. The refrigerator according to the second embodiment, wherein the magnet is mounted in a door decoration part defining a lower surface of the door, and the reed switch is provided under the magnet.

4. The refrigerator according to the third embodiment, wherein the rotary shaft of the door is formed as a vertical shaft, about which the door is hingedly rotated leftward and rightward such that the door is opened and closed, the rotary shaft of the door being provided on a left side or a right side of the cabinet such that the rotary shaft of the door is spaced apart forward from the cabinet.

5. The refrigerator according to the fourth embodiment, wherein the reed switch is spaced apart forward from the cabinet, the reed switch being biased from the rotary shaft of the door to left and right middle parts of the cabinet.

6. The refrigerator according to the fifth embodiment, wherein the reed switch is provided at a hinge cover forming the rotary shaft of the door, the hinge cover being horizontal with respect to a ground.

7. The refrigerator according to the fifth embodiment, wherein the magnet is configured to pass a vertical upper part of the reed switch such that the horizontal distance between the magnet and the reed switch is increased as the opening angle of the door is increased.

8. The refrigerator according to the first embodiment, wherein it is sensed whether the door is open or closed as a result of the contact point switching of the reed switch.

9. The refrigerator according to any one of the first to eighth embodiments, wherein the magnet comprises a plurality of magnets having different horizontal angles relative to the reed switch.

10. The refrigerator according to the ninth embodiment, wherein the magnet comprises a horizontal magnet provided parallel to a front surface of the cabinet in a longitudinal direction and a vertical magnet provided substantially perpendicular to the horizontal magnet, in a state in which the door is closed.

11. The refrigerator according to the tenth embodiment, wherein the magnet is a bar-type magnet, and a length of the magnet is greater than a height of the magnet in a state in which the magnet is mounted.

12. The refrigerator according to the tenth embodiment, wherein the reed switch is configured to have a quadrangular shape having horizontal sides and vertical sides.

13. The refrigerator according to the twelfth embodiment, wherein a length of the horizontal sides is greater than a length of the vertical sides.

14. The refrigerator according to the twelfth embodiment, wherein the length of the horizontal magnet and the vertical magnet is greater than the length of the horizontal sides of the reed switch.

15. The refrigerator according to the fourteenth embodiment, wherein, when the opening angle of the door is 90 degrees, an angle between the horizontal magnet and each horizontal side of the reed switch is substantially 90 degrees.

16. The refrigerator according to the tenth embodiment, wherein the turning radius of the horizontal magnet about the rotary shaft of the door is less than the turning radius of the vertical magnet.

17. The refrigerator according to the tenth embodiment, wherein the horizontal magnet is mounted such that a distance between the horizontal magnet and the rotary shaft of the door is decreased in order to increase the opening angle of the door corresponding to the critical point, and the horizontal magnet is mounted such that the distance between the horizontal magnet and the rotary shaft of the door is increased in order to decrease the opening angle of the door corresponding to the critical point.

18. A refrigerator comprising:

a cabinet having a storage compartment;

a door hingedly connected to the cabinet for opening and closing the storage compartment;

a sensor comprising a magnet provided at the door, the magnet being configured to turn about a rotary shaft of the door while having a predetermined turning radius as the door is opened and a reed switch fixed to the cabinet, a contact point of the reed switch being switched at a critical point of effective magnetic intensity due to the magnet, the sensor being configured to sense that the door is open when an opening angle of the door reaches a predetermined opening angle;

an electric driving unit for moving the drawer to a ready position spaced apart forward from an initial position by a predetermined distance when it is sensed that the door is open; and a rail configured to allow the drawer to move forward and rearward relative to the storage compartment.

19. The refrigerator according to the eighteenth embodiment, wherein the magnet is configured such that a vertical distance between the magnet and the reed switch is not changed while a horizontal distance between the magnet and the reed switch is changed as the opening angle of the door is changed.

20. The refrigerator according to the nineteenth embodiment, wherein the magnet is mounted in a door decoration part defining a lower surface of the door, and the reed switch is provided under the magnet.

21. The refrigerator according to the twentieth embodiment, wherein the magnet comprises a plurality of magnets having different horizontal angles relative to the reed switch.

The following is the fifth list of embodiments.

1. A refrigerator comprising:

a cabinet having a storage compartment;

a door hingedly connected to the cabinet for opening and closing the storage compartment;

a drawer provided in the storage compartment so as to be movable forward and rearward; and a rail for supporting the drawer such that the drawer moves forward and rearward relative to the storage compartment, wherein the drawer comprises:

a basket for receiving goods; and a drawer frame provided with a basket location part, on which the basket is located, and a rail coupling part located on the rail so as to be coupled to the rail.

2. The refrigerator according to the first embodiment, wherein the basket is configured to be located on the basket location part vertically downward so as to be coupled to the drawer frame and is configured to move vertically upward such that the coupling between the basket and the drawer frame is released.

3. The refrigerator according to the second embodiment, wherein the drawer frame is provided in a middle part thereof with an opening, and the basket location part is formed around the opening.

4. The refrigerator according to the third embodiment, wherein the basket comprises a lower basket configured to be inserted through the opening and an upper basket configured to be located on the basket location part, and the lower basket and the upper basket are integrally formed.

5. The refrigerator according to the fourth embodiment, wherein the rail coupling part is provided at each of left and right sides of the drawer frame such that the rail coupling part extends forward and rearward, and a horizontal width of the upper basket is greater than a horizontal width of the lower basket such that the upper basket covers the rail coupling part from above.

6. The refrigerator according to any one of the first to fifth embodiments, wherein the rail comprises a moving rail configured to move forward and rearward together with the drawer.

7. The refrigerator according to the sixth embodiment, wherein the rail coupling part is formed in a sectional shape of a channel such that the rail coupling part is located while surrounding the moving rail.

8. The refrigerator according to the seventh embodiment, wherein the moving rail is provided at a rear thereof with a catching part, the catching part being configured to catch a rear end of the rail coupling part so as to limit a rearward movement and an upward movement of the rail coupling part.

9. The refrigerator according to the eighth embodiment, wherein the rear end of the rail coupling part is inserted into the catching part.

10. The refrigerator according to the eighth embodiment or the ninth embodiment, wherein an elastic protrusion is provided at a front end of the moving rail, and the rail coupling part is provided at a front end thereof with a mounting hole, into which the elastic protrusion is inserted while being elastically restored after being elastically deformed.

11. The refrigerator according to the tenth embodiment, wherein, as the front end of the rail coupling part moves downward in a state in which the rear end of the rail coupling part is inserted in the catching part, the elastic protrusion is elastically deformed and is then inserted and coupled into the mounting hole.

12. The refrigerator according to the eleventh embodiment, wherein the moving rail is provided at each side of the drawer, and the drawer frame is fixed to the moving rail at four support points, respectively positioned at a front, rear, left, and right, by the elastic protrusion and the catching part.

13. The refrigerator according to the sixth embodiment, wherein the rail comprises a fixed rail fixed in the storage compartment, the fixed rail being provided under the moving rail, and the moving rail is configured to be slidable relative to the fixed rail.

14. The refrigerator according to the fifth embodiment, wherein the drawer further comprises a drawer decoration part provided at a lower part of a front of the basket such that the drawer decoration part extends leftward and rightward so as to cover the rail coupling part at a front of the drawer.

15. A refrigerator comprising:

a cabinet having a storage compartment;

a door hingedly connected to the cabinet for opening and closing the storage compartment;

a drawer provided in the storage compartment so as to be movable forward and rearward, the drawer comprising a basket for receiving goods and a drawer frame provided with a rail coupling part; and a rail coupled to the rail coupling part for supporting the drawer such that the drawer moves forward and rearward relative to the storage compartment, wherein the rail coupling part is formed in a channel shape such that the rail coupling part is located on the rail downward from above so as to surround the rail, and the rail is provided at a rear thereof with a catching part, into which a rear end of the rail coupling part is inserted, and the rail is provided at a front thereof with an elastic protrusion, which is inserted into a mounting hole provided at a front end of the rail coupling part.

16. The refrigerator according to the fifteenth embodiment, wherein the rail comprises a moving rail and a fixed rail provided under the moving rail for slidably supporting the moving rail, and the rail coupling part is coupled to the moving rail.

17. The refrigerator according to the sixteenth embodiment, wherein the mounting hole is formed in a side flange configured to cover an outside surface of the moving rail, and the elastic protrusion is elastically deformed toward left and right middles of the drawer and is then restored and inserted into the mounting hole.

18. The refrigerator according to the sixteenth embodiment, wherein an elastic protrusion bracket for forming the elastic protrusion at the fixed rail is mounted to a front end of the fixed rail, and a cutout part for allowing the elastic protrusion to be elastically deformed is formed between the elastic protrusion bracket and the elastic protrusion.

19. The refrigerator according to the fifteenth embodiment, wherein the rail comprises a rail bracket for fixing the fixed rail to a sidewall of the storage compartment.

20. The refrigerator according to the nineteenth embodiment, wherein the rail bracket comprises a front rail bracket and a rear rail bracket respectively provided at a front and a rear of the fixed rail such that the front rail bracket and the rear rail bracket are spaced apart from each other by a predetermined distance.

21. The refrigerator according to the twentieth embodiment, wherein the drawer frame is provided with a catching member protruding toward the sidewall of the storage compartment, and a transfer member protrudes from the sidewall of the storage compartment toward the drawer frame to push the catching member at a rear of the catching member.

22. The refrigerator according to the twentieth embodiment, further comprising:

an electric driving unit for moving the catching member based on a movement of the transfer member to move the drawer to a ready position spaced apart forward from an initial position by a predetermined distance, wherein the transfer member and the catching member are configured to move between the front rail bracket and the rear rail bracket within a section between the initial position and the ready position of the drawer.

23. A refrigerator comprising:

a cabinet having a storage compartment;

a door hingedly connected to the cabinet for opening and closing the storage compartment;

a sensor for sensing whether the door is open;

a drawer provided in the storage compartment so as to be movable forward and rearward, the drawer comprising a basket for receiving goods and a drawer frame provided with a rail coupling part and a catching member protruding toward a sidewall of the storage compartment;

a rail coupled to the rail coupling part for supporting the drawer such that the drawer moves forward and rearward relative to the storage compartment, the rail being supported by the sidewall of the storage compartment via a front rail bracket and a rear rail bracket; and an electric driving unit comprising a transfer member protruding from the sidewall of the storage compartment toward the drawer frame, the electric driving unit moving the catching member based on a movement of the transfer member to move the drawer to a ready position spaced apart forward from an initial position by a predetermined distance when it is sensed that the door is open, wherein the transfer member is configured to move between the front rail bracket and the rear rail bracket within a section between the initial position and the ready position of the drawer in order to avoid an interference between the transfer member and the front and rear rail brackets.

The following is the sixth list of embodiments.

1. A control method of a refrigerator comprising a motor, a drawer provided in a storage compartment defined in a cabinet so as to be movable forward and rearward, and a transfer member for pushing the drawer to automatically withdraw the drawer from an initial position to a ready position by driving of the motor, the control method comprising:

determining a condition for automatically withdrawing the drawer in a ready state (a determination step);

upon determining at the determination step that the condition is satisfied, driving the motor in one direction to move the transfer member forward such that the drawer is withdrawn to the ready position (a withdrawal step);

continuously driving the motor in the one direction to stop withdrawal of the drawer after the withdrawal step (a stopping step); and driving the motor in a reverse direction to return the transfer member rearward after the stopping step (a returning step).

2. The control method according to the first embodiment, further comprising driving the motor in the reverse direction to move the transfer member to the initial position in order to start the ready state when the refrigerator is powered on (an initial step).

3. The control method according to the second embodiment, wherein, at the initial step, the motor is driven in the reverse direction until a first hall sensor for sensing the initial position generates a signal or until a predetermined time has lapsed.

4. The control method according to the third embodiment, wherein, when driving of the motor is stopped at the initial step, the ready state is started in order to perform the determination step.

5. The control method according to the third embodiment, further comprising announcing that the refrigerator is operating abnormally when a second hall sensor for sensing the ready position generates a signal, or when the motor is driven until a predetermined time has lapsed, at the initial step (a notification step).

6. The control method according to the first embodiment, wherein, at the withdrawal step, the motor is driven until a second hall sensor for sensing the ready position generates a signal or until a predetermined time has lapsed.

7. The control method according to the sixth embodiment, wherein the motor is a brushless direct current (BLDC) motor, and, at the withdrawal step, a signal (frequency generator; FG) generated during rotation of the motor is calculated and a duty ratio to drive the motor is controlled to be different based on the calculated FG.

8. The control method according to the seventh embodiment, wherein the duty ratio is controlled to be increased as the calculated FG is increased.

9. The control method according to the sixth embodiment, wherein, when the calculated FG is less than an obstacle FG corresponding to an obstacle blocking withdrawal of the drawer during the withdrawal step, the returning step is performed without the stopping step being performed.

10. The control method according to the sixth embodiment, further comprising notifying that the refrigerator is operating abnormally when a first hall sensor for sensing the initial position generates a signal, or when the motor is driven until a predetermined time has lapsed, at the withdrawal step (a notification step).

11. The control method according to the first embodiment, wherein the stopping step is performed at a minimum duty ratio to drive the motor for a predetermined time.

12. The control method according to the eleventh embodiment, wherein the FG is calculated at the stopping step, and, when the FG calculated during the stopping step is a predetermined FG, the returning step is performed.

13. The control method according to the first embodiment, wherein the returning step comprises stopping the driving of the motor for a predetermined time.

14. The control method according to the first embodiment, wherein at the returning step, the motor is driven in the reverse direction such that the driving of the motor is stopped until a first hall sensor for sensing the initial position generates a signal or until a predetermined time has lapsed.

15. The control method according to the fourteenth embodiment, further comprising notifying that the refrigerator is operating abnormally when a second hall sensor for sensing the ready position generates a signal, or when the motor is driven until the predetermined time has lapsed, at the returning step (a notification step).

16. The control method according to the fourteenth embodiment, wherein the driving of the motor is stopped, and switching to the ready state is performed.

17. The control method according to any one of the first to sixteenth embodiments, wherein the refrigerator further comprises a door for opening and closing the storage compartment and a sensor for sensing that the door is open when an opening angle of the door is a predetermined opening angle, and the condition for automatically withdrawing the drawer comprises generating a door opening signal through the sensor.

18. The control method according to the seventeenth embodiment, wherein the refrigerator further comprises a door switch for sensing whether the door is in tight contact with the cabinet to sense whether the door is open or closed, and the condition for automatically withdrawing the drawer further comprises sensing whether the door is open through the door switch.

19. The control method according to the seventeenth embodiment, further comprising stopping the withdrawal step or the stopping step and driving the motor in the reverse direction to return the transfer member rearward when it is sensed through the sensor that the door is closed during the withdrawal step or the stopping step (an urgent returning step).

20. The control method according to the nineteenth embodiment, wherein, when the urgent returning step starts to be performed in a state in which the motor is driven in the one direction, the driving of the motor is stopped for a predetermined time and is then driven in the reverse direction.

21. A control method of a refrigerator comprising a motor, a drawer provided in a storage compartment defined in a cabinet so as to be movable forward and rearward, and a transfer member for pushing the drawer to automatically withdraw the drawer from an initial position to a ready position by driving of the motor, the control method comprising:

determining a condition for automatically withdrawing the drawer in a ready state (a determination step);

upon determining at the determination step that the condition is satisfied, driving the motor in one direction to move the transfer member forward such that the drawer is withdrawn to the ready position (a withdrawal step); and driving the motor in a reverse direction to return the transfer member rearward (a returning step).

22. A control method of a refrigerator comprising a motor, a drawer provided in a storage compartment defined in a cabinet so as to be movable forward and rearward, and a transfer member for pushing the drawer to automatically withdraw the drawer from an initial position to a ready position by driving of the motor, the control method comprising:

driving the motor in one direction to move the transfer member forward such that the drawer is withdrawn to the ready position when a door for opening and closing the storage compartment is opened (a withdrawal step); and stopping the withdrawal step and driving the motor in a reverse direction to return the transfer member rearward when the door is closed during the withdrawal step (a returning step).

23. A control method of a refrigerator comprising a motor, a drawer provided in a storage compartment defined in a cabinet so as to be movable forward and rearward, and a transfer member for pushing the drawer to automatically withdraw the drawer from an initial position to a ready position by driving of the motor, the control method comprising:

driving the motor in one direction to move the transfer member forward such that the drawer is withdrawn to the ready position when a door for opening and closing the storage compartment is opened (a withdrawal step); and driving the motor in a reverse direction to return the transfer member rearward in order to release a connection between the drawer and the transfer member after the withdrawal step (a returning step).

24. A control method of a refrigerator comprising a motor, a drawer provided in a storage compartment defined in a cabinet so as to be movable forward and rearward, and a transfer member for pushing the drawer to automatically withdraw the drawer from an initial position to a ready position by driving of the motor, the control method comprising:

driving the motor in one direction to move the transfer member forward such that the drawer is withdrawn to the ready position when a door for opening and closing the storage compartment is opened (a withdrawal step);

continuously driving the motor in the one direction to stop the withdrawal of the drawer after the withdrawal step (a stopping step); and driving the motor in a reverse direction to return the transfer member rearward in order to release a connection between the drawer and the transfer member after the stopping step (an urgent returning step).

25. A control method of a refrigerator comprising a motor, a drawer provided in a storage compartment defined in a cabinet so as to be movable forward and rearward, and a transfer member for pushing the drawer to automatically withdraw the drawer from an initial position to a ready position by driving of the motor, the control method comprising:

driving the motor in one direction to move the transfer member forward such that the drawer is withdrawn to the ready position when a door for opening and closing the storage compartment is opened (a withdrawal step);

driving the motor in a reverse direction to return the transfer member rearward in order to release a connection between the drawer and the transfer member after the withdrawal step (a returning step); and stopping the withdrawal step and driving the motor in the reverse direction to return the transfer member rearward when the door is closed during the withdrawal step (an urgent returning step).

26. A control method of a refrigerator comprising a motor, a drawer provided in a storage compartment defined in a cabinet so as to be movable forward and rearward, and a transfer member for pushing the drawer to automatically withdraw the drawer from an initial position to a ready position by driving of the motor, the control method comprising:

driving the motor in one direction to move the transfer member forward such that the drawer is withdrawn to the ready position when a door for opening and closing the storage compartment is opened (a withdrawal step);

continuously driving the motor in the one direction to stop the withdrawal of the drawer after the withdrawal step (a stopping step);

driving the motor in a reverse direction to return the transfer member rearward in order to release a connection between the drawer and the transfer member after the stopping step (a returning step); and stopping the withdrawal step or the stopping step and driving the motor in the reverse direction to return the transfer member rearward when the door is closed during the withdrawal step or the stopping step (an urgent returning step).

The following is the seventh list of embodiments.

1. A refrigerator comprising:

a cabinet having a storage compartment with a food introduction port formed in a front thereof;

a door hingedly connected to the cabinet for opening and closing the storage compartment;

a plurality of drawers disposed in the storage compartment, the drawers being arranged vertically;

a moving frame extending vertically so as to correspond to a height at which the drawers are disposed, the moving frame being configured to selectively push the drawers such that the drawers are moved toward the food introduction port;

an electric driving unit coupled to the moving frame for moving the moving frame toward the food introduction port; and a controller for controlling the electric driving unit to move the moving frame when it is sensed that the door is open.

2. The refrigerator according to the first embodiment, wherein the moving frame is provided with a plurality of transfer members configured to be selectively connected to the respective drawers.

3. The refrigerator according to the second embodiment, wherein the drawers are provided with catching members configured to be pushed by the respective transfer members.

4. The refrigerator according to the third embodiment, wherein a connection between the moving frame and the drawers is released when the moving frame returns rearward.

5. The refrigerator according to the fourth embodiment, wherein the controller controls the electric driving unit to return the moving frame rearward after the moving frame withdraws the drawers.

6. The refrigerator according to any one of the first to fifth embodiments, further comprising rails for supporting the drawers such that the drawers move relative to the storage compartment.

7. The refrigerator according to the sixth embodiment, further comprising:

a support cover configured to be coupled to a left or right sidewall of the storage compartment, wherein the rails are mounted to an outside surface of the support cover.

8. The refrigerator according to the seventh embodiment, wherein the moving frame is movably provided at the support cover separately from the rails.

9. The refrigerator according to any one of the first to fifth embodiments, wherein the moving frame is a single moving frame configured to simultaneously transfer a driving force of the electric driving unit to the drawers.

10. The refrigerator according to the ninth embodiment, wherein the electric driving unit comprises:

a motor assembly;

a housing for receiving the motor assembly; and a connection member for interconnecting the motor assembly and the moving frame.

11. The refrigerator according to the tenth embodiment, wherein the moving frame is moved in proportion to a distance by which the connection member is withdrawn from the housing.

12. The refrigerator according to the ninth embodiment, further comprising a support cover having one side surface, to which rails for supporting the drawers are coupled, and the other side surface, coupled to a sidewall defining the storage compartment, the support cover being configured to movably support the drawers along the rails.

13. The refrigerator according to the twelfth embodiment, wherein the motor assembly is mounted between the sidewall and the support cover.

14. The refrigerator according to the thirteenth embodiment, wherein the moving frame is configured to move forward and rearward between the sidewall and the support cover.

15. The refrigerator according to the fourteenth embodiment, wherein the support cover is provided at an inside surface thereof with a guide bar connected with the moving frame for movably supporting the moving frame.

16. The refrigerator according to the fifteenth embodiment, wherein the moving frame is provided with a sliding support part for surrounding the guide bar.

17. The refrigerator according to the fifteenth embodiment, wherein the sliding support part comprises at least two sliding support parts provided at an upper end, a middle part, and a lower end of the moving frame.

18. The refrigerator according to the fifteenth embodiment, wherein a liner is provided between the guide bar and the sliding support part.

19. The refrigerator according to the eighteenth embodiment, wherein the liner is provided at an upper inside surface, a lower inside surface, a left inside surface, and a right inside surface thereof with friction avoidance recesses for reducing a frictional area between the guide bar and the liner.

20. The refrigerator according to the thirteenth embodiment, further comprising a moving frame cover coupled to the support cover for covering the moving frame.

21. The refrigerator according to the twentieth embodiment, wherein the moving frame is provided with a roller such that the moving frame is slidably supported by the moving frame cover via the roller.

22. The refrigerator according to the ninth embodiment, wherein the moving frame is formed in a plate shape having a vertical height larger than a width in a direction in which the moving frame moves and a thickness smaller than the width.

23. The refrigerator according to the twenty-second embodiment, further comprising a transfer member for transferring movement of the moving frame to the drawers through a through part formed in the support cover.

24. The refrigerator according to the twenty-third embodiment, wherein the transfer member extends from the moving frame in a thickness direction of the moving frame such that the transfer member extends through the through part.

25. A refrigerator comprising:

a cabinet having a storage compartment with a food introduction port formed in a front thereof;

a door hingedly connected to the cabinet for opening and closing the storage compartment;

a drawer disposed in the storage compartment;

a moving frame configured to selectively push the drawer such that the drawer is moved toward the food introduction port;

an electric driving unit coupled to the moving frame for moving the moving frame toward the food introduction port; and a controller for controlling the electric driving unit to move the moving frame when it is sensed that the door is open, wherein the drawer remains separated from the moving frame at a position at which a front part of the drawer is withdrawn after escaping from the food introduction port.

26. The refrigerator according to the twenty-fifth embodiment, wherein the electric driving unit is driven such that the drawer is withdrawn from an initial position to a ready position at which the front part of the drawer does not escape from the food introduction port.

27. The refrigerator according to the twenty-sixth embodiment, wherein the withdrawal of the drawer from the initial position to the ready position is performed by a driving force of the electric driving unit regardless of application of a user's force to open the door.

28. The refrigerator according to the twenty-sixth embodiment, wherein a connection between the moving frame and the drawer is maintained such that moving frame pushes the drawer to the ready position.

29. The refrigerator according to the twenty-sixth embodiment, wherein a connection between the moving frame and the drawer is released when the moving frame returns rearward.

30. The refrigerator according to the twenty-fifth embodiment, wherein the drawer is configured to be manually withdrawn from a ready position of the drawer to a maximum withdrawal position of the drawer.

31. The refrigerator according to any one of the twenty-fifth to thirtieth embodiments, wherein the drawer is configured to be manually inserted.

32. The refrigerator according to the thirty-first embodiment, wherein the electric driving unit is driven to move the moving frame toward the food introduction port and is then driven to return the moving frame such that the drawer is manually inserted.

33. A refrigerator comprising:

a cabinet having a storage compartment with a food introduction port formed in a front thereof;

a door hingedly connected to the cabinet for opening and closing the storage compartment;

a drawer disposed in the storage compartment;

a moving frame configured to selectively push the drawer such that the drawer is moved toward the food introduction port;

an electric driving unit coupled to the moving frame for moving the moving frame toward the food introduction port;

a controller for controlling the electric driving unit to move the moving frame when it is sensed that the door is open; and an elastic device coupled to one side of the drawer and an inside wall of the storage compartment for selectively generating an elastic restoring force, wherein the drawer is returned by the elastic restoring force.

34. The refrigerator according to the thirty-third embodiment, wherein the elastic device is elastically deformed as the drawer is withdrawn and provides the elastic restoring force to the drawer when the drawer is inserted.

35. The refrigerator according to the thirty-third embodiment, wherein the elastic device is selectively connected with the drawer.

36. The refrigerator according to the thirty-fifth embodiment, wherein the drawer is provided with a catching member, and the elastic device comprises a hanging member configured to be selectively connected with the catching member.

37. The refrigerator according to the thirty-sixth embodiment, wherein the elastic device further comprises a spring configured to be elastically deformed and elastically restored depending on displacement of the hanging member.

38. The refrigerator according to the thirty-seventh embodiment, wherein the electric driving unit drives the drawer such that the drawer is withdrawn from an initial position to a ready position.

39. The refrigerator according to the thirty-eighth embodiment, wherein a connection between the elastic device and the drawer is maintained at the ready position of the drawer.

40. The refrigerator according to the thirty-ninth embodiment, wherein the drawer is configured to be manually withdrawn from the ready position to a maximum withdrawal position.

41. The refrigerator according to the fortieth embodiment, wherein the connection between the elastic device and the drawer is released when the drawer is withdrawn forward from the ready position.

42. The refrigerator according to the forty-first embodiment, wherein the elastic device is elastically deformed by a driving force of the electric driving unit when the drawer is withdrawn to the ready position, and the elastic device is elastically deformed by a user's force to manually withdraw the drawer when the drawer is withdrawn from the ready position until the connection between the elastic device and the drawer is released.

43. The refrigerator according to the forty-second embodiment, wherein the elastic device remains elastically deformed when the connection between the elastic device and the drawer is released.

44. The refrigerator according to the thirty-eighth embodiment, wherein the connection between the elastic device and the drawer is maintained at the initial position of the drawer.

45. The refrigerator according to the forty-fourth embodiment, wherein the connection between the elastic device and the drawer is maintained from the initial position to the ready position of the drawer.

46. The refrigerator according to the forty-fourth embodiment, wherein the connection between the elastic device and the drawer is released at the ready position of the drawer.

47. The refrigerator according to the thirty-eighth embodiment, wherein the connection between the elastic device and the drawer is released at the initial position of the drawer, and the elastic device and the drawer are connected with each other before the drawer is withdrawn to the ready position.

48. The refrigerator according to the forty-seventh embodiment, wherein the connection between the elastic device and the drawer is released again at the ready position of the drawer.

49. The refrigerator according to the thirty-seventh embodiment, wherein the elastic device further comprises a housing for receiving the spring, the housing being provided with a slot for guiding movement of the hanging member.

50. The refrigerator according to the forty-ninth embodiment, wherein the hanging member protrudes in a direction parallel to the housing or in a direction perpendicular to the housing such that the hanging member is selectively connected with the drawer.

51. A refrigerator comprising:

a cabinet having a storage compartment with a food introduction port formed in a front thereof;

a door hingedly connected to the cabinet for opening and closing the storage compartment;

a drawer disposed in the storage compartment;

a moving frame coupled to the drawer for moving the drawer forward and rearward;

an electric driving unit coupled to the moving frame; and a controller for controlling the electric driving unit to move the moving frame when it is sensed that the door is open or closed, wherein the controller controls the electric driving unit to be driven at a higher speed when the door is closed than when the door is opened.

52. The refrigerator according to the fifty-first embodiment, wherein the electric driving unit is driven to withdraw the drawer from an initial position to a ready position when it is sensed that the door is open.

53. The refrigerator according to the fifty-second embodiment, wherein the withdrawal of the drawer from the initial position to the ready position is automatically performed by a driving force of the electric driving unit regardless of application of a user's force to open the door.

54. The refrigerator according to the fifty-first embodiment, wherein the drawer is configured to be automatically inserted to the initial position by an elastic restoring force provided by the elastic device.

55. The refrigerator according to the fifty-fourth embodiment, wherein the electric driving unit is driven to return the moving frame rearward when it is sensed that the door is closed.

56. The refrigerator according to the fifty-fifth embodiment, wherein the moving frame is controlled such that a speed at which the moving frame moves rearward is higher than a speed at which the moving frame moves forward.

57. The refrigerator according to the fifty-sixth embodiment, wherein the electric driving unit is driven to return the moving frame rearward after moving the moving frame forward.

58. The refrigerator according to the fifty-fourth embodiment, wherein the elastic device is elastically deformed as the drawer is withdrawn from the initial position, and the connection between the drawer and the elastic device is released in a state in which the elastic device remains elastically deformed at the ready position.

59. The refrigerator according to the fifty-eighth embodiment, wherein the electric driving unit is driven to return the moving frame rearward after moving the moving frame forward.

60. The refrigerator according to the fifty-ninth embodiment, wherein the electric driving unit is driven to move the returned moving frame rearward when it is sensed that the door is closed, and the drawer moves rearward such that the drawer is reconnected with the elastic device as a result of rearward movement of the moving frame.

61. A refrigerator comprising:

a cabinet having a storage compartment with a food introduction port formed in a front thereof;

a door hingedly connected to the cabinet for opening and closing the storage compartment;

a drawer disposed in the storage compartment;

a fixed rail coupled to a sidewall of the storage compartment for supporting a load of the drawer;

a moving rail movably coupled to the fixed rail, the moving rail being coupled to a side surface of the drawer;

a moving frame for selectively pushing the drawer to move the drawer toward the food introduction port;

an electric driving unit coupled to the moving frame for moving the moving frame toward the food introduction port; and a controller for controlling the electric driving unit to move the moving frame when it is sensed that the door is open.

62. The refrigerator according to the sixty-first embodiment, wherein the moving frame is configured to be movable relative to the sidewall of the storage compartment separately from the rail.

63. The refrigerator according to the sixty-second embodiment, further comprising:

a support cover configured to be coupled to the sidewall of the storage compartment, wherein the fixed rail is mounted to an outside surface of the support cover.

64. The refrigerator according to the sixty-third embodiment, wherein the moving frame is movably mounted to an inside surface of the support cover.

65. The refrigerator according to the sixty-fourth embodiment, wherein the drawer is provided with a catching member, and the refrigerator further comprises a transfer member selectively connected with the catching member for selectively transferring movement of the moving frame to the catching member.

66. The refrigerator according to the sixty-fifth embodiment, wherein the support cover is provided with a slit, and the transfer member is configured to extend through the slit so as to interconnect the moving frame and the catching member.

67. The refrigerator according to the sixty-fifth embodiment, wherein the transfer member and the catching member are connected with each other such that only a horizontal force is transferred to the catching member.

68. The refrigerator according to the sixty-seventh embodiment, wherein the transfer member is configured to push the catching member at a rear of the catching member.

69. The refrigerator according to the sixty-sixth embodiment, wherein the fixed rail is mounted to the support cover via a front rail bracket and a rear rail bracket, and the slit is formed between the front rail bracket and the rear rail bracket such that a forward and rearward movement of the transfer member is not impeded by the front rail bracket and the rear rail bracket.

70. The refrigerator according to the sixty-fifth embodiment, wherein the drawer is provided at a side surface thereof with a rail coupling part located on the moving rail so as to be connected with the moving rail.

71. The refrigerator according to the seventieth embodiment, wherein the catching member protrudes from the rail coupling part in a lateral direction such that the catching member and the moving rail are arranged side by side in a leftward and rightward direction.

72. The refrigerator according to the sixty-third embodiment, wherein the support cover and the sidewall are provided with a plurality of fastening parts such that a load applied to the support cover is transferred to the sidewall via the fastening parts.

73. The refrigerator according to the seventy-second embodiment, wherein a load of the drawer is transferred to the support cover via the moving rail and the fixed rail, and the moving frame is selectively connected with the drawer only in a horizontal direction such that the load of the drawer is not transferred to the moving frame.

74. A refrigerator comprising:

a cabinet having a storage compartment with a food introduction port formed in a front thereof;

a door hingedly connected to the cabinet for opening and closing the storage compartment;

a support cover mounted to an inside wall of the storage compartment so as to define a sidewall of the storage compartment, the support cover being provided with a through part;

a plurality of rails mounted to an outside surface of the support cover, the rails being arranged vertically;

a plurality of drawers disposed in the storage compartment such that the drawers are inserted or withdrawn through the food introduction port along the rails, the drawers being arranged vertically;

a moving frame disposed inside the support cover, the moving frame extending vertically so as to correspond to a height at which the drawers are disposed, the moving frame being configured to selectively push the drawers through a transfer member extending through the through part such that the drawers are moved toward the food introduction port;

an electric driving unit coupled to the moving frame for moving the moving frame toward the food introduction port inside the support cover; and a controller for controlling the electric driving unit to move the moving frame when it is sensed that the door is open.

75. The refrigerator according to the seventy-fourth embodiment, wherein the support cover is coupled to the sidewall of the storage compartment so as to cover the electric driving unit and the moving frame such that the electric driving unit and the moving frame are prevented from being exposed in the storage compartment.

76. The refrigerator according to the seventy-fourth embodiment, wherein the sidewall is provided with a through part, through which the electric driving unit is inserted, or a recess, into which the electric driving unit is inserted.

77. The refrigerator according to the seventy-sixth embodiment, wherein the sidewall is a partition wall for partitioning the storage compartment into left and right storage compartments, and the support cover is mounted to the partition wall.

78. The refrigerator according to the seventy-fourth embodiment, wherein the through part or the recess is formed between an upper rail and a lower rail.

79. The refrigerator according to the seventy-fourth embodiment, wherein the electric driving unit comprises:

a motor assembly comprising a motor;

a housing for receiving the motor assembly; and a connection member coupled to the moving frame, the connection member being configured such that a length by which the connection member protrudes from the housing is variable.

80. The refrigerator according to the seventy-ninth embodiment, wherein the support cover is provided with a motor avoidance recess for receiving at least a portion of the motor.

81. The refrigerator according to any one of the seventy-fourth to eightieth embodiments, wherein the rails, the moving frame, and the electric driving unit are mounted to the support cover so as to constitute a single moving assembly, and the support cover is separably coupled to the sidewall, whereby the moving assembly is separably coupled to the sidewall.

82. The refrigerator according to the eighty-first embodiment, wherein the moving assembly comprises an elastic device mounted to the support cover for selectively providing an elastic restoring force to each of the drawers.

83. The refrigerator according to the eighty-first embodiment, wherein each of the drawers comprises:

a basket for receiving goods; and a drawer frame for receiving the basket downward from above, the drawer frame being provided with a rail coupling part coupled to a corresponding one of the rails.

84. The refrigerator according to the eighty-third embodiment, wherein the rail coupling part is formed in a channel shape such that the rail coupling part is located on the rail downward from above so as to surround the rail.

85. The refrigerator according to the eighty-fourth embodiment, wherein the rail is provided at a rear thereof with a catching part, into which a rear end of the rail coupling part is inserted, and the rail is provided at a front thereof with an elastic protrusion, which is inserted into a mounting hole provided in a front end of the rail coupling part.

86. The refrigerator according to the eighty-fifth embodiment, wherein the rail comprises a moving rail and a fixed rail provided under the moving rail for slidably supporting the moving rail, and the rail coupling part is coupled to the moving rail.

87. The refrigerator according to the eighty-sixth embodiment, wherein the mounting hole is formed in a side flange configured to cover an outside surface of the moving rail, and the elastic protrusion is elastically deformed toward left and right middles of the drawer and is then restored and inserted into the mounting hole.

88. The refrigerator according to the eighty-fourth embodiment, wherein the rail coupling part is provided with a first catching member configured to be selectively connected with the transfer member.

89. The refrigerator according to the eighty-eighth embodiment, further comprising:

an elastic device mounted to the support cover for selectively providing an elastic restoring force to each of the drawers, wherein the rail coupling part is provided with a second catching member configured to be selectively connected with the elastic device.

90. The refrigerator according to the eighty-ninth embodiment, wherein the second catching member is provided above the first catching member such that the second catching member is separably coupled to the rail coupling part.

What is claimed is:

1. A refrigerator comprising:

a cabinet having a storage compartment;

a door hingedly connected to the cabinet for opening and closing the storage compartment;

a drawer provided in the storage compartment, and configured to be withdrawn from an initial position to a ready position spaced apart forward from the initial position by a predetermined distance;

a moving assembly provided in a sidewall, and configured to support the drawer moving forward and backward, wherein the moving assembly comprises an electric driving unit configured to automatically move the drawer from the initial position to the ready position, wherein the electric driving unit is mounted to a supporting cover, and wherein the electric driving unit is provided within a space provided between the sidewall and the supporting cover.

2. The refrigerator according to claim 1, wherein the electric driving unit is mounted to an inner side of the supporting cover and provided within the space.

3. The refrigerator according to claim 2, further comprising:

a rail configured to allow the drawer to slide forward and backward relative to the storage compartment, wherein the rail is mounted to an outer side of the supporting cover.

4. The refrigerator according to claim 3, wherein the electric driving unit comprises:

a motor assembly configured to provide force for moving the drawer; and a moving frame configured to push the drawer such that the drawer is withdrawn while being moved forward by driving of the motor assembly.

5. The refrigerator according to claim 4, wherein the supporting cover is provided with a slit, and wherein the moving frame comprises a transfer member configured to extend through the slit so as to transfer the force of the motor assembly from the inner side of the supporting cover to the drawer in the outer side of the supporting cover.

6. The refrigerator according to claim 4, wherein the cabinet has a plurality of storage compartments, wherein the sidewall is a partitioning wall located between the plurality of storage compartments, and wherein the sidewall is provided with a through part, through which the electric driving unit is inserted.

7. The refrigerator according to claim 6, wherein the motor assembly comprises a first and a second motor assemblies, each of which is located on a left side and a right of the partitioning wall, wherein the first motor assembly located on the left side of the partitioning wall for moving the drawer in a left side storage compartment is extended to the right side of the partitioning wall, and wherein the second motor assembly located on the right side of the partitioning wall for moving the drawer in a right side storage compartment is extended to the left side of the partitioning wall.

8. The refrigerator according to claim 4, wherein the moving assembly is loaded to the sidewall and removed from the sidewall as a single assembly based on the supporting cover.

9. The refrigerator according to claim 8, wherein the drawer comprises a plurality of drawers, and wherein the supporting cover comprises a plurality of rails for each of the plurality of drawers.

10. The refrigerator according to claim 9, wherein the moving frame is a single moving frame extended from upside to downside such that the single moving frame is connected to the plurality of drawers.

* * * * *